US012644240B2

(12) United States Patent
Balbabyan

(10) Patent No.: US 12,644,240 B2
(45) Date of Patent: Jun. 2, 2026

(54) WASTE PICKING, STORAGE, AND DISPOSAL DEVICE

(71) Applicant: Khachatur Balbabyan, Freehold, NJ (US)

(72) Inventor: Khachatur Balbabyan, Freehold, NJ (US)

( * ) Notice: Subject to any disclaimer, the term of this patent is extended or adjusted under 35 U.S.C. 154(b) by 857 days.

(21) Appl. No.: 17/929,715

(22) Filed: Sep. 5, 2022

(65) Prior Publication Data

US 2023/0075370 A1 Mar. 9, 2023

Related U.S. Application Data

(60) Provisional application No. 63/240,972, filed on Sep. 5, 2021.

(51) Int. Cl.
*E01H 1/12* (2006.01)

(52) U.S. Cl.
CPC ... *E01H 1/1206* (2013.01); *E01H 2001/1226* (2013.01); *E01H 2001/1286* (2013.01)

(58) Field of Classification Search
CPC ..... E01H 1/1206; E01H 2001/1286; E01H 2001/1226; E01H 2001/128; E01H 2001/1293; A61B 17/282
USPC ..... 294/1.3
See application file for complete search history.

(56) References Cited

U.S. PATENT DOCUMENTS 4,815,476 A * 3/1989 Clossick ..... A61B 10/00 606/208
6,305,322 B1 10/2001 Patel
7,281,740 B1 * 10/2007 Fields ..... A01B 1/16 294/100
7,625,025 B1 * 12/2009 Zahedi ..... E01H 1/1206 294/1.3
9,187,871 B1 11/2015 Contreras
10,287,737 B2 5/2019 Casey
10,851,506 B1 12/2020 Sabella
11,814,801 B2 * 11/2023 Chapman ..... E01H 1/1206
D1,011,852 S * 1/2024 Smith ..... D8/51
D1,073,217 S * 4/2025 Chen ..... D30/162
2004/0123812 A1 7/2004 Condon
2009/0200812 A1 8/2009 Mambru
2012/0256430 A1 * 10/2012 Merino-Garcia .... A01K 27/004 294/1.3
2014/0152031 A1 * 6/2014 Ballacchino ..... E01H 1/1206 294/1.3

(Continued)

*Primary Examiner* — Paul T Chin
(74) *Attorney, Agent, or Firm* — Ashok Tankha

(57) ABSTRACT

A waste picking, storage, and disposal device includes a housing, a handle, gripping elements, a pull system, and an end cap. The gripping elements are radially hinged to a lower end of the housing. The pull system moves axially within a through-hole of the housing. The pull system includes a pull lever; a hollow chamber for storing disposable bags; braces radially hinged to a lower end of the hollow chamber and connected to the gripping elements; and a bag dispenser for dispensing a disposable bag. When the pull lever is operated axially in opposing directions, the lower end of the hollow chamber with the bag dispenser moves axially within an internal space defined by the gripping elements wrapped by the disposable bag, and via the braces, causes the wrapped gripping elements to open and close for picking, encapsulating, and storing pet waste within the disposable bag for subsequent disposal.

20 Claims, 31 Drawing Sheets

(56) References Cited

U.S. PATENT DOCUMENTS

| | | | | |
|---|---|---|---|---|
| 2016/0354101 | A1* | 12/2016 | Melsheimer | A61B 17/29 |
| 2020/0157753 | A1* | 5/2020 | Patterson | H05B 3/0014 |
| 2022/0354345 | A1* | 11/2022 | Bagley | A61B 1/00087 |
| 2022/0380992 | A1* | 12/2022 | Chapman | E01H 1/1206 |

* cited by examiner

WASTE PICKING, STORAGE, AND DISPOSAL DEVICE

CROSS-REFERENCE TO RELATED APPLICATIONS

This application claims priority to and the benefit of the provisional patent application titled "Mechanical Hand-Operated Dog Waste Sanitary Collection and Transportation Device", application No. 63/240,972, filed in the United States Patent and Trademark Office on Sep. 5, 2021, and the non-provisional patent application titled "Pet Toilet Collector", application number 202221504843.1, filed in the China National Intellectual Property Administration (CNIPA) on Jun. 15, 2022. The specifications of the above referenced patent applications are incorporated herein by reference in their entirety.

BACKGROUND

Animal waste is one of the sources of pollution that impacts water quality, animal health, and human health. Animal waste contains pollutants, disease-causing bacteria, viruses, and other pathogens, that when improperly disposed, pollutes water and soil. Animal waste has a strong, unpleasant odor, attracts vermin such as flies, mice, rats, etc., and may come into direct contact with other animals and humans in public areas and on private property. Water polluted by the animal waste is unusable for activities such as swimming, boating, fishing, etc., and causes severe illnesses in animals and humans. Some diseases can be transmitted from the animal waste on the soil to other animals and humans through contact with the soil.

Pet owners are typically advised to pick up after their pets on their lawns, at parks, and at other public areas where they take their pets for a walk. There are several ordinances to regulate cleanup of animal waste. These ordinances require the removal and proper disposal of animal waste from public areas and private property before a pet owner leaves the immediate area. However, animal waste cleanup during walking and other activities is an unpleasant experience for pet owners and is often difficult to perform while handling their pets. The most common method of cleaning up after pets is to pick up the animal waste with plastic bag-covered hands. Some pet owners carry a plastic bag, cover their hand with the plastic bag, and pick up the animal waste with their plastic bag-covered hand. However, during pick up, some of the animal waste may contact and contaminate the pet owner's hands. Furthermore, once picked up, the pet owner must then carry the plastic bag filled with the animal waste around until a proper disposal site is found. Since animal waste cleanup is cumbersome and unpleasant, some pet owners choose to leave the animal waste where the animal waste is dropped, which creates numerous sanitary problems and a serious health hazard for animals that come in direct contact with the animal waste, and for humans that come in direct contact with the animal waste, for example, through contamination of ground water, through contact with contaminated soil, or through contact with infected animals and/or infected humans. Furthermore, failure to perform animal waste cleanup may result in fines being levied on the pet owners. Conventional devices, for example, pet waste scoopers, shovels, etc., used for scooping and disposing the animal waste are either too bulky to carry around or difficult to use. Moreover, these conventional devices do not provide compact and concealed storage for carrying the animal waste around until a proper disposal site is found.

Hence, there is a long-felt need for a compact, lightweight, convenient, portable, sealable device and a sanitary method for picking, storing, and disposing waste, for example, animal waste and other waste such as garbage, debris, etc., with ease.

SUMMARY OF THE INVENTION

This summary is provided to introduce a selection of concepts in a simplified form that are further disclosed in the detailed description of the invention. This summary is not intended to determine the scope of the claimed subject matter.

The device and the method disclosed herein address the above-recited need for a compact, lightweight, convenient, portable, sealable device and a sanitary method for picking, storing, and disposing waste, for example, animal waste and other waste such as garbage, debris, etc., with ease. The device disclosed herein is a mechanical device for picking, storing, and disposing waste. The device integrates a capsule-shaped shell, a compression spring-loaded gripper mechanism, and a built-in bag dispenser into a single system. The device provides compact and concealed storage for carrying animal waste around until a proper disposal site is found.

The device disclosed herein comprises a generally cylindrical housing, a handle, multiple gripping elements, a pull system, and an end cap. The device is shaped as a capsule when the end cap is attached to a lower end of the cylindrical housing. The cylindrical housing comprises a first end and a second end. The first end and the second end of the cylindrical housing define a through-hole extending therebetween. The handle extends upwardly from the first end of the cylindrical housing. The handle is configured to be gripped by a user, for example, a pet owner, during operation of the pull system. The handle is disposed a predetermined distance away from the pull lever of the pull system for allowing movement of the pull lever within a space defined between the handle and the first end of the cylindrical housing. The gripping elements are radially hinged to the second end of the cylindrical housing. The gripping elements extend downwardly from the second end of the cylindrical housing. The pull system is disposed axially within the through-hole of the cylindrical housing and is operably coupled to the gripping elements. The pull system is configured to move axially within the through-hole of the cylindrical housing.

The pull system comprises a pull lever, a hollow chamber, multiple braces, and a bag dispenser. The pull lever is disposed external to the first end of the cylindrical housing. The pull lever is configured to be operated axially in opposing directions, for example, an upward direction and a downward direction, to facilitate opening and closing of the gripping elements for picking the waste. In an embodiment, the device further comprises a spring-loaded mechanism disposed within the cylindrical housing and configured to control operation of the pull system. The spring-loaded mechanism comprises spring members supported at the first end of the cylindrical housing, on opposing sides of the hollow chamber of the pull system. The spring members facilitate an upward movement and a downward movement of the pull system. In an embodiment, operating the pull lever in a first direction, for example, the downward direction, opens the gripping elements to facilitate ready picking of the waste, and operating the pull lever in a second direction, for example, the upward direction, opposing the first direction, closes the gripping elements for storage thereof and for encapsulating and storing the picked waste. In an embodiment, the diameter of a lower end of the pull lever of the pull system is substantially larger than the diameter of the through-hole of the cylindrical housing. The hollow chamber is detachably connected to a lower end of the pull lever. The hollow chamber is disposed axially within the through-hole extending between the first end and the second end of the cylindrical housing. The hollow chamber is configured to store a continuous roll of disposable bags therewithin. In an embodiment, the pull system further comprises a mounting rod disposed axially within an internal space of the hollow chamber. The mounting rod comprises a first end detachably connected to the lower end of the pull lever, and a second end attached to the bag dispenser. The mounting rod is configured to accommodate the continuous roll of disposable bags thereon within the internal space of the hollow chamber. The pull lever is detached from the first end of the mounting rod for loading the continuous roll of disposable bags onto the mounting rod.

The braces are radially hinged to a lower end of the hollow chamber in a one-to-one correspondence to the gripping elements. Each of the braces comprises a first end and a second end. The first end of each brace is hinged to the lower end of the hollow chamber. The second end of each brace is operably hinged to a pair of flanges configured substantially on a mid-section of a corresponding one of the gripping elements for facilitating the opening and the closing of the gripping elements. The bag dispenser is disposed proximal to the lower end of the hollow chamber and to the second end of the cylindrical housing for supporting the continuous roll of disposable bags. The bag dispenser comprises an external opening configured to dispense one of the disposable bags stored in the hollow chamber for containing and disposing the waste. The dispensed, disposable bag is configured to be wrapped around the gripping elements to protect the gripping elements from directly contacting the waste. When the pull lever is operated axially in the opposing directions, the lower end of the hollow chamber with the bag dispenser moves axially within an internal space defined by the gripping elements, and via the braces, causes the wrapped gripping elements to open and close for picking, encapsulating, and storing the waste within the dispensed, disposable bag for subsequent disposal.

In an embodiment, the cylindrical housing further comprises a first cylindrical member, a second cylindrical member, and a third cylindrical member. The first cylindrical member extends downwardly from the first end of the cylindrical housing. The second cylindrical member is disposed on an outer wall of the first cylindrical member. The second cylindrical member is removably fixed in an axial direction and is rotatable about the outer wall of the first cylindrical member in a circumferential direction for allowing or restricting axial movement of the hollow chamber of the pull system. The third cylindrical member is removably connected to the first cylindrical member. The third cylindrical member extends upwardly from the second end of the cylindrical housing. The third cylindrical member is internally connected to the first cylindrical member along the axial direction to define the through-hole for accommodating the pull system.

In an embodiment, the device further comprises a pair of grooves configured diametrically opposite each other on an inner wall of the first cylindrical member of the cylindrical housing. The grooves extend along the axial direction. The device further comprises a pair of sliding blocks configured diametrically opposite each other on an outer wall of the hollow chamber of the pull system. The sliding blocks of the hollow chamber are configured to match the grooves and slide within the grooves of the first cylindrical member to facilitate the movement of the pull system axially within the through-hole of the cylindrical housing. In an embodiment, the first cylindrical member comprises a slot corresponding to one of the grooves. The slot is configured to accommodate a stopper configured on an inner wall of the second cylindrical member. The slot is configured to allow the stopper to move therewithin in the circumferential direction for blocking or opening the groove during rotation of the second cylindrical member about the outer wall of the first cylindrical member. In an embodiment, the first cylindrical member further comprises a slide rail extending circumferentially on the outer wall of the first cylindrical member. The slide rail is configured to slidably accommodate a protruding element configured on the inner wall of the second cylindrical member. Each end of the slide rail comprises a notch matching the protruding element. The notch at each end is configured to accommodate the protruding element when the stopper is positioned to block or open the groove during the rotation of the second cylindrical member about the outer wall of the first cylindrical member.

The end cap is detachably attachable to the second end of the cylindrical housing. The end cap is configured to enclose and conceal the gripping elements with and without the encapsulated waste. In an embodiment, the end cap comprises a generally cylindrical, hollow upper section and a generally semi-spherical, hollow lower section with a closed end. The cylindrical, hollow upper section extends upwardly from the semi-spherical, hollow lower section. The cylindrical, hollow upper section is detachably attachable to the second end of the cylindrical housing. The semi-spherical, hollow lower section extends downwardly from the cylindrical, hollow upper section. The cylindrical, hollow upper section and the semi-spherical, hollow lower section are together configured to enclose the gripping elements. The device is configured to form a capsule when the end cap is attached to the second end of the cylindrical housing. After picking, encapsulating, and storing the waste, the end cap is attached to the second end of the cylindrical housing for concealing the encapsulated waste, thereby allowing the user to conveniently and sanitarily carry the encapsulated waste in the capsule around until a proper disposal site is found. In an embodiment, the device further comprises one or more attachment components, for example, attachment holes, connectors, etc., configured on the first end of the cylindrical housing. The attachment component(s) is configured to secure one or more straps, for example, wrist straps, lanyards, etc., to the device for allowing a user to carry the device.

Disclosed herein is also a sanitary method for picking, storing, and disposing waste, for example, animal waste. In the method disclosed herein, the device comprising the generally cylindrical housing, the handle, the gripping elements, the pull system, the spring members, and the end cap disclosed above, is provided. To operate the device, the user grips the handle and holds up the pull lever attached to the hollow chamber of the pull system, causing the spring members to compress, while detaching the end cap from the second end of the cylindrical housing to expose the gripping elements in a closed position. The user then releases the pull lever, causing the spring members to decompress and the braces to expand and open the gripping elements. The user then manually pulls one of the disposable bags out through the external opening of the bag dispenser of the pull system and wraps the disposable bag around the opened gripping elements to protect the opened gripping elements from directly contacting the waste. The user then positions the wrapped gripping elements over the waste. The user then grips the handle and pulls the pull lever, causing the spring members to compress and the braces to retract and close the wrapped gripping elements over the waste for picking and storing the waste within the disposable bag. The user then unwraps the closed gripping elements and twists and closes an open end of the disposable bag for encapsulating the waste within the disposable bag. The user then attaches the end cap to the second end of the cylindrical housing for enclosing and concealing the closed gripping elements with the encapsulated waste and thereafter transports the encapsulated waste within the device to a disposal location for subsequent disposal of the disposable bag with the encapsulated waste at the disposal location.

For the subsequent disposal of the disposable bag with the encapsulated waste, the user detaches the end cap from the second end of the cylindrical housing to expose the closed gripping elements with the encapsulated waste. The user then releases the pull lever, causing the spring members to decompress and the braces to expand and open the closed gripping elements for releasing the disposable bag with the encapsulated waste. The user then disposes the released, disposable bag with the encapsulated waste at the disposal location. Releasing the disposable bag with the encapsulated waste from the opened gripping elements dispenses another one of the disposable bags from the external opening of the bag dispenser of the pull system for subsequent picking, storing, and disposal of other waste. In an embodiment, the user locks the pull system by restricting axial movement of the hollow chamber of the pull system using the stopper configured in the cylindrical housing of the device as disclosed above. In an embodiment, the user detaches and removes the pull lever of the pull system from an upper end of the hollow chamber of the pull system for loading the continuous roll of disposable bags into the hollow chamber.

BRIEF DESCRIPTION OF THE DRAWINGS

The foregoing summary, as well as the following detailed description of the invention, is better understood when read in conjunction with the appended drawings. For illustrating the embodiments herein, exemplary constructions of the embodiments are shown in the drawings. However, the embodiments herein are not limited to the specific components, structures, and methods disclosed herein. The description of a component, or a structure, or a method step referenced by a numeral in a drawing is applicable to the description of that component, or structure, or method step shown by that same numeral in any subsequent drawing herein. The terms "upper", "lower", "front", "rear", "top", "bottom", "inner", "outer", etc., used herein are based on the orientation or positional relationship shown in the appended drawings, and are provided merely for explaining the embodiments herein, rather than indicating or implying that the referenced device, component, or structure must have a particular orientation or must be constructed and operated in a particular orientation, and therefore should not be construed as limiting the embodiments herein.

DETAILED DESCRIPTION OF THE INVENTION

Figure 1:
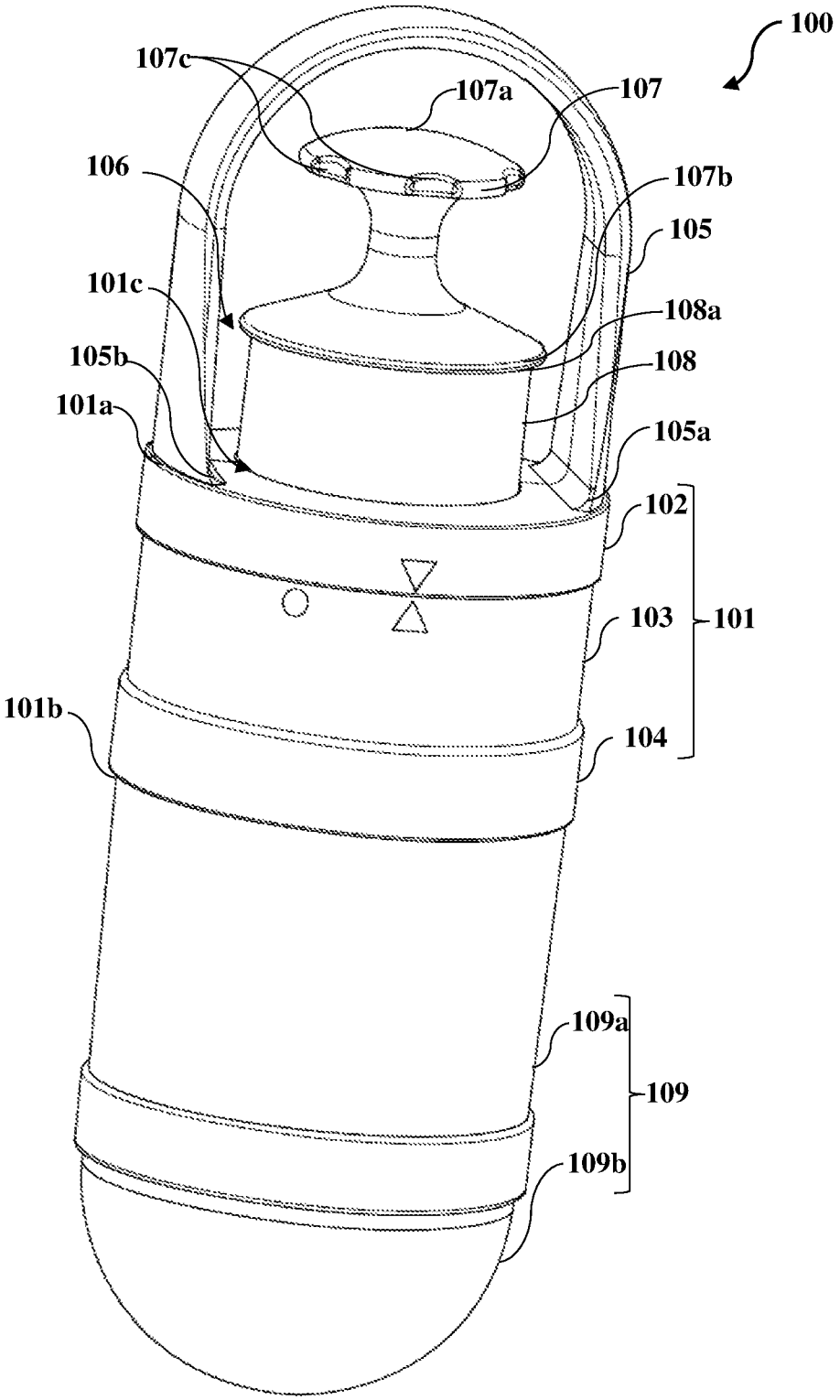
FIG. 1 illustrates a front perspective view of an embodiment of a waste picking, storage, and disposal device.
Figure 8:
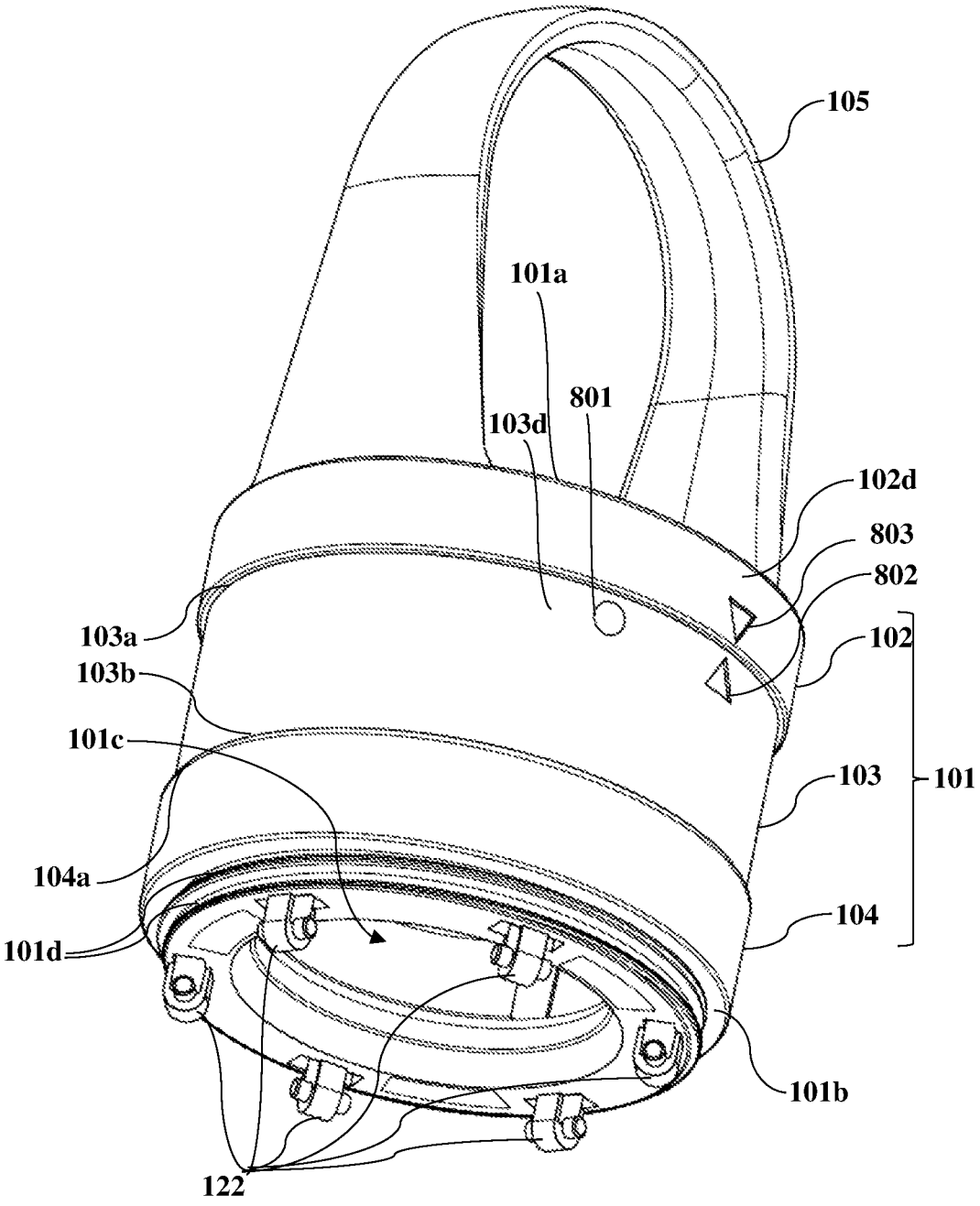
FIG. 8 illustrates a bottom perspective view of an embodiment of the cylindrical housing of the waste picking, storage, and disposal device, showing hinge components configured to hinge the gripping elements to a lower end of the cylindrical housing.
Figure 10:
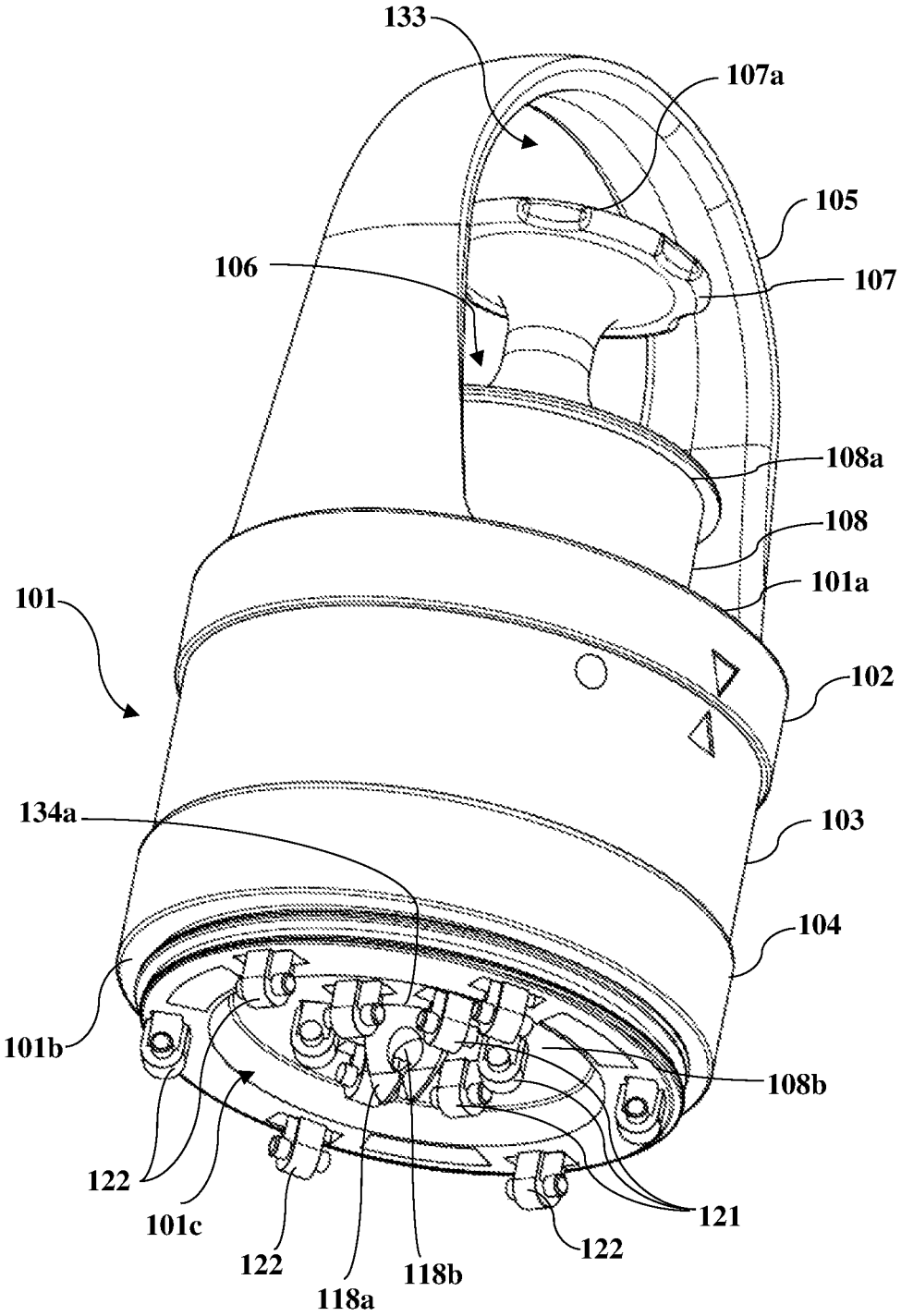
FIG. 10 illustrates a bottom perspective view of an embodiment of the cylindrical housing of the waste picking, storage, and disposal device, showing the pull system disposed axially within a through-hole of the cylindrical housing, and hinge components configured to hinge braces to a lower end of the hollow chamber of the pull system.

FIG. 1 illustrates a front perspective view of an embodiment of a waste picking, storage, and disposal device 100, hereinafter referred to as a "device". In an exemplary embodiment, the device 100 is configured to be used as a portable, hand-operated, sanitary, pet waste collection and transportation tool. The device 100 is usable as a pet accessory for pet waste collection and disposal. The device 100 is compact, lightweight, convenient to use, and sealable. The weight of the device 100 is, for example, about 12 ounces (oz). The device 100 disclosed herein comprises a generally cylindrical housing 101, a handle 105, a spring-loaded gripper with multiple gripping elements 112 illustrated in FIG. 3A, a pull system 106, and an end cap 109. The cylindrical housing 101, the handle 105, and the end cap 109 are made, for example, of plastic, a hard plastic, or a thermoplastic polymer such as acrylonitrile butadiene styrene (ABS). In an embodiment, the cylindrical housing 101, the handle 105, and the end cap 109 are made of metal. The gripping elements 112 are made of a thermoplastic material, for example, nylon or another durable and flexible plastic material that prevents breakage of the gripping elements 112. The total height of the device 100 is, for example, about $8\frac{7}{16}^{th}$ inches. The width of the device 100 is, for example, about $2\frac{5}{8}^{th}$ inches. The height of the cylindrical housing 101 is, for example, about $2\frac{5}{16}^{th}$ inches. The diameter of the cylindrical housing 101 is, for example, about $2\frac{5}{8}^{th}$ inches. The cylindrical housing 101 comprises a first end 101*a* and a second end 101*b*. As used herein, the first end 101*a* of the cylindrical housing 101 is, for example, the upper end, and the second end 101*b* of the cylindrical housing 101 is, for example, the lower end. The first end 101*a* and the second end 101*b* are hereinafter referred to as the upper end and the lower end of the cylindrical housing 101, respectively. The upper end 101*a* and the lower end 101*b* of the cylindrical housing 101 define a generally cylindrical opening extending therebetween, herein referred to as a through-hole 101*c*, as illustrated in FIG. 4B, FIG. 8, and FIG. 10. The through-hole 101*c* extends between the upper end 101*a* and the lower end 101*b* of the cylindrical housing 101 as illustrated in the cross-sectional views in FIG. 13B and FIG. 14B. The through-hole 101*c* is open at the upper end 101*a* and the lower end 101*b* of the cylindrical housing 101 as illustrated in FIG. 4B, FIG. 8, and FIG. 10, to allow the pull system 106 to pass through the through-hole 101*c*.

In an embodiment, the cylindrical housing 101 further comprises a first cylindrical member 102, a second cylindrical member 103, and a third cylindrical member 104. The terms "first", "second", and "third" are used herein for descriptive purposes only and are not to be construed to indicate or imply relative importance. The first cylindrical member 102, the second cylindrical member 103, and the third cylindrical member 104 of the cylindrical housing 101 are made, for example, of plastic, a hard plastic, or a thermoplastic polymer such as acrylonitrile butadiene styrene (ABS). The first cylindrical member 102 extends downwardly from the upper end 101*a* of the cylindrical housing 101. The second cylindrical member 103 is disposed on an outer wall 102*b* of the first cylindrical member 102 as illustrated in FIG. 8, FIGS. 9A-9B, FIG. 13C, and FIG. 15C. The second cylindrical member 103 is configured as a rotating cylinder as disclosed on the description of FIG. 8 and FIGS. 9A-9B. The second cylindrical member 103 is removably fixed in an axial direction and is rotatable about the outer wall 102*b* of the first cylindrical member 102 in a circumferential direction for one of allowing and restricting axial movement of a hollow chamber 108 of the pull system 106. The third cylindrical member 104 is removably connected to the first cylindrical member 102. The third cylindrical member 104 extends upwardly from the lower end 101*b* of the cylindrical housing 101. The third cylindrical member 104 is internally connected to the first cylindrical member 102 along the axial direction to define the through-hole 101*c* for accommodating the pull system 106 as illustrated in FIG. 8, FIG. 10, FIG. 13B, and FIG. 14B.

Figure 7A:
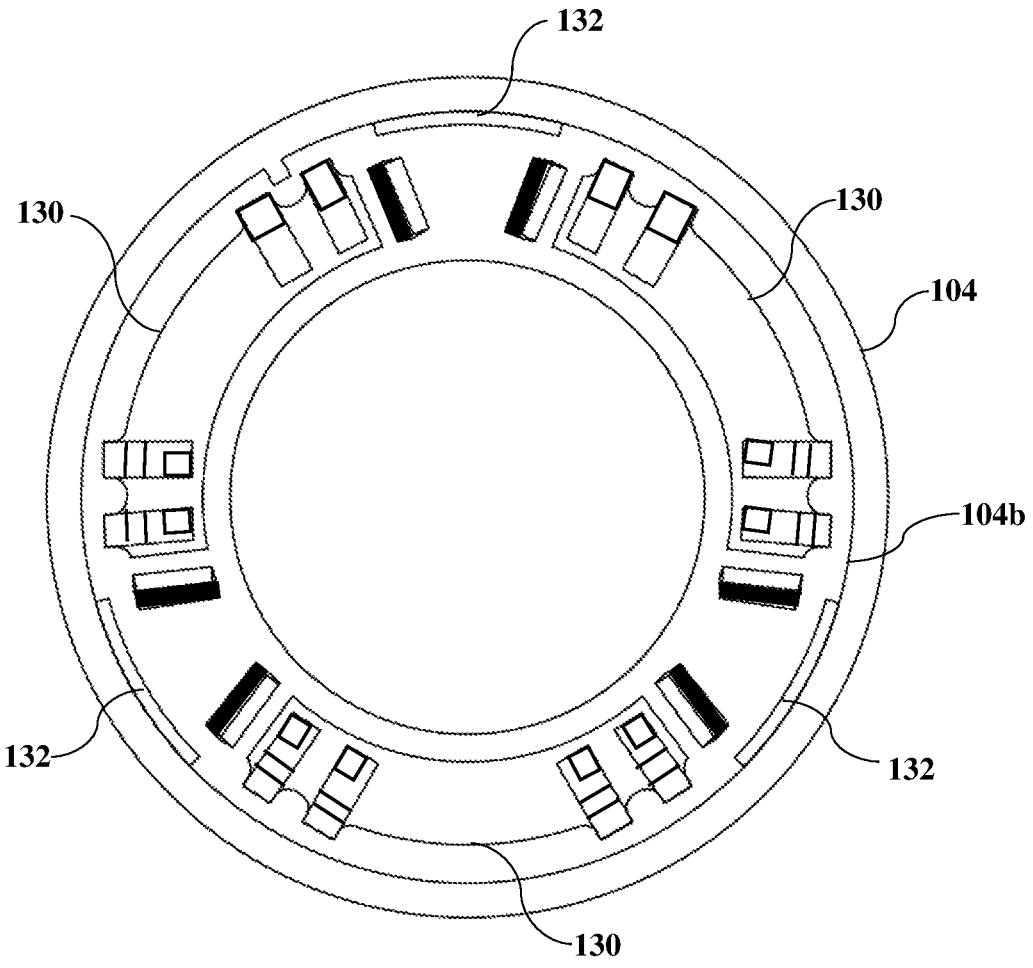
FIGS. 7A-7B illustrate a top plan view and a bottom elevation view, respectively, of an embodiment of a third cylindrical member of the cylindrical housing of the waste picking, storage, and disposal device.
Figure 7B:
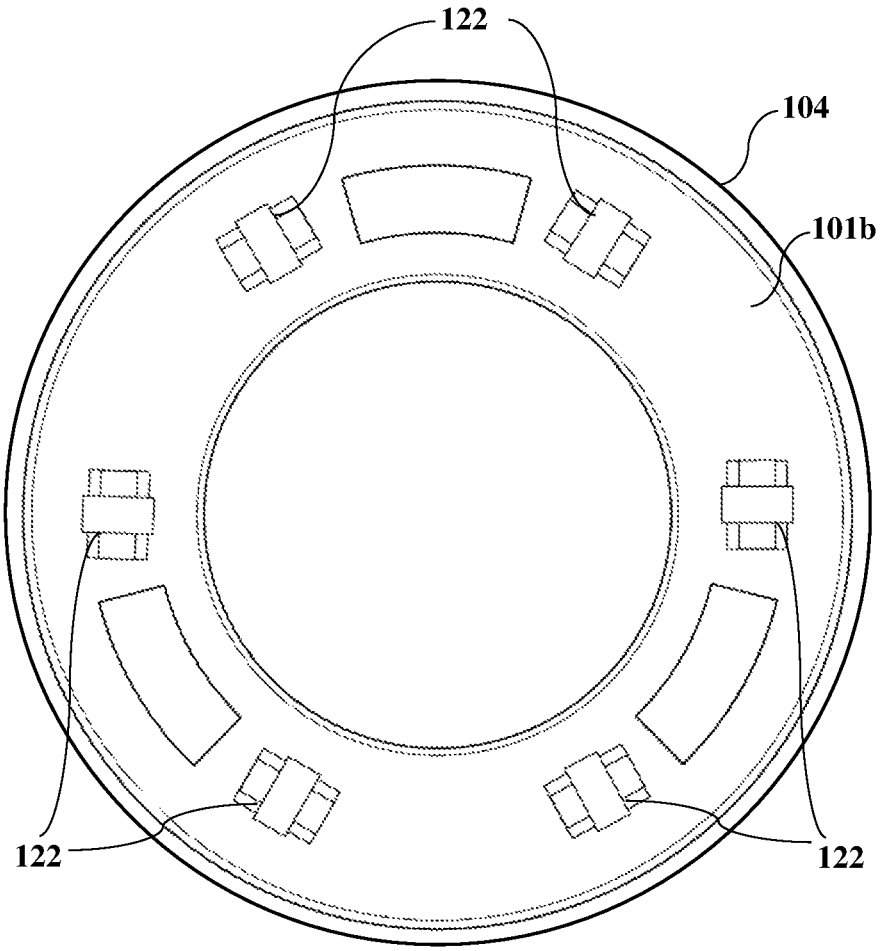

In an embodiment, the third cylindrical member 104 is detachably connected to the first cylindrical member 102 as disclosed in the description of FIGS. 7A-7B and FIG. 8. For example, the third cylindrical member 104 is snap-fitted to the first cylindrical member 102. The snap-fit connection of the third cylindrical member 104 to the first cylindrical member 102 allows convenient installation, assembly, and disassembly of the device 100. If either cylindrical member 104 or 102 is damaged, the detachable connection between the third cylindrical member 104 and the first cylindrical member 102 allows replacement of either cylindrical member 104 or 102 for normal operation of the device 100, without having to replace the entire cylindrical housing 101, thereby reducing maintenance costs. Similarly, as the second cylindrical member 103 is removably fixed in an axial direction to the outer wall 102*b* of the first cylindrical member 102, if either cylindrical member 103 or 102 is damaged, the second cylindrical member 103 can be removed from the first cylindrical member 102, and either cylindrical member 103 or 102 can be replaced for normal operation of the device 100, without having to replace the entire cylindrical housing 101, thereby reducing maintenance costs. In an embodiment, the first cylindrical member 102, the second cylindrical member 103, and the third cylindrical member 104 are in fluid communication with each other and together define the through-hole 101*c* for inserting the pull system 106. In an embodiment, the third cylindrical member 104 is configured as a grasping cylinder for allowing a user to grasp the cylindrical housing 101 while attaching and detaching the end cap 109 to and from the lower end 101*b* of the cylindrical housing 101. As used herein, the term "user" refers to any person, for example, a pet owner, a pet walker, etc., who operates the device 100 for picking, storing, and disposing waste, for example, animal waste. For purposes of illustration, the disclosure herein refers to animal waste being picked, stored, and disposed by the device 100; however, the scope of the device 100 and the method disclosed herein is not limited to picking, storing, and disposing animal waste, but extends to picking, storing, and disposing waste of any type, for example, garbage, debris, pet waste, dog waste, and other animal and non-animal waste.

The handle 105 of the device 100 extends upwardly from the upper end 101*a* of the cylindrical housing 101, above the through-hole 101*c* of the cylindrical housing 101. The height of the handle 105 is, for example, about 2¾$^{th}$ inches. The width of the handle 105 is, for example, about 2⅝$^{th}$ inches. Opposing ends 105*a* and 105*b* of the handle 105 are attached to the upper end 101*a* of the cylindrical housing 101 as illustrated in FIG. 1. The handle 105 is configured to be gripped by a user, for example, a pet owner, a pet walker, etc., during operation of the pull system 106. In an embodiment as illustrated in FIG. 1, the handle 105 is arch-shaped and rounded for providing a convenient grip to the user. The gripping elements 112 are operably coupled to the lower end 101*b* of the cylindrical housing 101 as disclosed in the description of FIG. 3A. The pull system 106 is disposed axially within the through-hole 101*c* of the cylindrical housing 101 and is operably coupled to the gripping elements 112 as illustrated in FIG. 12A, FIG. 13B, FIG. 14B, FIG. 15B, and FIG. 16B. The pull system 106 is configured to fit within the through-hole 101*c* of the cylindrical housing 101 and move axially within the through-hole 101*c*. In an embodiment, the device 100 further comprises a spring-loaded mechanism comprising spring members 119*a* and 119*b* illustrated in FIGS. 4A-4B, FIG. 14B, and FIG. 16B, disposed within the cylindrical housing 101 and configured to control operation of the pull system 106. The spring members 119*a* and 119*b* are open-coil helical springs, for example, compression springs, configured to oppose compression in an axial direction. The spring members 119*a* and 119*b* facilitate an upward movement and a downward movement of the pull system 106.

Figure 3A:
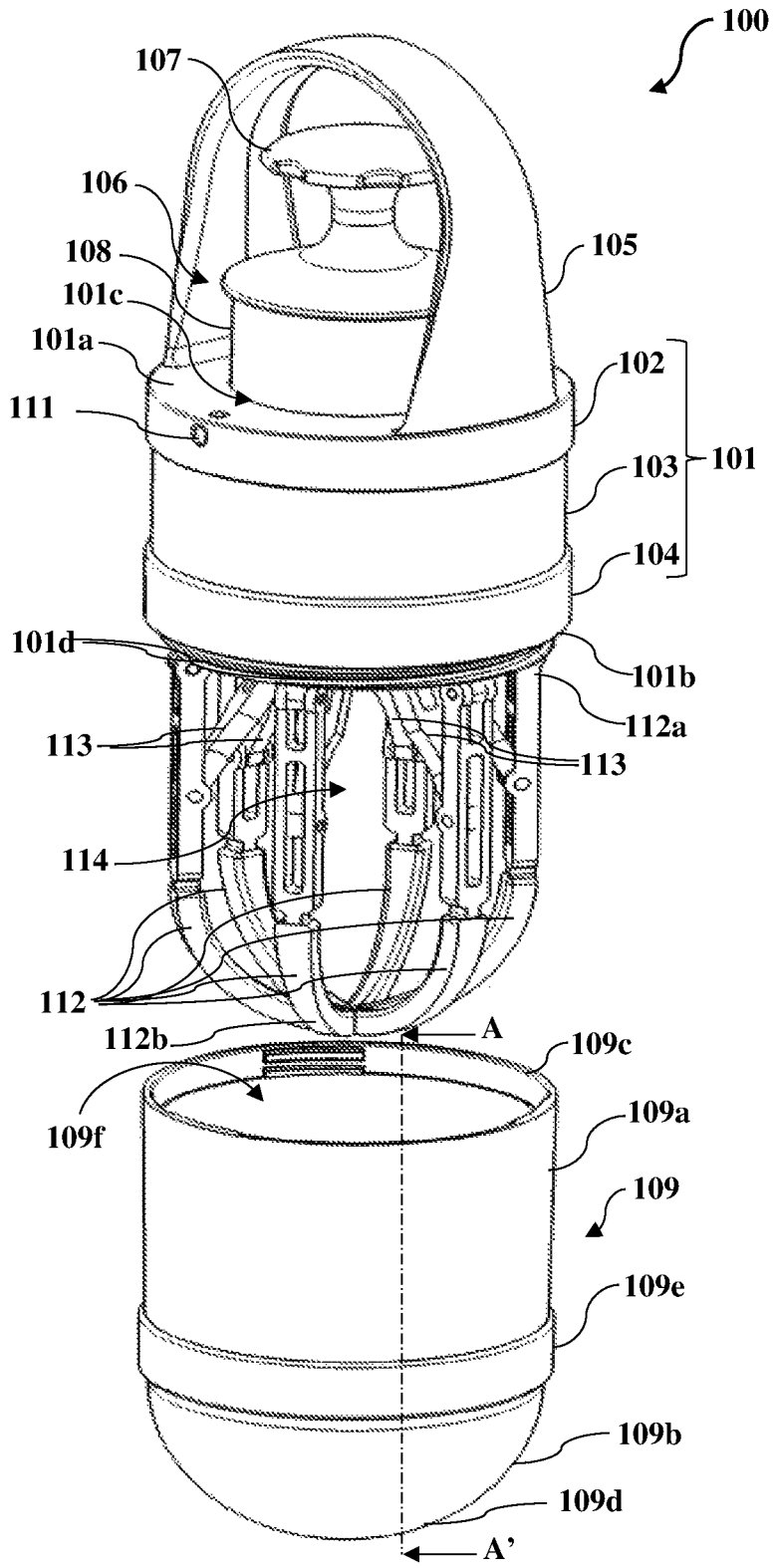
FIG. 3A illustrates a rear perspective view of an embodiment of the waste picking, storage, and disposal device, showing an end cap detached from a cylindrical housing of the device to expose gripping elements of the device in a closed position.
Figure 4A:
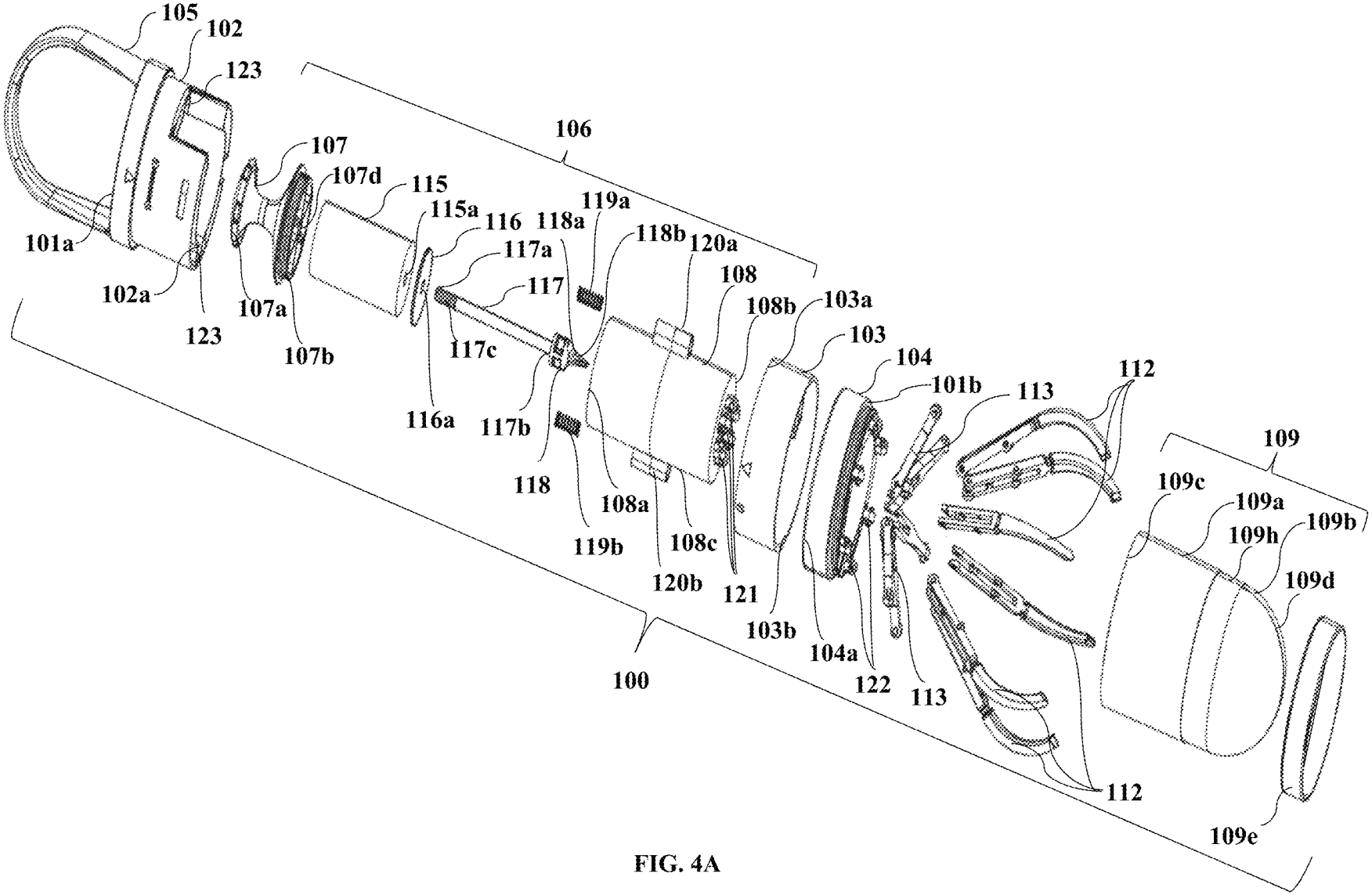
FIGS. 4A-4B illustrate exploded views of an embodiment of the waste picking, storage, and disposal device.
Figure 4B:
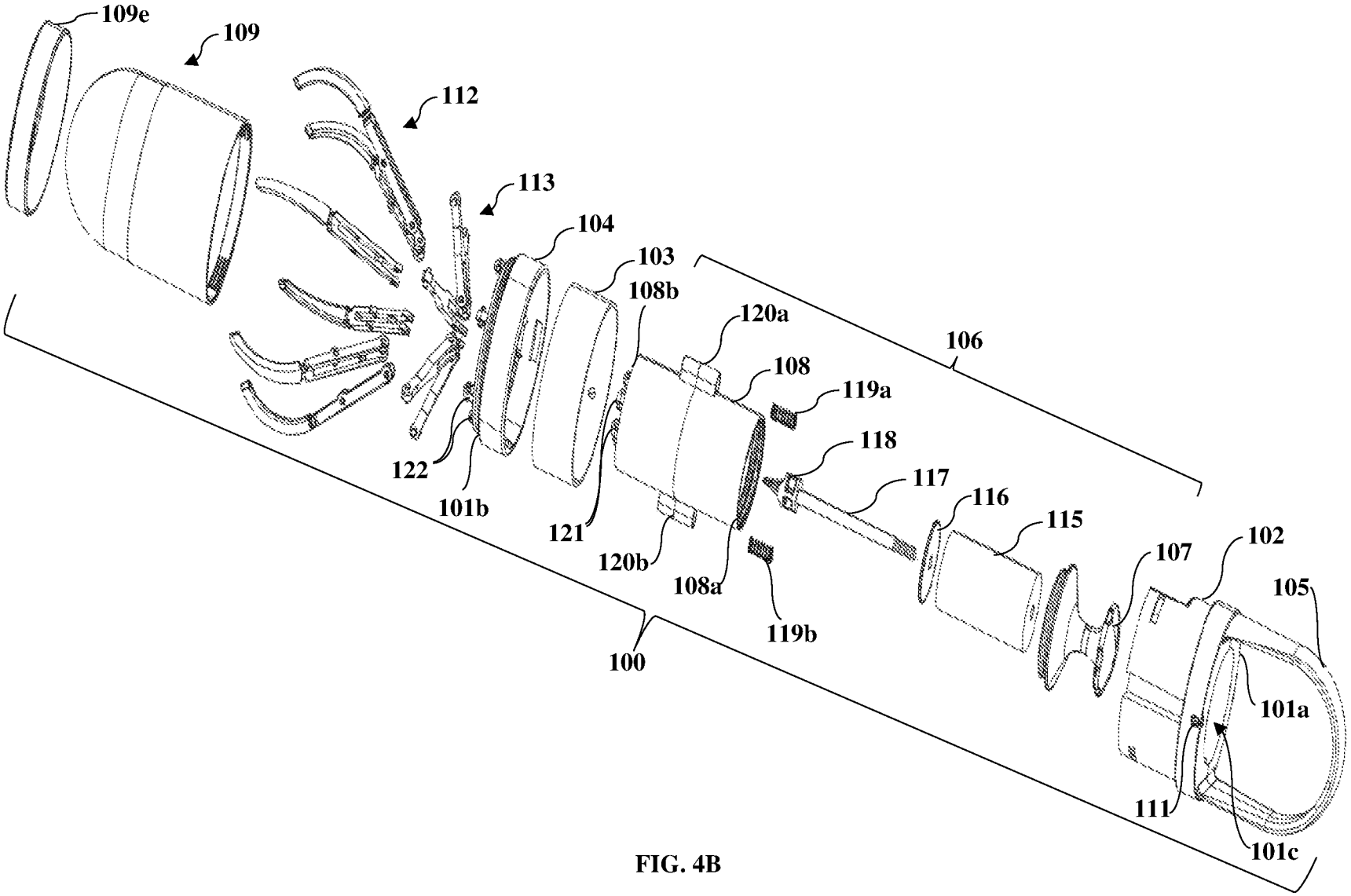

The pull system 106 comprises a pull lever 107, a hollow chamber 108, multiple braces 113 illustrated in FIG. 3A, and a built-in bag dispenser 118 illustrated in FIGS. 4A-4B, FIG. 13B, FIG. 14B, FIG. 15B, and FIG. 16B. The pull lever 107 and the hollow chamber 108 are made, for example, of plastic, a hard plastic, or a thermoplastic polymer such as acrylonitrile butadiene styrene (ABS). In an embodiment, the pull lever 107 and the hollow chamber 108 are made of metal. The bag dispenser 118 and the braces 113 are made of a thermoplastic material, for example, nylon or another durable and flexible plastic material that prevents breakage of the bag dispenser 118 and the braces 113. The pull lever 107 is disposed external to the upper end 101*a* of the cylindrical housing 101. The pull lever 107 is configured to plug the through-hole 101*c* at the upper end 101*a* of the cylindrical housing 101. In an exemplary embodiment, a contact part of the pull lever 107, that is, an upper end 107*a* of the pull lever 107, is rounded or curved in an umbrella shape to provide a convenient grip to a user's fingers when the user operates the pull lever 107. In another exemplary embodiment, grooves 107*c* are peripherally configured on the upper end 107*a* of the pull lever 107 for placing the user's fingers and allowing the user to rotate the pull lever 107 during removal of the pull lever 107 from the hollow chamber 108. The grooves 107*c* of the pull lever 107 provide a grip to the user's fingers and the user's hand when the user operates the pull lever 107. The pull lever 107 is configured to be operated axially in opposing directions, for example, an upward direction and a downward direction, to facilitate opening and closing of the gripping elements 112 for picking the waste. In an embodiment, operating the pull lever 107 in a first direction, for example, the downward direction, opens the gripping elements 112 to facilitate ready picking of the waste, and operating the pull lever 107 in a second direction, for example, the upward direction, opposing the first direction, closes the gripping elements 112 for storage thereof and for encapsulating and storing the picked waste.

In an embodiment, the diameter of a lower end 107*b* of the pull lever 107 is substantially larger than the diameter of the through-hole 101*c* of the cylindrical housing 101. The maximum size of the pull lever 107 along the radial direction of the hollow chamber 108 is larger than the diameter of the through-hole 101*c*. In an embodiment, the larger-diameter lower end 107*b* of the pull lever 107 holds the pull lever 107 firmly against the upper end 101*a* of the cylindrical housing 101 when the pull system 106 is moved in a downward direction, thereby precluding the pull system 106 from falling through the through-hole 101*c* of the cylindrical housing 101 and preventing difficulty in pulling the pull lever 107 out of the through-hole 101*c*. The hollow chamber 108 is detachably connected to the lower end 107*b* of the pull lever 107. The hollow chamber 108 is a cylindrical chamber comprising open ends, that is, an upper end 108*a* and a lower end 108*b* as illustrated in FIG. 4A and FIG. 10. The upper end 108*a* of the hollow chamber 108 is detachably connected to the lower end 107*b* of the pull lever 107. The hollow chamber 108 is disposed axially within the through-hole 101*c* extending between the upper end 101*a* and the lower end 101*b* of the cylindrical housing 101 as illustrated in FIG. 13B, FIG. 14B, FIGS. 15B-15C, and FIG. 16B. The hollow chamber 108 is configured to store a continuous roll 115 of disposable bags, for example, plastic bags, biodegradable bags, etc., therewithin as illustrated in FIG. 13B, FIG. 14B, FIG. 15B, and FIG. 16B. In an exemplary embodiment, the hollow chamber 108 stores a continuous roll 115 of about 200 disposable bags therewithin.

Figure 12A:
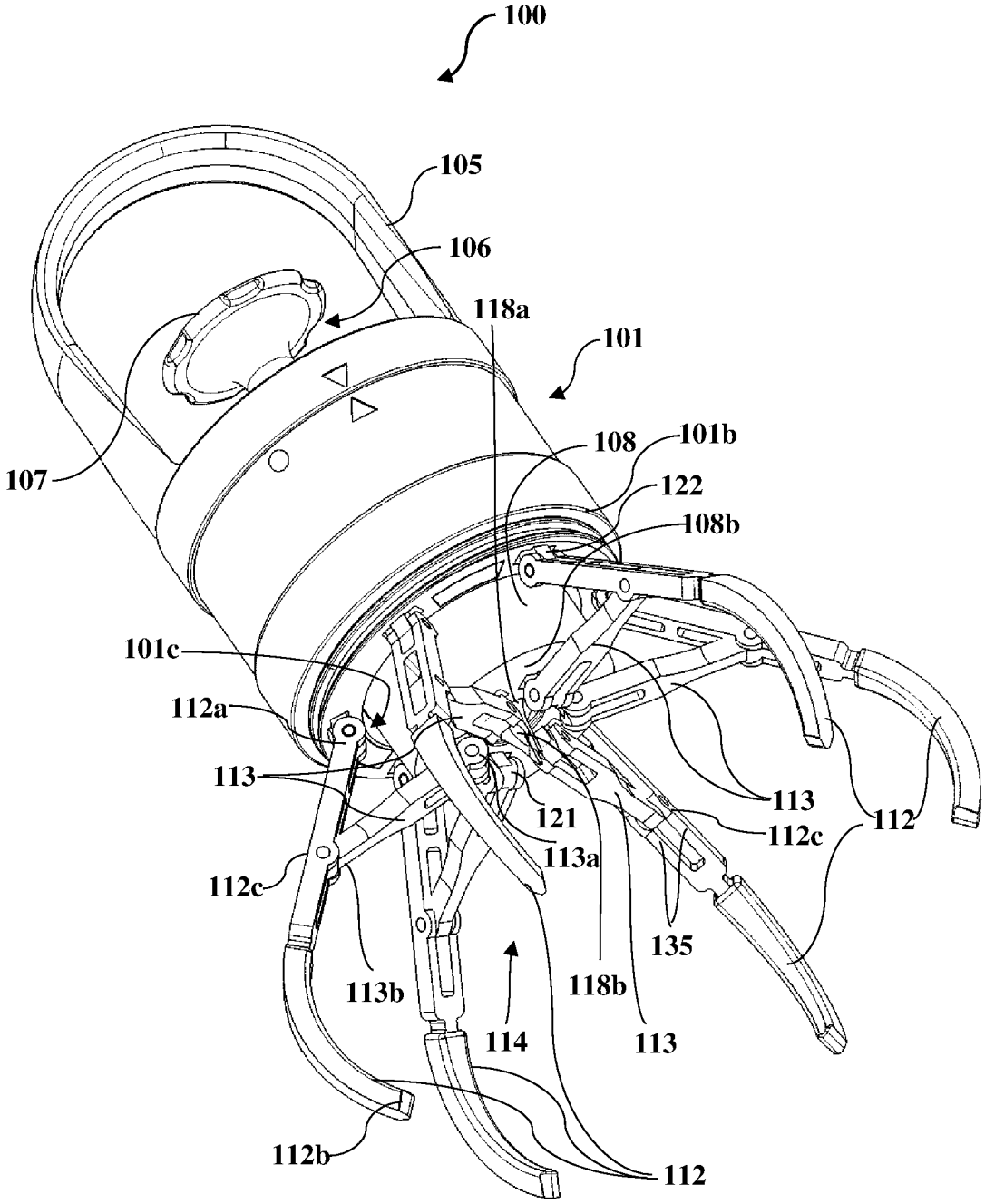
FIGS. 12A-12B illustrate perspective views of an embodiment of the waste picking, storage, and disposal device, showing the gripping elements in an open position.
Figure 12B:
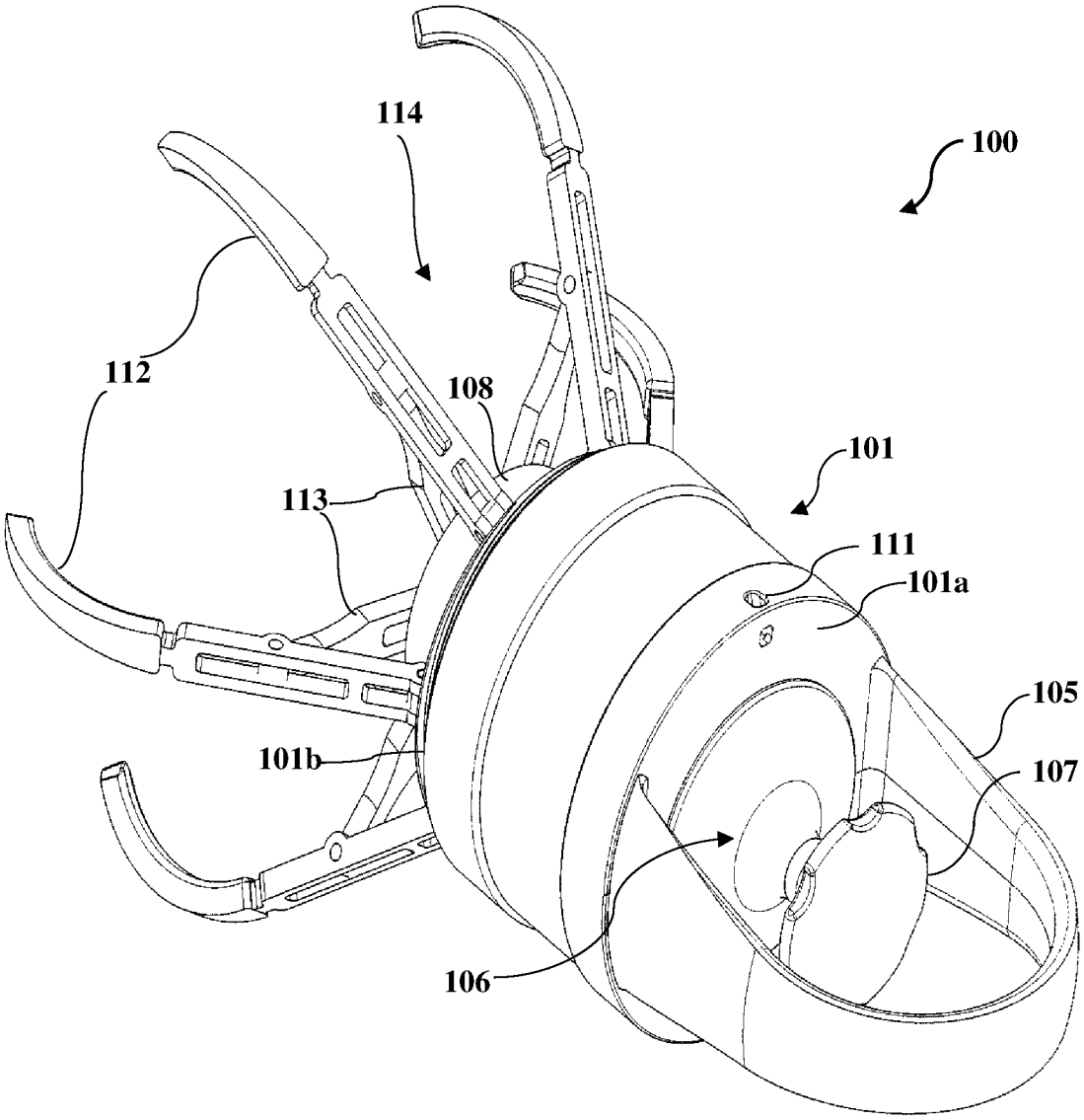
Figure 12C:
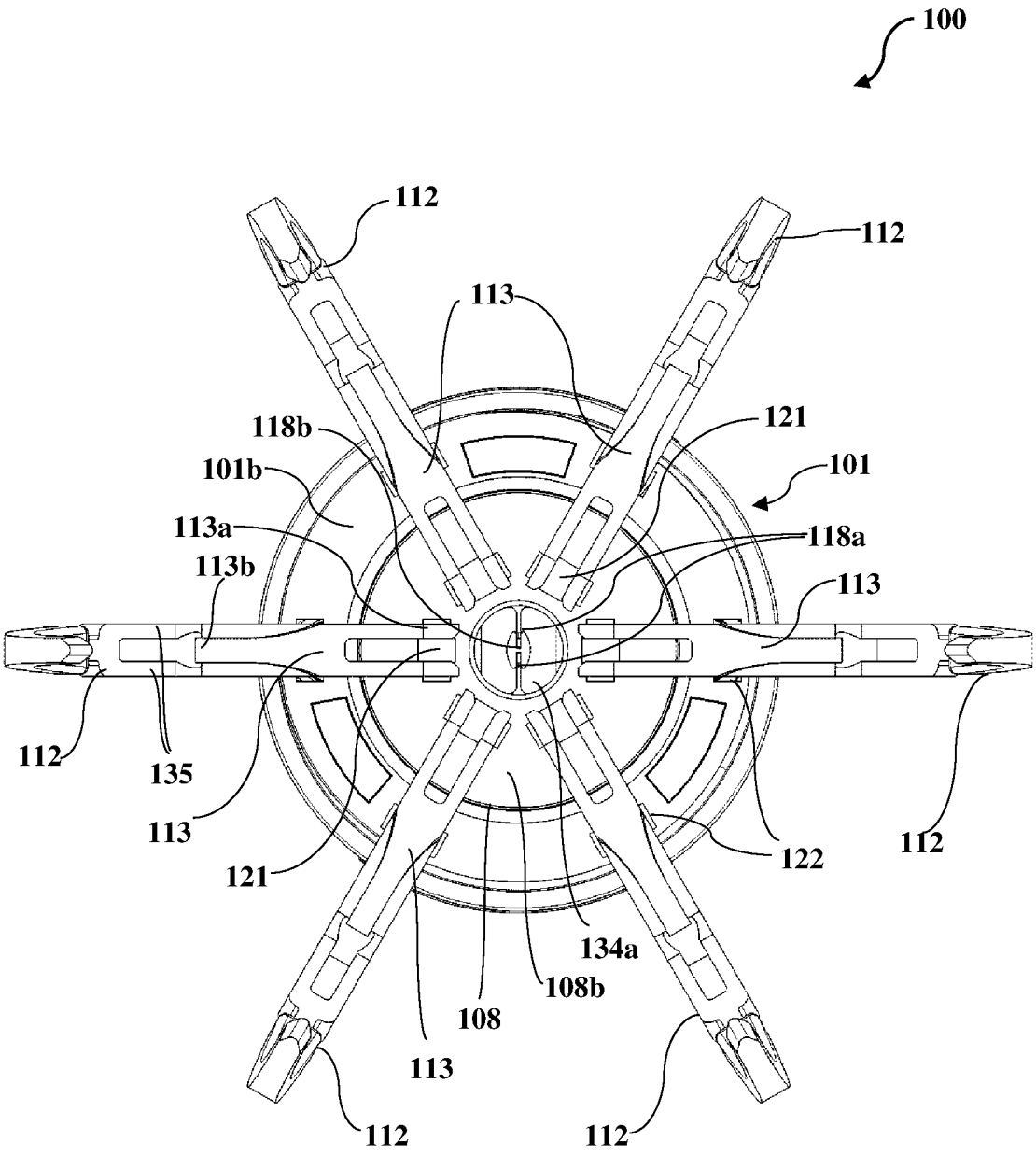
FIG. 12C illustrates a bottom elevation view of an embodiment of the waste picking, storage, and disposal device, showing the gripping elements in the open position.

The braces 113 of the pull system 106 illustrated in FIG. 3A, are radially hinged to the lower end 108*b* of the hollow chamber 108 illustrated in FIG. 4A, FIGS. 12A-12C, FIG. 13B, FIGS. 14A-14B, FIGS. 15A-15B, and FIGS. 16A-16B, in a one-to-one correspondence to the gripping elements 112 as illustrated in FIG. 12A and FIG. 12C. The bag dispenser 118 is attached to a lower end 117*b* of a mounting rod 117 as illustrated in FIG. 4A, FIG. 13B, FIG. 14B, FIG. 15B, and FIG. 16B and as disclosed in the description of FIGS. 4A-4B. The bag dispenser 118 is disposed proximal to the lower end 108*b* of the hollow chamber 108 as illustrated in FIG. 13B, FIG. 14B, FIG. 15B, and FIG. 16B, and to the lower end 101*b* of the cylindrical housing 101 for supporting the continuous roll 115 of disposable bags as disclosed in the description of FIG. 13B. The bag dispenser 118 dispenses one of the disposable bags stored in the hollow chamber 108 for containing and disposing the waste. The dispensed, disposable bag is configured to be wrapped around the gripping elements 112 as illustrated in FIG. 18D, to protect the gripping elements 112 from directly contacting the waste. When the pull lever 107 is operated axially in the opposing directions, the lower end 108*b* of the hollow chamber 108 with the bag dispenser 118 moves axially within an internal space 114 defined by the gripping elements 112 illustrated in FIGS. 15A-15B and FIGS. 16A-16B, and via the braces 113, causes the wrapped gripping elements 112 to open and close for picking, encapsulating, and storing the waste within the dispensed, disposable bag for subsequent disposal.

The end cap 109 of the device 100 is detachably connected to the lower end 101*b* of the cylindrical housing 101 for enclosing and concealing the gripping elements 112 with and without the encapsulated waste. In an exemplary embodiment, the end cap 109 is configured as a half-opened tubular structure, where the open end 109*c* illustrated in FIG. 3A, is removably connected to the lower end 101*b* of the cylindrical housing 101. The height of the end cap 109 is, for example, about 3⅜$^{th}$ inches. The diameter of the end cap 109 is, for example, about 2⅝$^{th}$ inches. In an embodiment, the end cap 109 comprises a generally cylindrical, hollow upper section 109*a* and a generally semi-spherical, hollow lower section 109*b* with a closed end 109*d* illustrated in FIG. 3A. The cylindrical, hollow upper section 109*a* and the semi-spherical, hollow lower section 109*b* of the end cap 109 are made, for example, of plastic, a hard plastic, or a thermoplastic polymer such as acrylonitrile butadiene styrene (ABS). The cylindrical, hollow upper section 109*a* is detachably attachable to the lower end 101*b* of the cylindrical housing 101. The cylindrical, hollow upper section 109*a* extends upwardly from the semi-spherical, hollow lower section 109*b*. The cylindrical, hollow upper section 109*a* and the semi-spherical, hollow lower section 109*b* are together configured to accommodate and enclose the gripping elements 112. The device 100 is configured to form a capsule when the end cap 109 is attached to the lower end 101*b* of the cylindrical housing 101 as illustrated in FIG. 1. The cylindrical housing 101 and the attached end cap 109 form a capsule-shaped shell as illustrated in FIG. 1. After picking, encapsulating, and storing the waste, the end cap 109 is attached to the lower end 101*b* of the cylindrical housing 101 for concealing the encapsulated waste, thereby allowing the user to conveniently and sanitarily carry the encapsulated waste in the capsule around until a proper disposal site is found.

Figure 2:
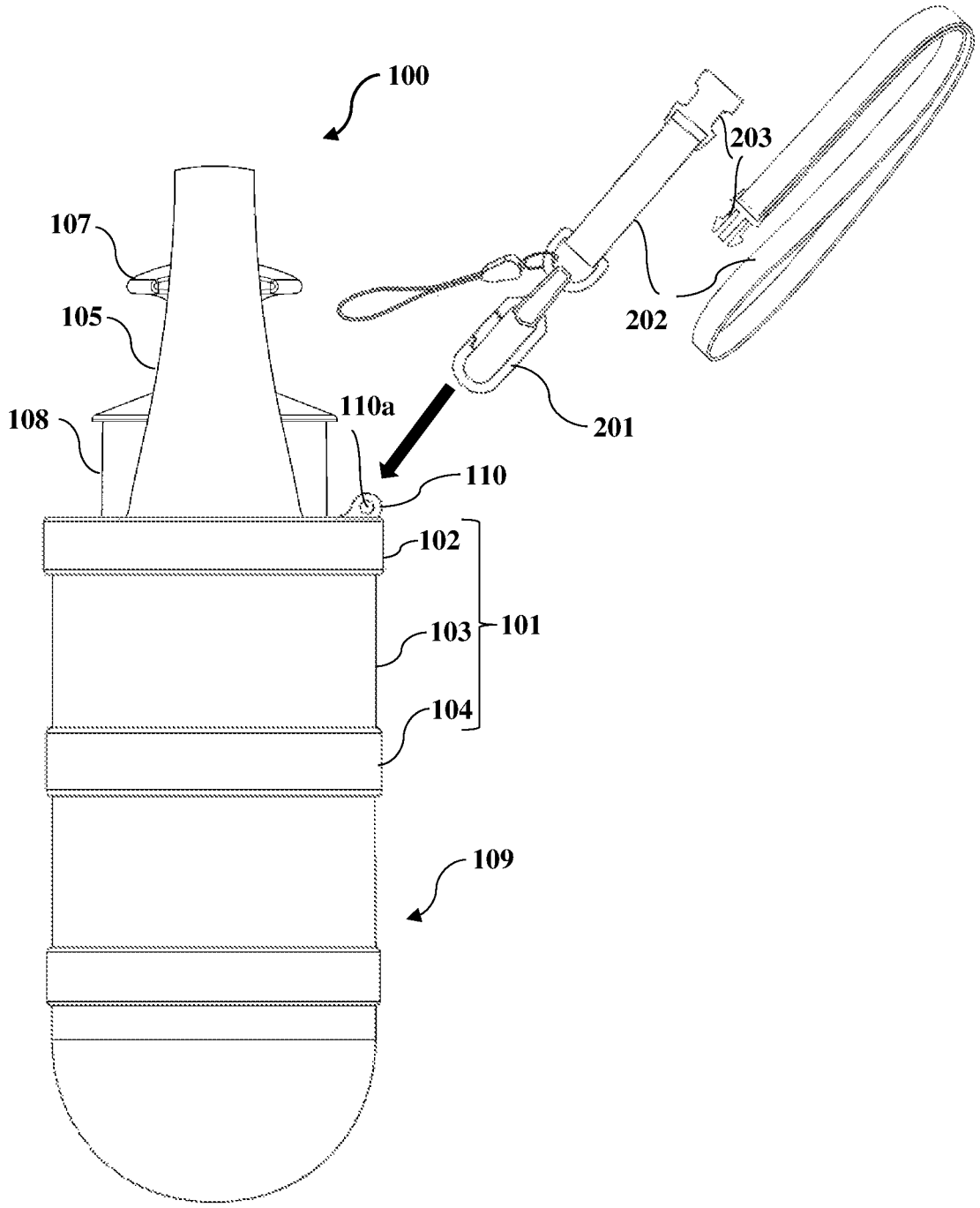
FIG. 2 illustrates a right-side elevation view of an embodiment of the waste picking, storage, and disposal device, showing an attachment component configured to secure a strap to the device for allowing a user to carry the device.

FIG. 2 illustrates a right-side elevation view of an embodiment of the waste picking, storage, and disposal device 100, showing an attachment component 110 configured to secure a strap 202 to the device 100 for allowing a user to carry the device 100. In an embodiment, the attachment component 110 is configured on the upper end 101*a* of the cylindrical housing 101. As illustrated in FIG. 2, the attachment component 110 comprises an opening 110*a* configured to attach a connector 201, for example, a latch, a carabiner, etc., through which a strap 202, for example, a cord, a multi-functional lanyard, etc., may be connected for carrying the device 100. The connector 201 of the strap 202 is securely attachable to the opening 110*a* of the attachment component 110 of the device 100 for allowing a user to carry the device 100 in different ways, for example, on the user's wrist, on a belt loop of a user's trousers, around the user's neck, on a pet collar, etc. A strap connector 203 is used to connect two parts of the strap 202 as illustrated in FIG. 2 and allows adjustment of the strap 202. In other embodiments, the attachment component 110 is configured to be attached or coupled to any suitable location on the cylindrical housing 101, that allows the device 100 to be conveniently carried by the user.

FIG. 3A illustrates a rear perspective view of an embodiment of the waste picking, storage, and disposal device 100, showing the end cap 109 detached from the cylindrical housing 101 of the device 100 to expose the gripping elements 112 of the device 100 in a closed position. As illustrated in FIG. 3A, the upper end 109*c* of the cylindrical, hollow upper section 109*a* of the end cap 109 is open, and the lower end 109*d* of the semi-spherical, hollow lower section 109*b* of the end cap 109 is closed. In an embodiment, the device 100 further comprises a hollow, ring-shaped component 109*e* configured to be disposed on the end cap 109 as illustrated in FIG. 3A. The hollow, ring-shaped component 109*e* is configured to provide grip to a user's hand when the user removes the end cap 109 from the lower end 101*b* of the cylindrical housing 101 and when the user attaches the end cap 109 to the lower end 101*b* of the cylindrical housing 101. The hollow, ring-shaped component 109*e* is made, for example, of nylon or another durable and flexible plastic material configured to prevent breakage of the hollow ring-shaped component 109*e*.

In an exemplary implementation, the device 100 comprises six gripping elements 112 configured in the shape of fingers as illustrated in FIG. 3A, for picking and storing waste. The six gripping elements 112 constitute a six-finger gripper at the lower end 101*b* of the cylindrical housing 101. The gripping elements 112 are radially hinged to the lower end 101*b* of the cylindrical housing 101. The gripping elements 112 extend downwardly from the lower end 101*b* of the cylindrical housing 101. The gripping elements 112 are distributed on the lower end 101*b* of the third cylindrical member 104 of the cylindrical housing 101. Each gripping element 112 comprises an upper end 112*a* and a lower end 112*b*. The upper end 112*a* of each gripping element 112 is hinged to the lower end 101*b* of the cylindrical housing 101. The lower end 112*b* of each of the gripping elements 112 is bent, for example, in the shape of an arc. In an exemplary embodiment, the lower end 112*b* of each of the gripping elements 112 is bent by an arc length of a quarter (¼) circle. In an exemplary embodiment of the six-finger gripper, three pairs of gripping elements 112 are arranged at intervals relative to each other, where each pair of the gripping elements 112 is configured to form a semi-circle in the closed position as illustrated in FIG. 3A. The configuration of the gripping elements 112 allows a complete 360-degree pickup of the waste.

In an exemplary embodiment, the gripping elements 112 are controlled by a spring-loaded pull of the pull system 106. When the pull lever 107 of the pull system 106 is pulled, the gripping elements 112 are closed and fit into an internal space 109*f* of the end cap 109. The end cap 109 is hollow and cylindrical at the upper end 109*c* that is attached to the lower end 101*b* of the cylindrical housing 101, and semi-spherical on the other end 109*d*. For storage of the device 100 prior to picking and storing waste, the pull lever 107 is pulled in an upward position, causing the gripping elements 112 to close. The gripping elements 112 in the closed position are then enclosed and concealed by attaching the end cap 109 to the lower end 101*b* of the cylindrical housing 101. In an embodiment, the lower end 101*b* of the cylindrical housing 101 comprises threads, for example, screw threads 101*d*, for engaging and fastening the upper end 109*c* of the end cap 109 to the lower end 101*b* of the cylindrical housing 101. When the device 100 is being used for picking, storing, and disposing waste, the end cap 109 is unscrewed from the lower end 101*b* of the cylindrical housing 101 and removed by a user.

In an embodiment, the device 100 further comprises an attachment hole 111 configured to attach a strap (not shown), for example, a wrist strap, to the device 100. The strap may be worn on the user's wrist or held by the user for carrying the device 100. In an embodiment, the attachment hole 111 is configured on the first cylindrical member 102 of the cylindrical housing 101 as illustrated in FIG. 3A. In other embodiments, the attachment hole 111 is configured at any suitable location on the cylindrical housing 101, that allows the device 100 to be conveniently carried by the user.

Figure 3B:
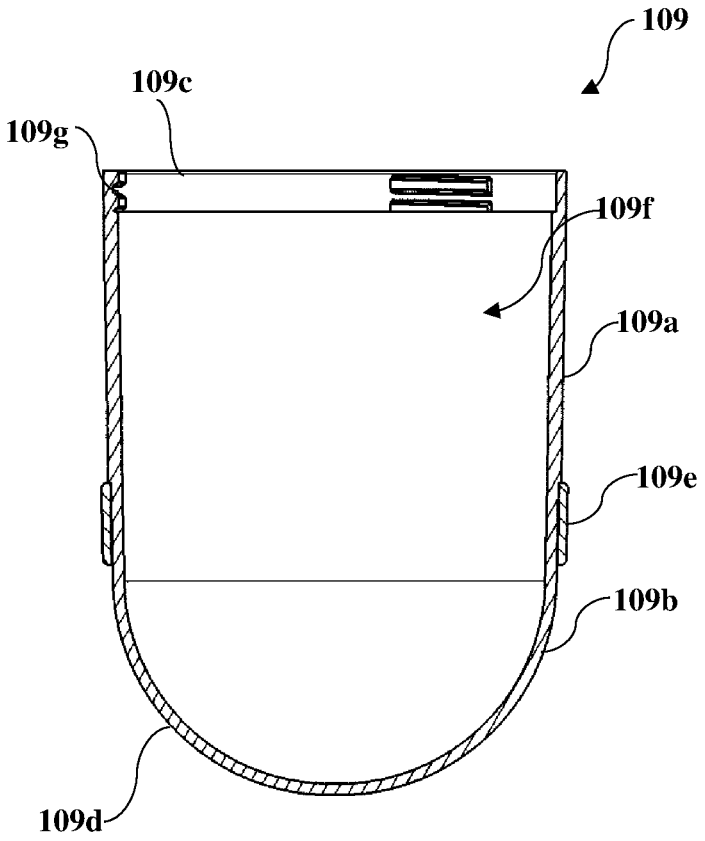
FIG. 3B illustrates a cross-sectional view of an embodiment of the end cap taken along a section line A-A' shown in FIG. 3A.

FIG. 3B illustrates a cross-sectional view of an embodiment of the end cap 109 taken along a section line A-A' shown in FIG. 3A. As illustrated in FIG. 3B, the generally semi-spherical, hollow lower section 109*b* of the end cap 109 with its closed end 109*d* extends downwardly from the generally cylindrical, hollow upper section 109*a* of the end cap 109. Also, illustrated in FIG. 3B is the hollow, ring-shaped component 109*e* disposed on the cylindrical, hollow upper section 109*a* for providing grip to a user's hand when the user removes and attaches the end cap 109 from and to the lower end 101*b* of the cylindrical housing 101 illustrated in FIG. 3A, respectively. In an embodiment, the upper end 109*c* of the cylindrical, hollow upper section 109*a* comprises internal screw threads 109*g* configured to engage with external screw threads 101*d* configured on the lower end 101*b* of the cylindrical housing 101 illustrated in FIG. 3A, for attaching the upper end 109*c* of the end cap 109 to the lower end 101*b* of the cylindrical housing 101. The end cap 109 is rotated in one direction, for example, a counterclockwise direction, to engage the internal screw threads 109*g* on the upper end 109*c* of the end cap 109 with the external screw threads 101*d* on the lower end 101*b* of the cylindrical housing 101 for attaching the end cap 109 to the device 100, thereby enclosing the gripping elements 112 illustrated in FIG. 3A, within the internal space 109*f* of the end cap 109 and closing the device 100. The end cap 109 is rotated in an opposing direction, for example, a clockwise direction, to disengage the internal screw threads 109*g* on the upper end 109*c* of the end cap 109 from the external screw threads 101*d* on the lower end 101*b* of the cylindrical housing 101 for removing the end cap 109 from the device 100 and exposing gripping elements 112.

FIGS. 4A-4B illustrate exploded views of an embodiment of the waste picking, storage, and disposal device 100. A front, perspective exploded view and a rear, perspective exploded view of the device 100 are exemplarily illustrated in FIG. 4A and FIG. 4B, respectively. FIGS. 4A-4B illustrate parts of the cylindrical housing 101, that is, the three cylindrical members 102, 103, and 104. The handle 105 extends upwardly from the upper end 101*a* of the first cylindrical member 102 of the cylindrical housing 101. In an embodiment, the device 100 further comprises a pair of grooves 123 configured diametrically opposite each other on an inner wall 102*a* of the first cylindrical member 102 of the cylindrical housing 101. The grooves 123 extend along an axial direction of the cylindrical housing 101. The device 100 further comprises a pair of sliding blocks 120*a* and 120*b* configured diametrically opposite each other on an outer wall 108*c*, that is, an outer peripheral surface, of the hollow chamber 108 of the pull system 106. The sliding blocks 120*a* and 120*b* of the hollow chamber 108 are configured to match the grooves 123 and slide within the grooves 123 of the first cylindrical member 102 to facilitate the movement of the pull system 106 axially within the through-hole 101*c* of the cylindrical housing 101. An opening of the through-hole 101*c* of the cylindrical housing 101 is illustrated in FIG. 4B. The sliding blocks 120*a* and 120*b* of the hollow chamber 108 also prevent the pull system 106 from twisting inside the through-hole 101*c* of the cylindrical housing 101.

FIGS. 4A-4B also illustrate parts of the pull system 106, that is, the pull lever 107, the hollow chamber 108, the bag dispenser 118, the spring members 119*a* and 119*b*, and other parts 115, 116, and 117 of the pull system 106 disposed between the first cylindrical member 102 and the other two cylindrical members 103 and 104 of the cylindrical housing 101. The second cylindrical member 103 comprises an upper end 103*a* and a lower end 103*b* disposed with respect to the first cylindrical member 102 and the third cylindrical member 104 respectively, as disclosed in the description of FIG. 8. The cylindrical housing 101 defines a through-hole 101*c* extending between the upper end 101*a* and the lower end 101*b* of the cylindrical housing 101 for accommodating the pull system 106. The pull system 106 is disposed axially within the through-hole 101*c* of the cylindrical housing 101. As illustrated in FIGS. 4A-4B, the parts of the pull system 106 comprise the pull lever 107, a continuous roll 115 of disposable bags, a support plate 116, a mounting rod 117, the bag dispenser 118 operably coupled to one end 117*b* of the mounting rod 117, the spring members 119*a* and 119*b*, and the hollow chamber 108. In an embodiment, the lower end 107*b* of the pull lever 107 is mechanically threaded for engageably connecting the lower end 107*b* of the pull lever 107 to the open upper end 108*a* of the hollow chamber 108.

Figure 13A:
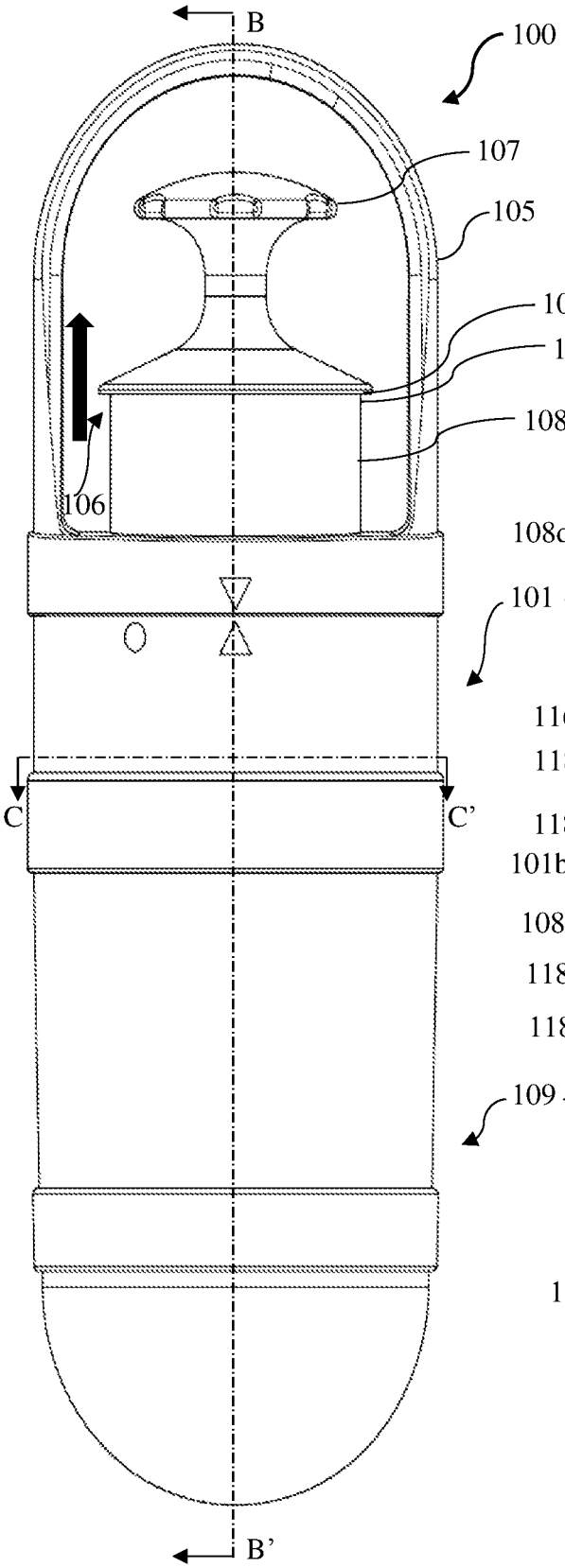
FIG. 13A illustrates a front elevation view of an embodiment of the waste picking, storage, and disposal device in a closed condition.
Figure 13B:
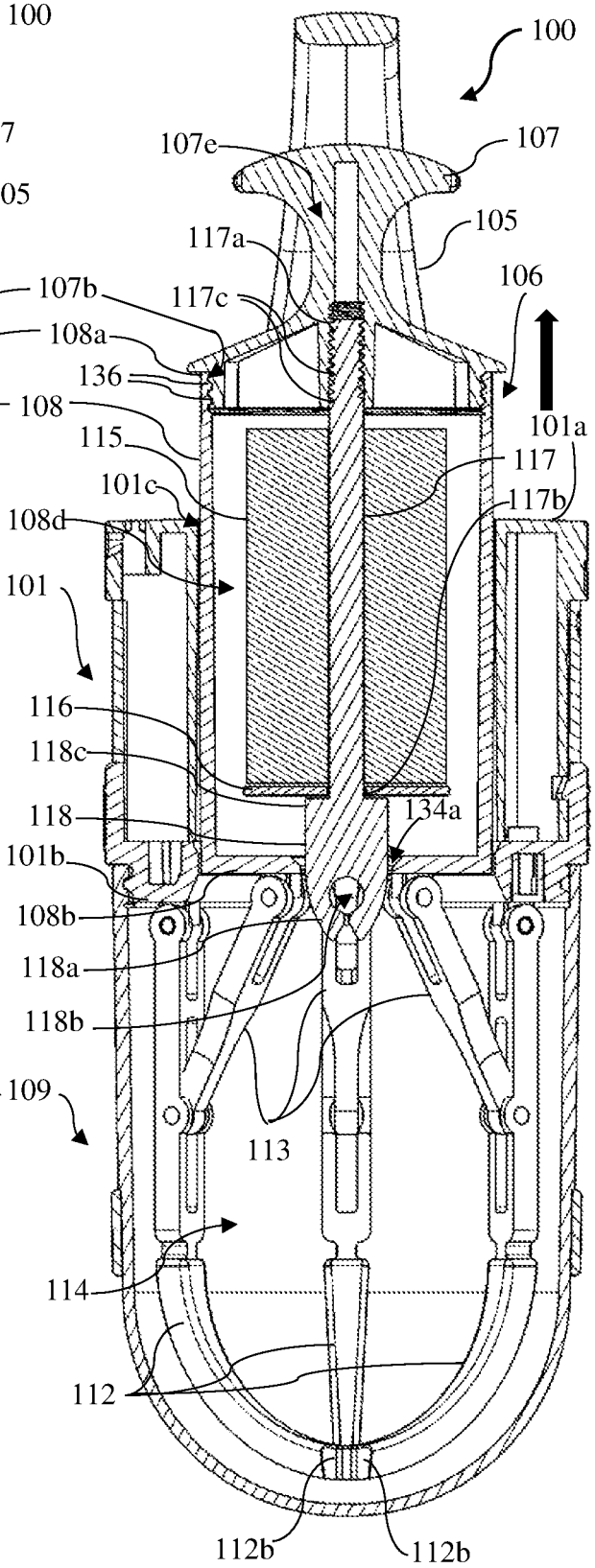
FIG. 13B illustrates a cross-sectional view of an embodiment of the waste picking, storage, and disposal device in the closed condition, taken along a section line B-B' shown in FIG. 13A.

The continuous roll 115 of disposable bags is loaded on the mounting rod 117 and positioned within the hollow chamber 108 as disclosed in the description of FIG. 13B. The disposable bags are, for example, biodegradable bags. The mounting rod 117 is made of a thermoplastic material, for example, nylon or another durable and flexible plastic material that prevents breakage of the mounting rod 117. The mounting rod 117 comprises an upper end 117*a* and a lower end 117*b*. The pull lever 107 is detachably connected to the upper end 117*a* of the mounting rod 117. In an embodiment, the upper end 117*a* of the mounting rod 117 is mechanically threaded for engageably connecting the pull lever 107 to the upper end 117*a* of the mounting rod 117. In an embodiment, the pull lever 107 further comprises a threaded opening 107*d* centrally positioned at the lower end 107*b* of the pull lever 107 as illustrated in FIG. 4A. The upper end 117*a* of the mounting rod 117 comprises threads, for example, screw threads 117*c* as illustrated in FIG. 4A. The threaded upper end 117*a* of the mounting rod 117 is inserted into and engaged with the threaded opening 107*d* of the pull lever 107 for connecting the upper end 117*a* of the mounting rod 117 to the lower end 107*b* of the pull lever 107. The pull lever 107 is disengaged from the upper end 117*a* of the mounting rod 117 for loading the continuous roll 115 of disposable bags onto the mounting rod 117. The support plate 116 is configured to support and facilitate dispensing of the disposable bags from the continuous roll 115 of disposable bags through the bag dispenser 118. The continuous roll 115 of disposable bags and the support plate 116 are mounted on the mounting rod 117 via their respective holes 115*a* and 116*a*. That is, the mounting rod 117 is inserted through the holes 116*a* and 115*a* of the support plate 116 and the continuous roll 115 of disposable bags respectively, for connecting the support plate 116 and the continuous roll 115 of disposable bags within the hollow chamber 108 of the pull system 106.

In an embodiment, the bag dispenser 118 comprises a protruding element 118*a* with an external opening 118*b* configured to dispense one of the disposable bags stored in the hollow chamber 108 for containing and disposing waste. The protruding element 118*a* comprising the external opening 118*b* is made of a thermoplastic material, for example, nylon or another durable and flexible plastic material to prevent breakage of the protruding element 118*a* when a disposable bag is inserted into and pulled out through the external opening 118*b*. In an embodiment, the device 100 further comprises hinge components 121 operably coupled to the lower end 108*b* of the hollow chamber 108 as illustrated in FIGS. 4A-4B. The hinge components 121 are configured to radially hinge the braces 113 in a one-to-one correspondence to the gripping elements 112. Similarly, in an embodiment, the device 100 further comprises hinge components 122 operably coupled to the lower end 101*b* of the cylindrical housing 101, that is, to the lower end 101*b* of the third cylindrical member 104 as illustrated in FIGS. 4A-4B. The hinge components 122 are configured to radially hinge the gripping elements 112 to the lower end 101*b* of the third cylindrical member 104 of the cylindrical housing 101. The end cap 109 is detachably attachable to the lower end 101*b* of the cylindrical housing 101. The end cap 109 comprising the cylindrical, hollow upper section 109*a* and the semi-spherical, hollow lower section 109*b* is configured to enclose and conceal the gripping elements 112 in the closed position with and without the encapsulated waste. In an embodiment, the lower end 101*b* of the third cylindrical member 104 of the cylindrical housing 101 is mechanically threaded for engageably connecting the upper end 109*c* of the end cap 109 to the lower end 101*b* of the cylindrical housing 101 as disclosed in the description of FIG. 3B. Also, illustrated in FIGS. 4A-4B, is the hollow, ring-shaped component 109*e* configured to be disposed in a recessed section 109*h* of the end cap 109. The recessed section 109*h* is configured proximal to the lower end 109*d* of the end cap 109. The hollow, ring-shaped component 109*e* securely fits within the recessed section 109*h* of the end cap 109 and provides grip to a user's hand when the user detaches and removes the end cap 109 from the lower end 101*b* of the cylindrical housing 101 and when the user attaches the end cap 109 to the lower end 101*b* of the cylindrical housing 101.

Figure 5:
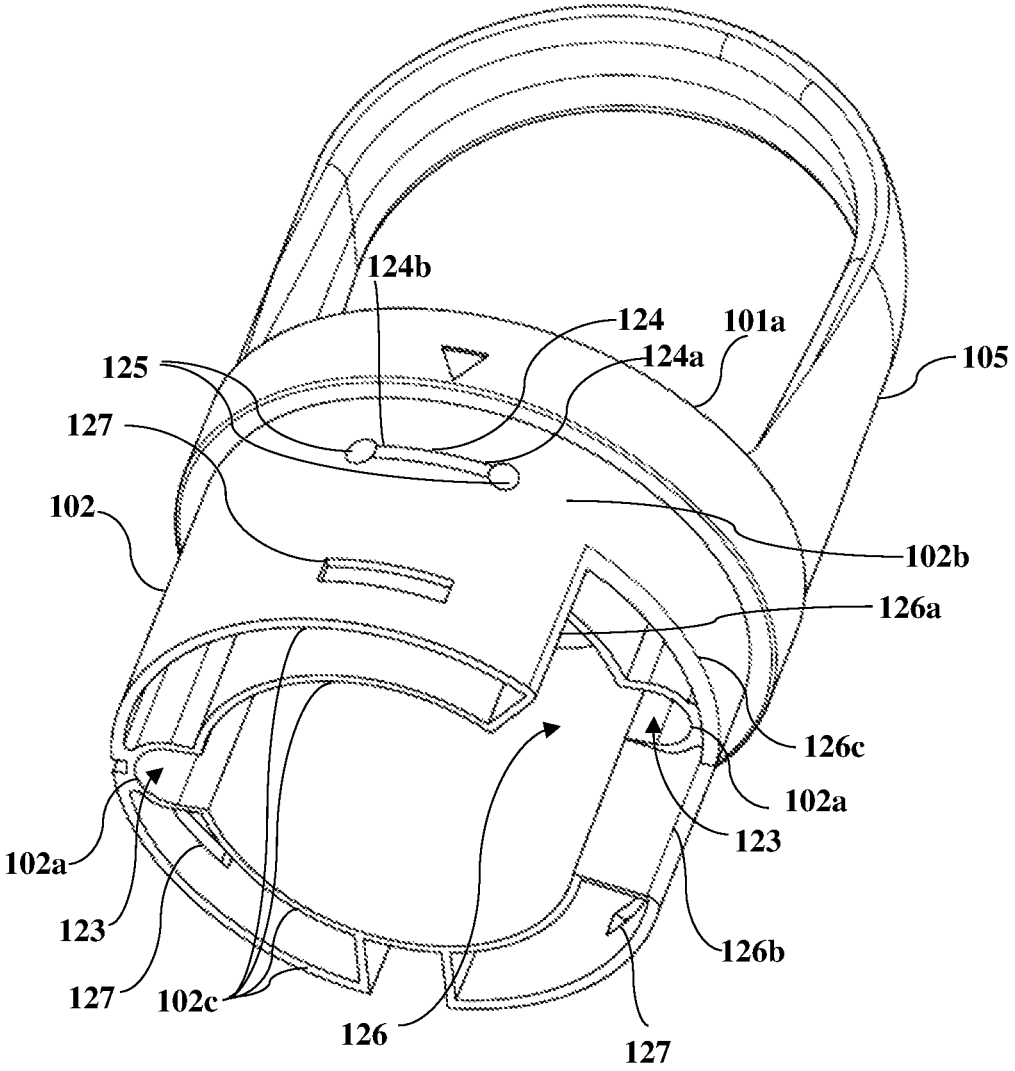
FIG. 5 illustrates a bottom perspective view of an embodiment of a first cylindrical member of the cylindrical housing of the waste picking, storage, and disposal device.

FIG. 5 illustrates a bottom perspective view of an embodiment of the first cylindrical member 102 of the cylindrical housing 101 of the waste picking, storage, and disposal device 100 shown in FIG. 1, FIG. 3A, and FIGS. 4A-4B. As illustrated in FIG. 5, the arch-shaped and rounded handle 105 of the device 100 extends upwardly from the upper end 101*a* of the first cylindrical member 102. In an embodiment, the inner wall 102*a* of the first cylindrical member 102 comprises a pair of grooves 123 extending along the axial direction of the cylindrical housing 101. The grooves 123 are configured diametrically opposite each other on the inner wall 102*a* of the first cylindrical member 102. The grooves 123 are configured to receive and accommodate the sliding blocks 120*a* and 120*b* configured diametrically opposite each other on the outer wall 108*c* of the hollow chamber 108 illustrated in FIGS. 4A-4B and FIGS. 9A-9B. The sliding blocks 120*a* and 120*b* of the hollow chamber 108 fit and slide within the grooves 123 of the cylindrical housing 101 to facilitate movement of the pull system 106 axially within the through-hole 101*c* of the cylindrical housing 101 as illustrated in FIG. 13B, FIG. 14B, FIG. 15B, and FIG. 16B.

Figure 6:
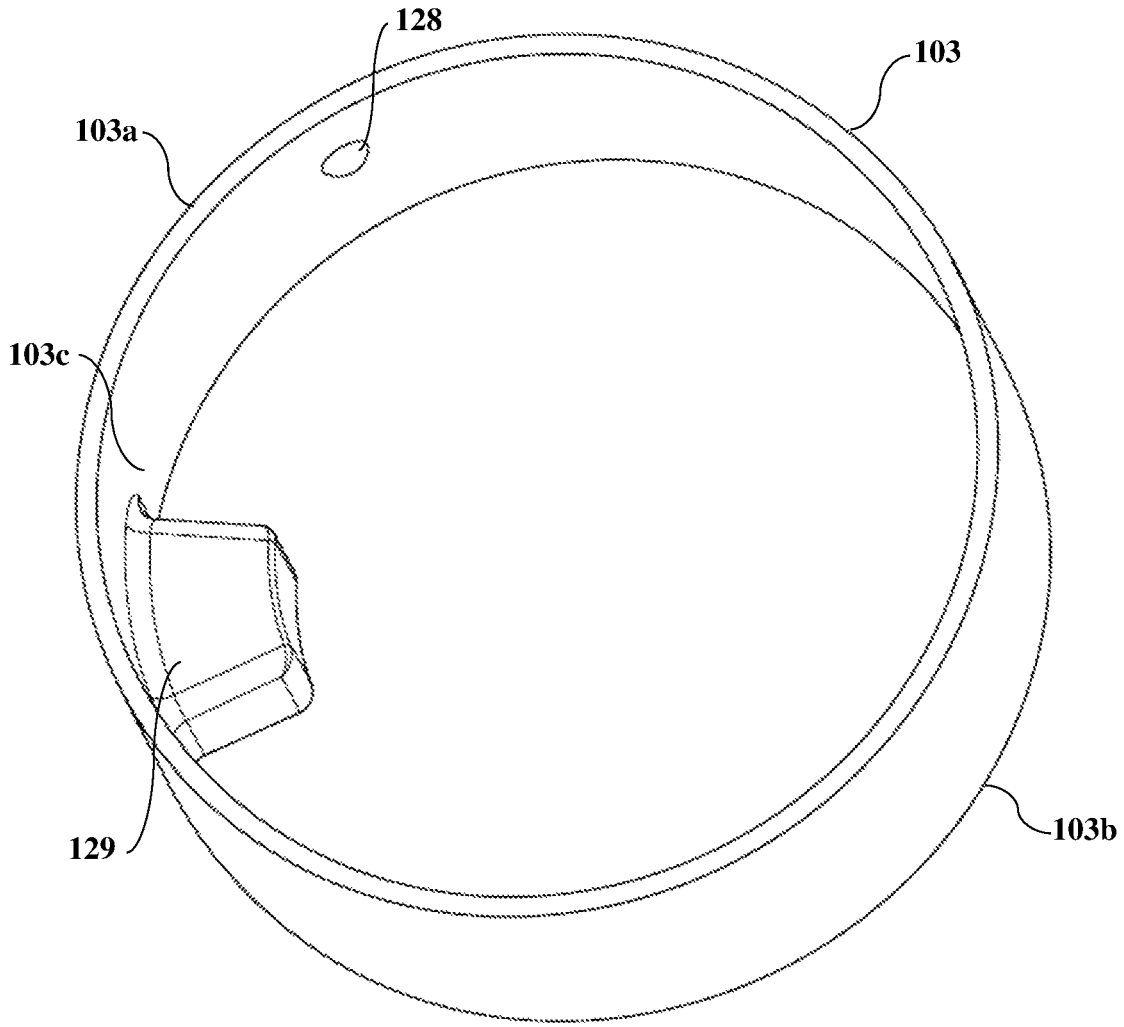
FIG. 6 illustrates a top perspective view of an embodiment of a second cylindrical member of the cylindrical housing of the waste picking, storage, and disposal device.

In an embodiment, the first cylindrical member 102 comprises a slot 126 corresponding to one of the grooves 123. The slot 126 is defined, for example, by three edges 126*a*, 126*b*, and 126*c* on one side of the first cylindrical member 102 as illustrated in FIG. 5. The slot 126 is configured to accommodate a stopper 129 configured on an inner wall 103*c* of the second cylindrical member 103 as illustrated in FIG. 6. The slot 126 is configured to allow the stopper 129 to move therewithin in a circumferential direction for one of blocking and opening one of the grooves 123 during rotation of the second cylindrical member 103 about the outer wall 102*b* of the first cylindrical member 102. In an embodiment, the first cylindrical member 102 further comprises a slide rail 124 extending circumferentially on the outer wall 102*b* of the first cylindrical member 102. The slide rail 124 is configured to slidably accommodate a protruding element 128 configured on the inner wall 103*c* of the second cylindrical member 103 illustrated in FIG. 6. Each end 124*a* and 124*b* of the slide rail 124 comprises a notch 125 matching the protruding element 128. The notch 125 is configured to accommodate the protruding element 128 when the stopper 129 is positioned to block or open one of the grooves 123 during the rotation of the second cylindrical member 103 about the outer wall 102*b* of the first cylindrical member 102. The notches 125 secure the second cylindrical member 103 in respective positions on the outer wall 102*b* of the first cylindrical member 102, when the stopper 129 is disposed to block the groove 123 in one position and open the groove 123 in the other position. Since the through-hole 101*c* is a cylindrical opening, the sliding blocks 120*a* and 120*b* of the hollow chamber 108 and the grooves 123 of the first cylindrical member 102 are arranged to prevent the hollow chamber 108 from rotating in the circumferential direction when the hollow chamber 108 is moved axially in the through-hole 101*c*, thereby preventing damage to the braces 113 illustrated in FIG. 3A and FIGS. 4A-4B.

In an embodiment, the first cylindrical member 102 further comprises connecting slots 127 configured at predetermined locations on the outer wall 102*b* of the first cylindrical member 102 as illustrated in FIG. 5. Each of the connecting slots 127 is, for example, of a rectangular shape. The connecting slots 127 are configured to receive matching protrusions 132 configured on an inner wall 104*b* of the third cylindrical member 104 illustrated in FIG. 7A, for internally connecting the third cylindrical member 104 to the first cylindrical member 102 as disclosed in the description of FIGS. 7A-7B.

Figure 9A:
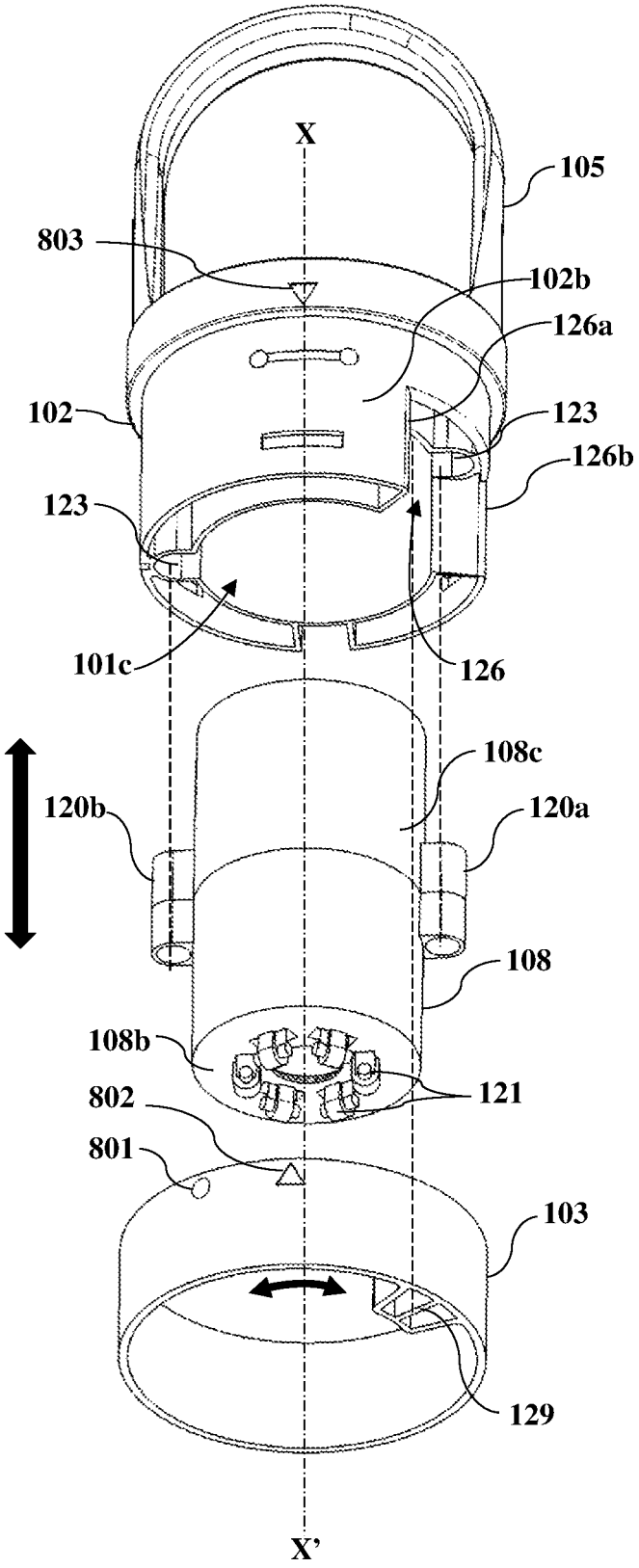
FIGS. 9A-9B illustrate partial exploded views showing an axial alignment of a hollow chamber of a pull system disposed within the first cylindrical member and the second cylindrical member of the cylindrical housing, and operation of a stopper of the second cylindrical member for locking the pull system.
Figure 9B:
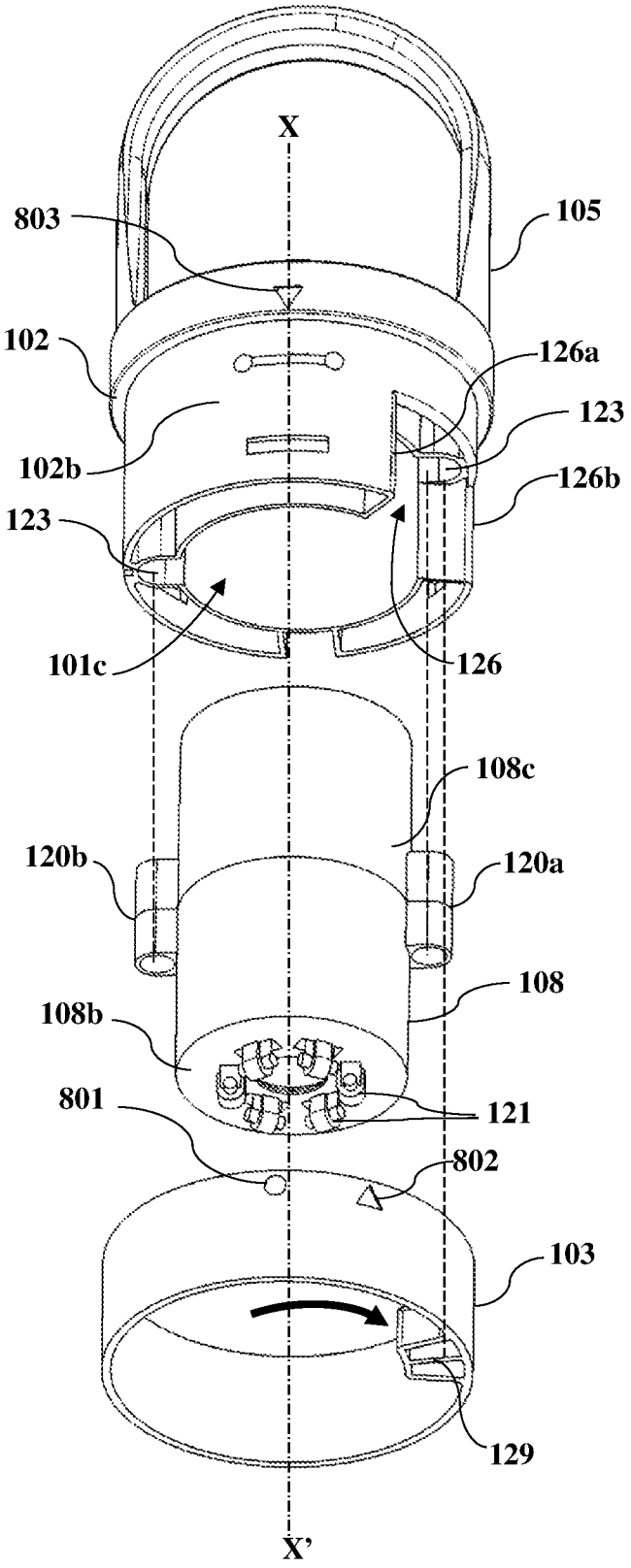
Figure 13C:
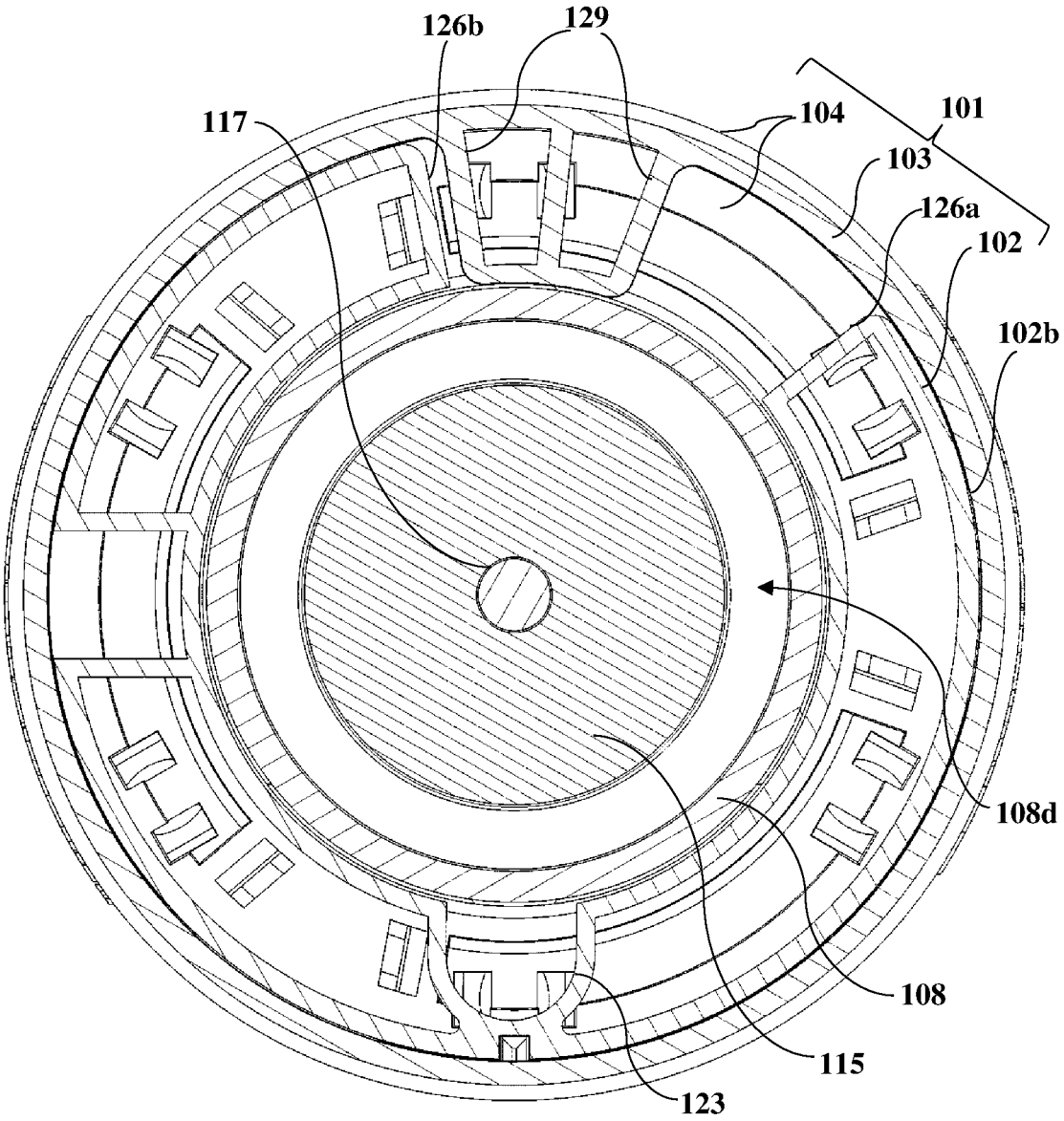
FIG. 13C illustrates a cross-sectional view of an embodiment of the waste picking, storage, and disposal device in the closed condition, taken along a section line C-C' shown in FIG. 13A.

FIG. 6 illustrates a top perspective view of an embodiment of the second cylindrical member 103 of the cylindrical housing 101 of the waste picking, storage, and disposal device 100 shown in FIG. 1, FIG. 3A, and FIGS. 4A-4B. FIG. 6 illustrates the stopper 129 and the protruding element 128 configured on the inner wall 103*c* of the second cylindrical member 103. The stopper 129 is configured as a locking mechanism, for example, a latch, to lock the hollow chamber 108 as illustrated in FIG. 13C, and restrict axial movement of the hollow chamber 108 as disclosed in the description of FIGS. 9A-9B. The stopper 129 moves in the circumferential direction within the slot 126 configured in the first cylindrical member 102, for blocking or opening one of the grooves 123 of the first cylindrical member 102 illustrated in FIG. 5, during the rotation of the second cylindrical member 103 about the outer wall 102*b* of the first cylindrical member 102. For example, the stopper 129 moves in the circumferential direction between the edges 126*a* and 126*b* of the slot 126 illustrated in FIG. 5, to open and block the groove 123 disposed near the edge 126*b* of the slot 126, respectively. When the second cylindrical member 103 is rotated circumferentially about the outer wall 102*b* of the first cylindrical member 102 towards the edge 126*b* of the slot 126, the stopper 129 blocks the groove 123 disposed near the edge 126*b* of the slot 126 and restricts the axial movement of the hollow chamber 108 by stopping the sliding movement of the corresponding sliding block 120*a* in the groove 123 as illustrated in FIG. 9B. When the second cylindrical member 103 is rotated circumferentially about the outer wall 102*b* of the first cylindrical member 102 in the opposite direction towards the edge 126*a* of the slot 126, the stopper 129 opens the groove 123 disposed near the edge 126*b* of the slot 126 and moves to the edge 126*a* of the slot 126, thereby allowing the axial movement of the hollow chamber 108 by allowing the sliding movement of the corresponding sliding block 120*a* in the corresponding groove 123 as illustrated in FIG. 9A.

The protruding element 128 of the second cylindrical member 103 is configured, for example, as an embossment on the inner wall 103*c* of the second cylindrical member 103. The protruding element 128 of the second cylindrical member 103 connects to the notch 125 at each end 124*a* and 124*b* of the slide rail 124 of the first cylindrical member 102 illustrated in FIG. 5, when the stopper 129 is positioned to block or open the groove 123 disposed near the edge 126*b* of the slot 126, during rotation of the second cylindrical member 103 about the outer wall 102*b* of the first cylindrical member 102. That is, the protruding element 128 connects to the notch 125 at one end 124*a* of the slide rail 124 when the stopper 129 is positioned to block the groove 123 during rotation of the second cylindrical member 103 about the outer wall 102*b* of the first cylindrical member 102; and the protruding element 128 connects to the notch 125 at the other end 124*b* of the slide rail 124 when the stopper 129 is positioned to open the groove 123 during rotation of the second cylindrical member 103 about the outer wall 102*b* of the first cylindrical member 102.

FIGS. 7A-7B illustrate a top plan view and a bottom elevation view, respectively, of an embodiment of the third cylindrical member 104 of the cylindrical housing 101 of the waste picking, storage, and disposal device 100 shown in FIG. 1, FIG. 3A, and FIGS. 4A-4B. As illustrated in the top plan view shown in FIG. 7A, the third cylindrical member 104 comprises protrusions 132 configured on the inner wall 104*b* of the third cylindrical member 104. In an embodiment, the protrusions 132 are configured to be snap-fitted into the corresponding connecting slots 127 of the first cylindrical member 102 illustrated in FIG. 5, for connecting the third cylindrical member 104 to the first cylindrical member 102. The third cylindrical member 104 further comprises recesses 130 for accommodating the lower ends 102*c* of the first cylindrical member 102. In an embodiment, the third cylindrical member 104 supports the hollow chamber 108 of the pull system 106 as illustrated in FIG. 10, and prevents the pull system 106 from falling all the way through the through-hole 101*c* of the cylindrical housing 101. The bottom elevation view of the third cylindrical member 104 in FIG. 7B, illustrates the hinge components 122 attached to the lower end 101*b* of the third cylindrical member 104 for operably coupling the gripping elements 112 to the lower end 101*b* of the cylindrical housing 101 as illustrated in FIG. 3A and FIGS. 12A-12C.

FIG. 8 illustrates a bottom perspective view of an embodiment of the cylindrical housing 101 of the waste picking, storage, and disposal device 100 shown in FIG. 1, FIG. 3A, and FIGS. 4A-4B, showing hinge components 122 configured to hinge the gripping elements 112 shown in FIGS. 4A-4B, to the lower end 101*b* of the cylindrical housing 101. As illustrated in FIG. 8, the second cylindrical member 103 of the cylindrical housing 101 shown in FIG. 6 is disposed on the outer wall 102*b* of the first cylindrical member 102 of the cylindrical housing 101 shown in FIG. 5. In an embodiment, the upper end 103*a* of the second cylindrical member 103 is disposed flush against the upper section 102*d* of the first cylindrical member 102, and the lower end 103*b* of the second cylindrical member 103 is disposed flush against the upper end 104*a* of the third cylindrical member 104. The third cylindrical member 104 of the cylindrical housing 101 shown in FIGS. 7A-7B is internally connected to the lower end 102*c* of the first cylindrical member 102 shown in FIG. 5, for example, by a snap-fit connection, as disclosed in the description of FIGS. 7A-7B. In an embodiment, the hinge components 122 pivotably connect the gripping elements 112 to the lower end 101*b* of the cylindrical housing 101. In an embodiment, the hinge components 122 extend downwardly from the lower end 101*b* of the cylindrical housing 101 as illustrated in FIG. 8. The hinge components 122 are made, for example, of plastic, a hard plastic, or a thermoplastic polymer such as acrylonitrile butadiene styrene (ABS). In an embodiment, the hinge components 122 are made of metal.

In an embodiment, marking elements, for example, a circular mark 801 and a triangular mark 802, are configured at intervals on an outer wall 103*d* of the second cylindrical member 103, that is, the rotating cylinder, and a triangular mark 803 is configured on an upper section 102*d* of the first cylindrical member 102. When the circular mark 801 on the second cylindrical member 103 is aligned with the triangular mark 803 on the first cylindrical member 102, the stopper 129 of the second cylindrical member 103 illustrated in FIG. 6, is located at the position of blocking the groove 123 disposed near the edge 126*b* of the slot 126 of the first cylindrical member 102 illustrated in FIG. 5, and the corresponding sliding block 120*a* of the hollow chamber 108 is restricted from sliding in the groove 123 as illustrated in FIG. 9B. When the triangular mark 803 on the first cylindrical member 102 is aligned with the triangular mark 802 on the second cylindrical member 103, the stopper 129 is located at a position of avoiding or opening the groove 123 disposed near the edge 126*b* of the slot 126 of the first cylindrical member 102, which allows the corresponding sliding block 120*a* of the hollow chamber 108 to slide freely in the groove 123 and the gripping elements 112 to follow the sliding movement. Axial movement of the sliding blocks 120*a* and 120*b* of the hollow chamber 108 within the grooves 123 of the first cylindrical member 102 illustrated in FIG. 9A, performs an inward gripping or an outward opening action on the gripping elements 112. In other embodiments, different types and shapes of marking elements are used for representing blocking and opening of the groove 123 of the first cylindrical member 102.

FIGS. 9A-9B illustrate partial exploded views showing an axial alignment of the hollow chamber 108 of the pull system 106 shown in FIGS. 4A-4B, disposed within the first cylindrical member 102 and the second cylindrical member 103 of the cylindrical housing 101 shown in FIG. 10, and operation of the stopper 129 of the second cylindrical member 103 for locking the pull system 106. The second cylindrical member 103 is configured to rotate circumferentially about the outer wall 102*b* of the first cylindrical member 102 about the axis X-X' illustrated in FIG. 9A-9B, causing the stopper 129 to serve, for example, as a latch, and move within the slot 126 of the first cylindrical member 102 from one edge 126*a* to the other edge 126*b* of the slot 126. FIG. 9A illustrates the position of the stopper 129 towards the edge 126*a* of the slot 126, which opens or unblocks the groove 123 disposed near the edge 126*b* of the slot 126 and allows upward and downward movement of the hollow chamber 108 along the axis X-X'. When the triangular mark 803 on the first cylindrical member 102 is substantially aligned with the triangular mark 802 on the second cylindrical member 103 as illustrated in FIG. 9A, the stopper 129 is located near the edge 126*a* of the slot 126, thereby opening or unblocking the groove 123 disposed near the other edge 126*b* of the slot 126, which allows the corresponding sliding block 120*a* of the hollow chamber 108 to slide freely in the groove 123 along the axis X-X' and in turn, allows the hollow chamber 108 to move axially within the through-hole 101*c* of the cylindrical housing 101 illustrated in FIG. 10, and allows the gripping elements 112 illustrated in FIG. 11 and FIGS. 12A-12B to follow the sliding movement.

FIG. 9B illustrates the position of the stopper 129 towards the edge 126*b* of the slot 126, which blocks the groove 123 disposed near the edge 126*b* of the slot 126 and restricts upward and downward movement of the hollow chamber 108 along the axis X-X'. When the circular mark 801 on the second cylindrical member 103 is substantially aligned with the triangular mark 803 on the first cylindrical member 102 as illustrated in FIG. 9B, the stopper 129 is located near the edge 126*b* of the slot 126, thereby blocking the groove 123 disposed near the edge 126*b* of the slot 126, which restricts the corresponding sliding block 120*a* of the hollow chamber 108 from sliding in the groove 123 along the axis X-X', and in turn, restricts the axial movement of the hollow chamber 108 within the through-hole 101*c* of the cylindrical housing 101.

FIG. 10 illustrates a bottom perspective view of an embodiment of the cylindrical housing 101 of the waste picking, storage, and disposal device 100 shown in FIG. 1, FIG. 3A, and FIGS. 4A-4B, showing the pull system 106 disposed axially within the through-hole 101*c* of the cylindrical housing 101, and the hinge components 121 configured to hinge the braces 113 shown in FIGS. 4A-4B, to the lower end 108*b* of the hollow chamber 108 of the pull system 106. As illustrated in FIG. 10, the handle 105 is disposed a predetermined distance away from the pull lever 107 of the pull system 106 for allowing movement of the pull lever 107 within a space 133 defined between the handle 105 and the upper end 101*a* of the cylindrical housing 101. The distance between the handle 105 and the upper end 107*a* of the pull lever 107 is, for example, about 1.5 centimeters (cm) when the device 100 is in a closed condition, and about 3.8 cm when the device 100 is in an open condition. In the closed condition of the device 100, the pull lever 107 is pulled and disposed in an upward position and the gripping elements 112 are in a closed position as illustrated in FIG. 3A, FIG. 13B, and FIGS. 14A-14B. In the open condition of the device 100, the pull lever 107 is released and disposed in a downward position and the gripping elements 112 are in an open position as illustrated in FIGS. 12A-12C, FIGS. 15A-15C, and FIGS. 16A-16B. In an embodiment, the hinge components 121 extend downwardly from the lower end 108*b* of the hollow chamber 108 as illustrated in FIG. 10. The hinge components 121 are made, for example, of plastic, a hard plastic, or a thermoplastic polymer such as acrylonitrile butadiene styrene (ABS). In an embodiment, the hinge components 121 are made of metal. The braces 113 are radially hinged to the lower end 108*b* of the hollow chamber 108 via the hinge components 121 as illustrated in FIG. 12A and FIG. 12C. Also illustrated in FIG. 10, is the protruding element 118*a* comprising the external opening 118*b* of the bag dispenser 118 shown in FIGS. 4A-4B. A user may pull out a disposable bag from the external opening 118*b* of the bag dispenser 118.

Figure 11:
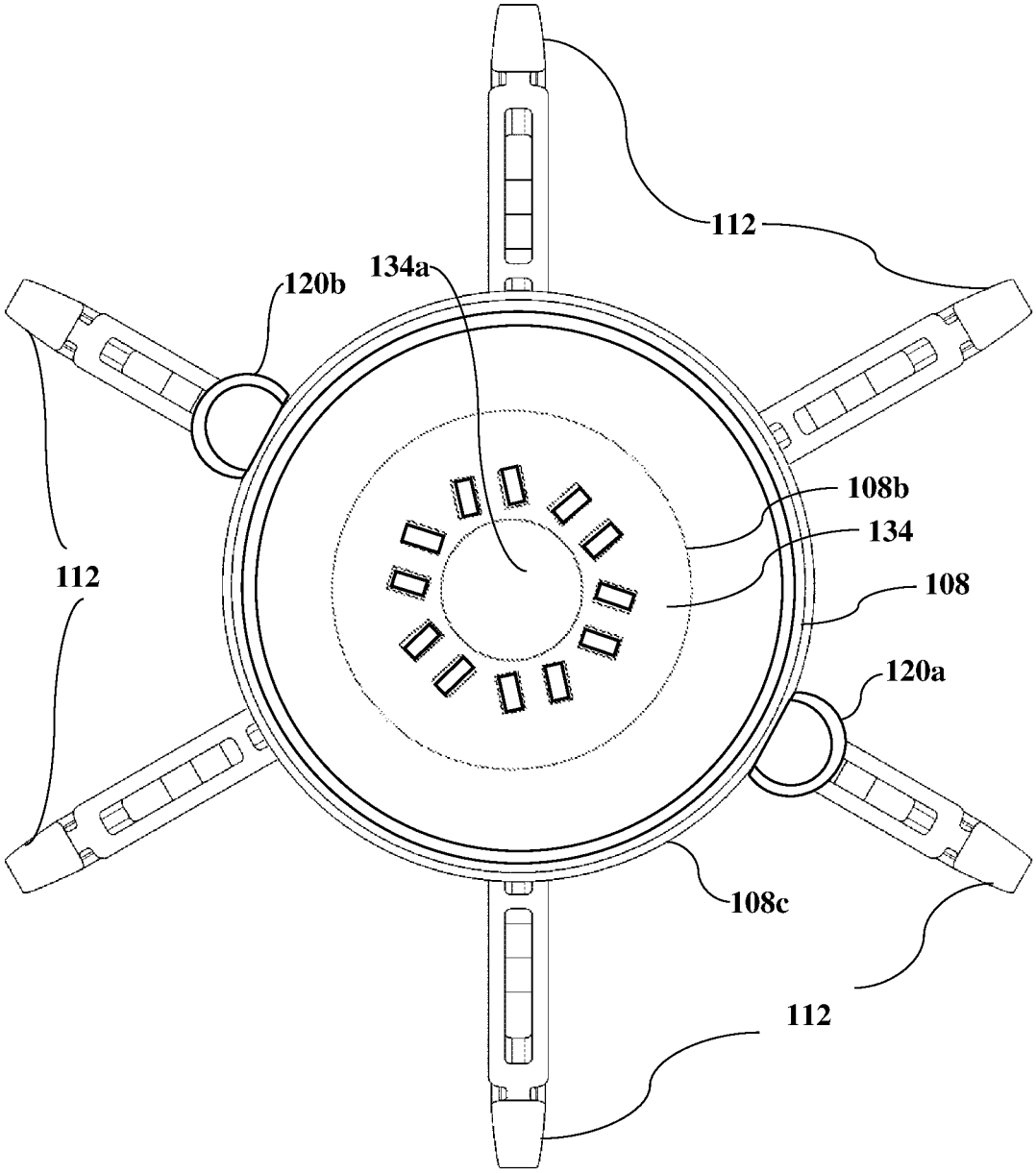
FIG. 11 illustrates a cutaway, top plan view of the hollow chamber of the pull system operably coupled to the gripping elements of the waste picking, storage, and disposal device.

FIG. 11 illustrates a cutaway, top plan view of the hollow chamber 108 of the pull system 106 shown in FIGS. 4A-4B, operably coupled to the gripping elements 112 of the waste picking, storage, and disposal device 100 shown in FIGS. 12A-12C. As illustrated in FIG. 11, the sliding blocks 120*a* and 120*b* are disposed diametrically opposite each other on the outer wall 108*c* of the hollow chamber 108. In an embodiment, a support plate 134 is disposed at the lower end 108*b* of the hollow chamber 108 for supporting the hinge components 121 on the lower end 108*b* of the hollow chamber 108. The support plate 134 partially closes the lower end 108*b* of the hollow chamber 108, while leaving an opening 134*a* for inserting the protruding element 118*a* of the bag dispenser 118 as illustrated in FIG. 10, FIG. 12A, and FIG. 12C.

FIGS. 12A-12B illustrate perspective views of an embodiment of the waste picking, storage, and disposal device 100, showing the gripping elements 112 in an open position. The gripping elements 112 are distributed alternately about the through-hole 101*c* at the lower end 101*b* of the cylindrical housing 101. In an exemplary embodiment, the gripping elements 112 are evenly or uniformly spaced about the through-hole 101*c* at the lower end 101*b* of the cylindrical housing 101. The gripping elements 112 are radially hinged to the hinge components 122 that are operably coupled to the lower end 101*b* of the cylindrical housing 101. The upper end 112*a* of each gripping element 112 is hinged to one of the hinge components 122 forming a hinge joint therebetween. The hinge joints connect the gripping elements 112 to the lower end 101*b* of the cylindrical housing 101. The braces 113 are radially hinged to the hinge components 121 that are operably coupled to the lower end 108*b* of the hollow chamber 108 in a one-to-one correspondence to the gripping elements 112. For example, six braces 113 correspond to six gripping elements 112 of the device 100. The braces 113 are configured to facilitate movement of the gripping elements 112 from a closed position to an open position and vice versa. In an embodiment, the braces 113 are configured as connecting rods that connect the lower end 108*b* of the hollow chamber 108 to mid-sections 112*c* of the corresponding gripping elements 112. Each of the braces 113 comprises a first end 113*a* and a second end 113*b* as illustrated in FIG. 12A. The first end 113*a* of each brace 113 is hinged to the lower end 108*b* of the hollow chamber 108. The first end 113*a* of each brace 113 is hinged to one of the hinge components 121 forming a hinge joint therebetween. The hinge joints connect the braces 113 to the lower end 108*b* of the hollow chamber 108. The second end 113*b* of each brace 113 is operably hinged to a pair of flanges 135 configured substantially on the mid-section 112*c* of a corresponding one of the gripping elements 112 for facilitating the opening and the closing of the gripping elements 112. Each brace 113 extends from the hinge component 121 and terminates at the pair of flanges 135 at the mid-section 112*c* of the corresponding gripping element 112. The pair of flanges 135, disposed on the mid-section 112*c* of each of the gripping elements 112, hinges the second end 113*b* of a corresponding one of the braces 113 and hosts the corresponding brace 113.

When the pull lever 107 of the pull system 106 is released axially in a downward direction, causing the lower end 108*b* of the hollow chamber 108 to move axially in a downward direction within the internal space 114 defined by the gripping elements 112, the hinge joint formed between the first end 113*a* of each brace 113 and the corresponding hinge component 121 flexes each brace 113 in an outward direction, thereby moving the gripping elements 112 in an outward direction. When each brace 113, whose second end 113*b* is hinged to a corresponding gripping element 112, flexes in an outward direction, the hinge joint formed between the upper end 112*a* of the corresponding gripping element 112 and the corresponding hinge component 122 moves the gripping element 112 in an outward direction, thereby allowing the gripping element 112 to open as illustrated in FIGS. 12A-12B. In the open position, the gripping elements 112 extend to an angle, for example, from about 0 degrees to about 45 degrees. When the pull lever 107 is pulled axially in an upward direction, causing the lower end 108*b* of the hollow chamber 108 to move axially in an upward direction from the internal space 114 defined by the gripping elements 112, the hinge joint formed between the first end 113*a* of each brace 113 and the corresponding hinge component 121 flexes each brace 113 in an inward direction, thereby moving the gripping elements 112 in an inward direction. When each brace 113, whose second end 113*b* is hinged to a corresponding gripping element 112, flexes in an inward direction, the hinge joint formed between the upper end 112*a* of the corresponding gripping element 112 and the corresponding hinge component 122 moves the gripping element 112 in an inward direction, thereby allowing the gripping element 112 to close.

FIG. 12C illustrates a bottom elevation view of an embodiment of the waste picking, storage, and disposal device 100, showing the gripping elements 112 in the open position. FIG. 12C illustrates the connection of the first end 113*a* of each brace 113 to a corresponding hinge component 121 extending from the lower end 108*b* of the hollow chamber 108 of the pull system 106 shown in FIGS. 4A-4B, and the connection of the second end 113*b* of each brace 113 to the pair of flanges 135 of a corresponding gripping element 112. The gripping elements 112 are hinged to the hinge components 122 extending from the lower end 101*b* of the cylindrical housing 101 of the device 100. Also illustrated in FIG. 12C, is the protruding element 118*a* comprising the external opening 118*b* of the bag dispenser 118 shown in FIGS. 4A-4B, through which a disposable bag is pulled out prior to operating the pull lever 107 of the pull system 106 in a downward direction and an upward direction as disclosed in the description of FIGS. 12A-12B.

FIG. 13A illustrates a front elevation view of an embodiment of the waste picking, storage, and disposal device 100 in a closed condition. Prior to operation of the device 100 for picking, storing, and disposing waste, the device 100 is stored in a closed condition. In the closed condition, the gripping elements 112 are disposed in a closed position as illustrated in FIG. 13B, by pulling the pull lever 107 of the pull system 106 axially in an upward direction indicated by an arrow in FIG. 13A, and the end cap 109 is attached to the lower end 101*b* of the cylindrical housing 101 of the device 100 to enclose and conceal the gripping elements 112 in the closed position.

FIG. 13B illustrates a cross-sectional view of an embodiment of the waste picking, storage, and disposal device 100 in the closed condition, taken along a section line B-B' shown in FIG. 13A. As illustrated in FIG. 13B, the pull lever 107 is threadably connected to the hollow chamber 108 via threads, for example, screw threads 136, configured on the upper end 108*a* of the hollow chamber 108 and the lower end 107*b* of the pull lever 107. FIG. 13B also illustrates the mounting rod 117 of the pull system 106 disposed axially within an internal space 108*d* of the hollow chamber 108. In an embodiment, the lower end 107*b* of the pull lever 107 is threadably connected to the upper end 117*a* of the mounting rod 117 via the threaded opening 107*d* at the lower end 107*b* of the pull lever 107 illustrated in FIG. 4A. The mounting rod 117 accommodates a continuous roll 115 of disposable bags thereon within the internal space 108*d* of the hollow chamber 108. The upper end 117*a* of the mounting rod 117 extends into an internal space 107*e* of the pull lever 107. The pull lever 107 is detachably connected to the upper end 117*a* of the mounting rod 117 and is removable from the upper end 117*a* of the mounting rod 117 for loading the continuous roll 115 of disposable bags onto the mounting rod 117. In an embodiment, the upper end 117*a* of the mounting rod 117 comprises threads, for example, screw threads 117*c*, for removably engaging the pull lever 107 to the upper end 117*a* of the mounting rod 117. The pull lever 107 is detached and removed from the upper end 117*a* of the mounting rod 117 to load the continuous roll 115 of disposable bags onto the mounting rod 117. The hollow chamber 108 defines an internal space 108*d* for accommodating the continuous roll 115 of disposable bags as illustrated in FIG. 13B. The bag dispenser 118 is enclosed in the internal space 108*d* of the hollow chamber 108 within the general cylindrical housing 101. In an embodiment, the mounting rod 117 extends axially within the internal space 108*d* of the hollow chamber 108 from the upper end 108*a* towards the lower end 108*b* of the hollow chamber 108, and supports the continuous roll 115 of disposable bags thereon. In an embodiment, for loading the continuous roll 115 of disposable bags, the pull lever 107 is first disengaged from the hollow chamber 108 and is pulled out of the hollow chamber 108 along with the mounting rod 117 and the attached bag dispenser 118. The pull lever 107 is then disengaged from the upper end 117*a* of the mounting rod 117. The continuous roll 115 of disposable bags is then loaded on the mounting rod 117 and supported by the support plate 116 above the bag dispenser 118. The pull lever 107 is then re-engaged with the upper end 117*a* of the mounting rod 117. The mounting rod 117 with the loaded, continuous roll 115 of disposable bags is then re-inserted into the internal space 108*d* of the hollow chamber 108 such that the protruding element 118*a* of the bag dispenser 118 protrudes through the opening 134*a* at the lower end 108*b* of the hollow chamber 108. The pull lever 107, that is re-engaged with the upper end 117*a* of the mounting rod 117, is then re-engaged with the upper end 108*a* of the hollow chamber 108.

The support plate 116, disposed coaxially at the lower end 117*b* of the mounting rod 117, supports the continuous roll 115 of disposable bags. The lower end 117*b* of the mounting rod 117 is operably coupled to the bag dispenser 118. The bag dispenser 118 extends downwardly from the lower end 117*b* of the mounting rod 117. The bag dispenser 118 is disposed proximal to the lower end 108*b* of the hollow chamber 108 as illustrated in FIG. 13B, and to the lower end 101*b* of the cylindrical housing 101 for supporting the continuous roll 115 of disposable bags along with the support plate 116. One end 118*c* of the bag dispenser 118 is attached to the lower end 117*b* of the mounting rod 117. The protruding element 118*a* of the bag dispenser 118 disposed on the other end opposing the end 118*c* of the bag dispenser 118. The external opening 118*b* of the protruding element 118*a* is configured to dispense one of the disposable bags from the continuous roll 115 of disposable bags stored in the hollow chamber 108 for containing and disposing the waste. After loading the continuous roll 115 of disposable bags onto the mounting rod 117, one of the disposable bags is inserted into the external opening 118*b* of the protruding element 118*a* of the bag dispenser 118, prior to re-inserting the mounting rod 117 into the internal space 108*d* of the hollow chamber 108. The protruding element 118*a* with the external opening 118*b* protrudes into the internal space 114 defined by the gripping elements 112 for allowing a user to pull out the inserted disposable bag and wrap the disposable bag around the gripping elements 112 when the gripping elements 112 are in an open position as illustrated in FIG. 18D. The user pulls the disposable bag out through the external opening 118*b* of the protruding element 118*a* of the bag dispenser 118 into the internal space 114 defined within the gripping elements 112. As illustrated in FIG. 13B, the device 100 is in the closed condition where the pull lever 107 is disposed in an upward direction and the end cap 109 is attached to the lower end 101*b* of the cylindrical housing 101 of the device 100 to enclose and conceal the gripping elements 112 in the closed position. In the closed position, the lower ends 112*b*, that is, the tips of the gripping elements 112 meet towards a single point.

FIG. 13C illustrates a cross-sectional view of an embodiment of the waste picking, storage, and disposal device 100 in the closed condition, taken along a section line C-C' shown in FIG. 13A. The position of the stopper 129 of the second cylindrical member 103 with respect to the first cylindrical member 102 of the cylindrical housing 101 is illustrated in FIG. 13C, indicating a locked condition of the device 100. To lock the device 100, the second cylindrical member 103 is rotated in a circumferential direction about the outer wall 102*b* of the first cylindrical member 102, such that the stopper 129 reaches the edge 126*b* of the slot 126 illustrated in FIG. 5, and blocks the corresponding groove 123 of the first cylindrical member 102 (not visible in FIG. 13C due to blockage by the stopper 129). By blocking the groove 123 disposed near the edge 126*b* of the slot 126, the stopper 129 restricts axial movement of the corresponding sliding block 120*a* of the hollow chamber 108 illustrated in FIG. 9B, within the groove 123, thereby locking the device 100. In the locked condition, the gripping elements 112 are retained in a closed position and precluded from damage.

Figure 14A:
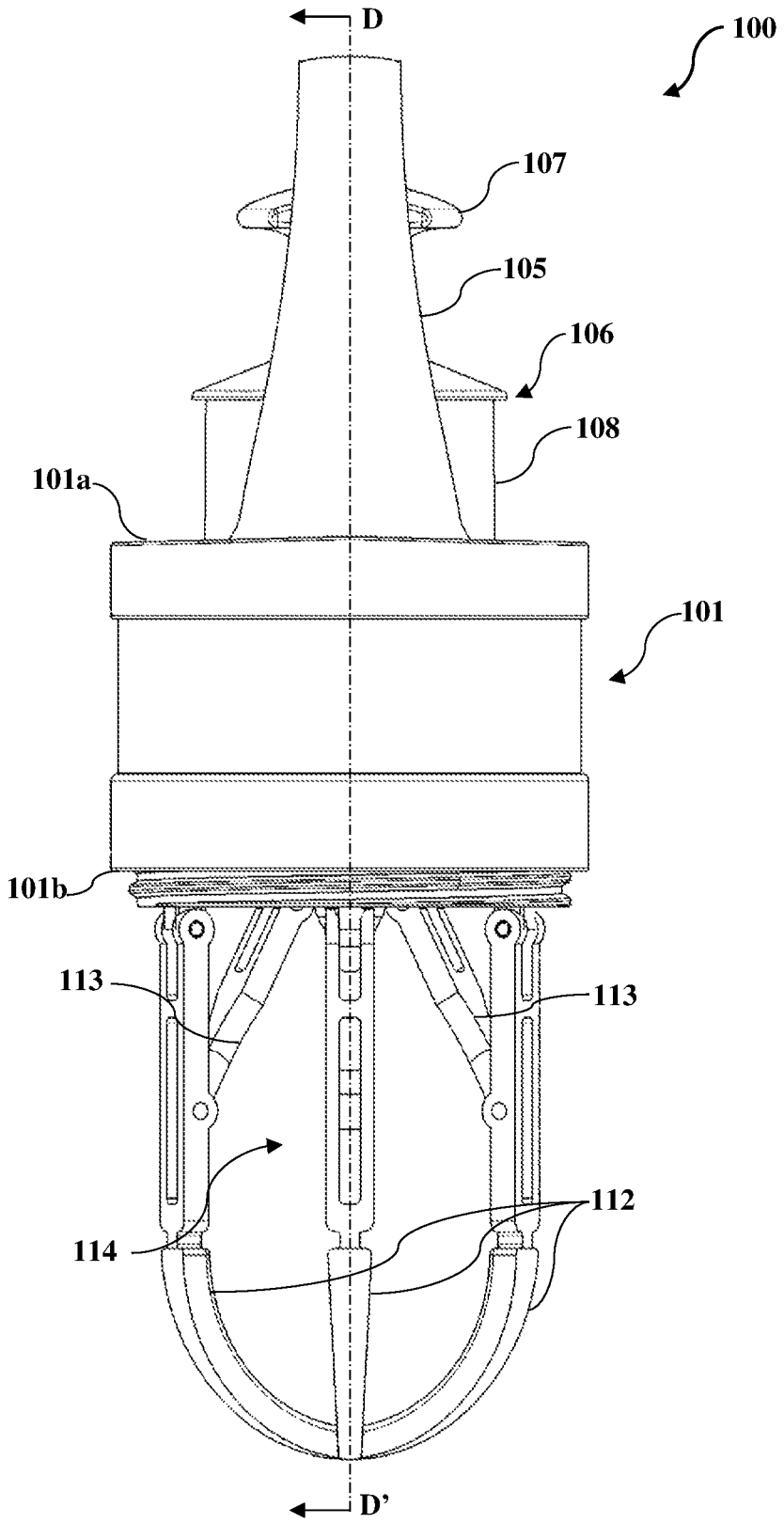
FIG. 14A illustrates a side elevation view of an embodiment of the waste picking, storage, and disposal device, showing the gripping elements in the closed position.
Figure 14B:
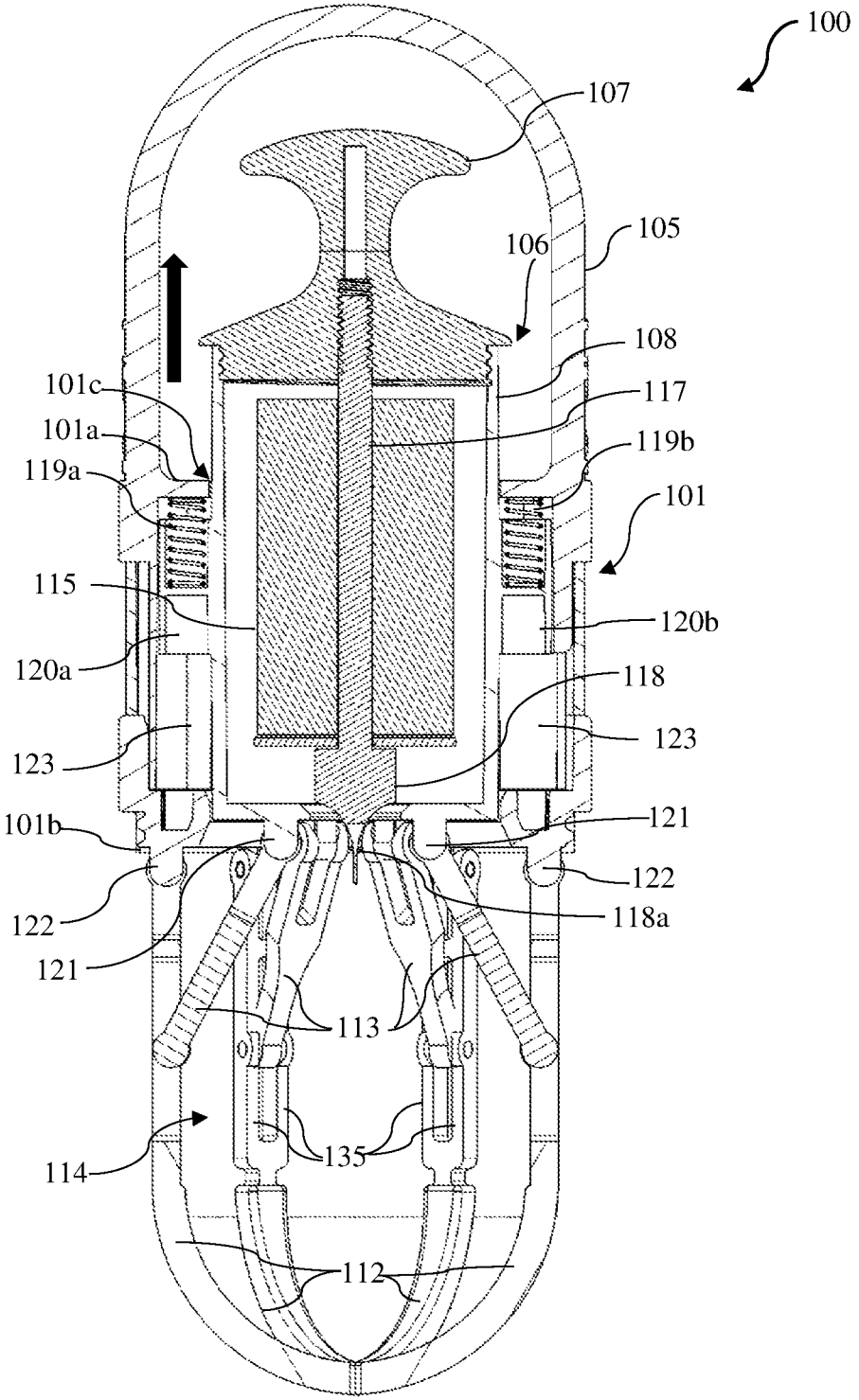
FIG. 14B illustrates a cross-sectional view of an embodiment of the waste picking, storage, and disposal device, taken along a section line D-D' shown in FIG. 14A.

FIG. 14A illustrates a side elevation view of an embodiment of the waste picking, storage, and disposal device 100, showing the gripping elements 112 in a closed position. The end cap 109 shown in FIGS. 13A-13B, is detached and removed from the lower end 101*b* of the cylindrical housing 101 of the device 100 to expose the gripping elements 112 in the closed position as illustrated in FIG. 14A. FIG. 14B illustrates a cross-sectional view of an embodiment of the waste picking, storage, and disposal device 100, taken along a section line D-D' shown in FIG. 14A. FIG. 14B illustrates the spring-loaded mechanism of the device 100 comprising the spring members 119*a* and 119*b*. The spring members 119*a* and 119*b* are, for example, compression springs made of a metal alloy such as steel. The spring members 119*a* and 119*b* are supported at the upper end 101*a* of the cylindrical housing 101. For example, one end of each of the spring members 119*a* and 119*b* is fixed and supported at the upper end 101*a* of the cylindrical housing 101. The spring members 119*a* and 119*b* are disposed on opposing sides of the hollow chamber 108. The spring members 119*a* and 119*b* are configured to compress and decompress during operation of the pull lever 107 of the pull system 106. The spring members 119*a* and 119*b* resist a linear force applied axially by a pull operation on the pull lever 107. When the pull lever 107 is pulled in an upward direction, the spring members 119*a* and 119*b* are compressed and store the compressive force as energy, until the spring members 119*a* and 119*b* release the energy and decompress. The spring members 119*a* and 119*b* facilitate an upward movement and a downward movement of the pull system 106 as disclosed in the description of FIG. 16B. In an embodiment, the spring members 119*a* and 119*b* are compressed in an axial direction when the pull lever 107 is pulled axially in an upward direction to close the gripping elements 112 for storage of the device 100 in the closed condition; and the spring members 119*a* and 119*b* are decompressed or expanded in an axial direction when the pull lever 107 is released axially in a downward direction to open the gripping elements 112 for ready picking of waste.

Figure 15A:
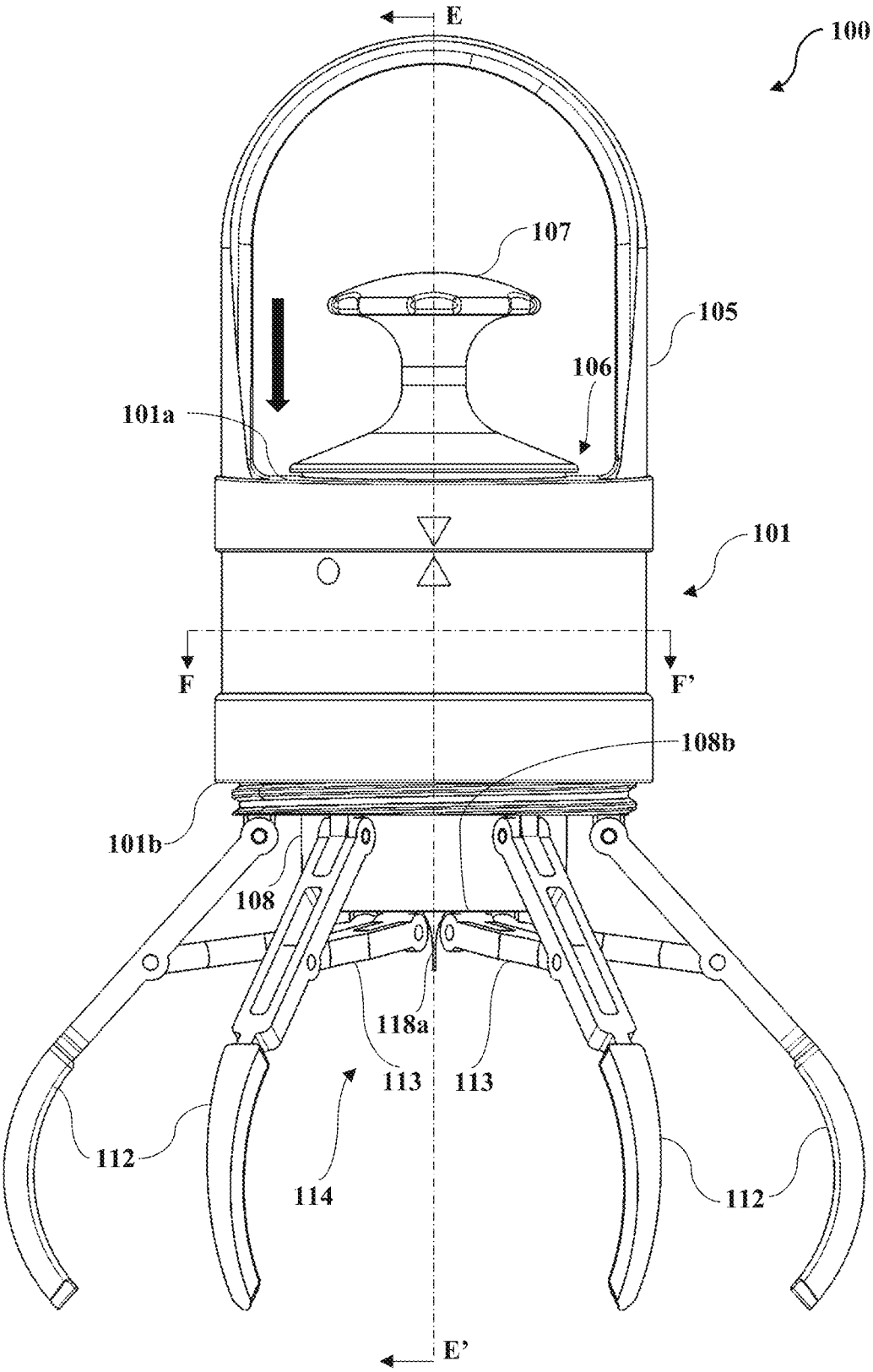
FIG. 15A illustrates a front elevation view of an embodiment of the waste picking, storage, and disposal device in an open condition.

FIG. 15A illustrates a front elevation view of an embodiment of the waste picking, storage, and disposal device 100 in an open condition. In the open condition, the end cap 109 shown in FIGS. 13A-13B, is detached and removed from the lower end 101*b* of the cylindrical housing 101 of the device 100 to expose the gripping elements 112 as illustrated in FIGS. 14A-14B. The pull lever 107 of the pull system 106 is then released axially in the downward direction indicated by an arrow in FIG. 15A, to open the gripping elements 112 for picking up waste. When the pull lever 107 is released axially in the downward direction, the hollow chamber 108 moves in a downward direction within the internal space 114, causing the braces 113 to flex and expand, and in turn, the gripping elements 112 to open for ready picking of waste as disclosed in the description of FIGS. 16A-16B.

Figure 15B:
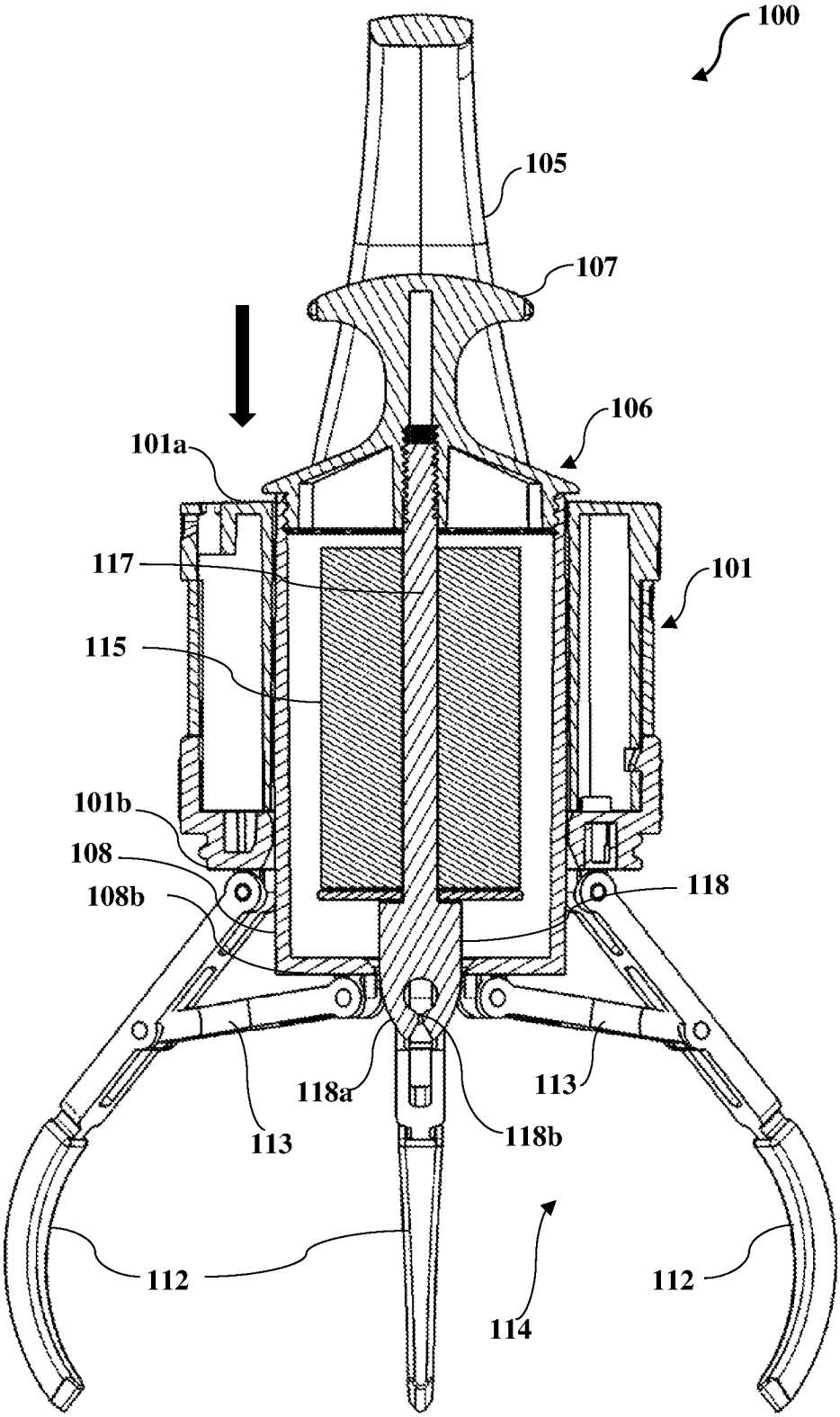
FIG. 15B illustrates a cross-sectional view of an embodiment of the waste picking, storage, and disposal device in the open condition, taken along a section line E-E' shown in FIG. 15A.

FIG. 15B illustrates a cross-sectional view of an embodiment of the waste picking, storage, and disposal device 100 in the open condition, taken along a section line E-E' shown in FIG. 15A. FIG. 15B illustrates the bag dispenser 118 disposed proximal to the lower end 108*b* of the hollow chamber 108. Also illustrated in FIG. 15B are the braces 113 in a flexed and expanded condition, causing the gripping elements 112 to open for ready picking of waste.

Figure 15C:
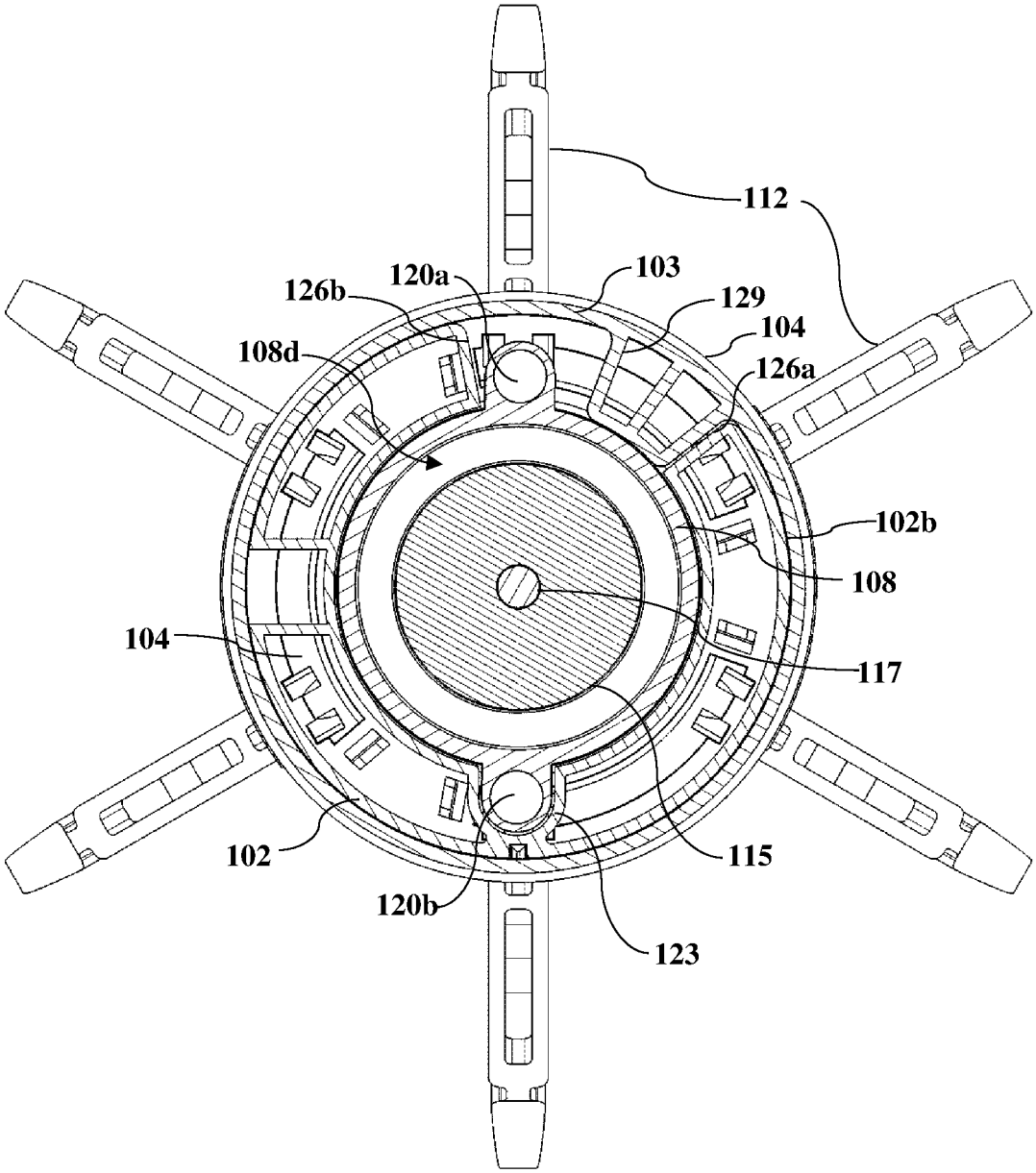
FIG. 15C illustrates a cross-sectional view of an embodiment of the waste picking, storage, and disposal device in the open condition, taken along a section line F-F' shown in FIG. 15A.

FIG. 15C illustrates a cross-sectional view of an embodiment of the waste picking, storage, and disposal device 100 in the open condition, taken along a section line F-F' shown in FIG. 15A. FIG. 15C illustrates the device 100 in an unlocked condition, where the stopper 129 of the second cylindrical member 103 is positioned at the edge 126*a* of the slot 126 of the first cylindrical member 102 of the cylindrical housing 101 shown in FIG. 5, and away from one of the grooves 123 disposed near the other edge 126*b* of the slot 126, thereby unblocking or opening the groove 123 near the other edge 126*b* of the slot 126 and allowing axial movement of the sliding block 120*a* of the hollow chamber 108, within the groove 123. To unlock the device 100, the second cylindrical member 103 of the cylindrical housing 101 is rotated about the outer wall 102*b* of the first cylindrical member 102 in a circumferential direction towards the edge 126*a* of the slot 126 for allowing axial movement of the hollow chamber 108 in an upward direction and a downward direction to close and open the gripping elements 112, respectively.

Figure 16A:
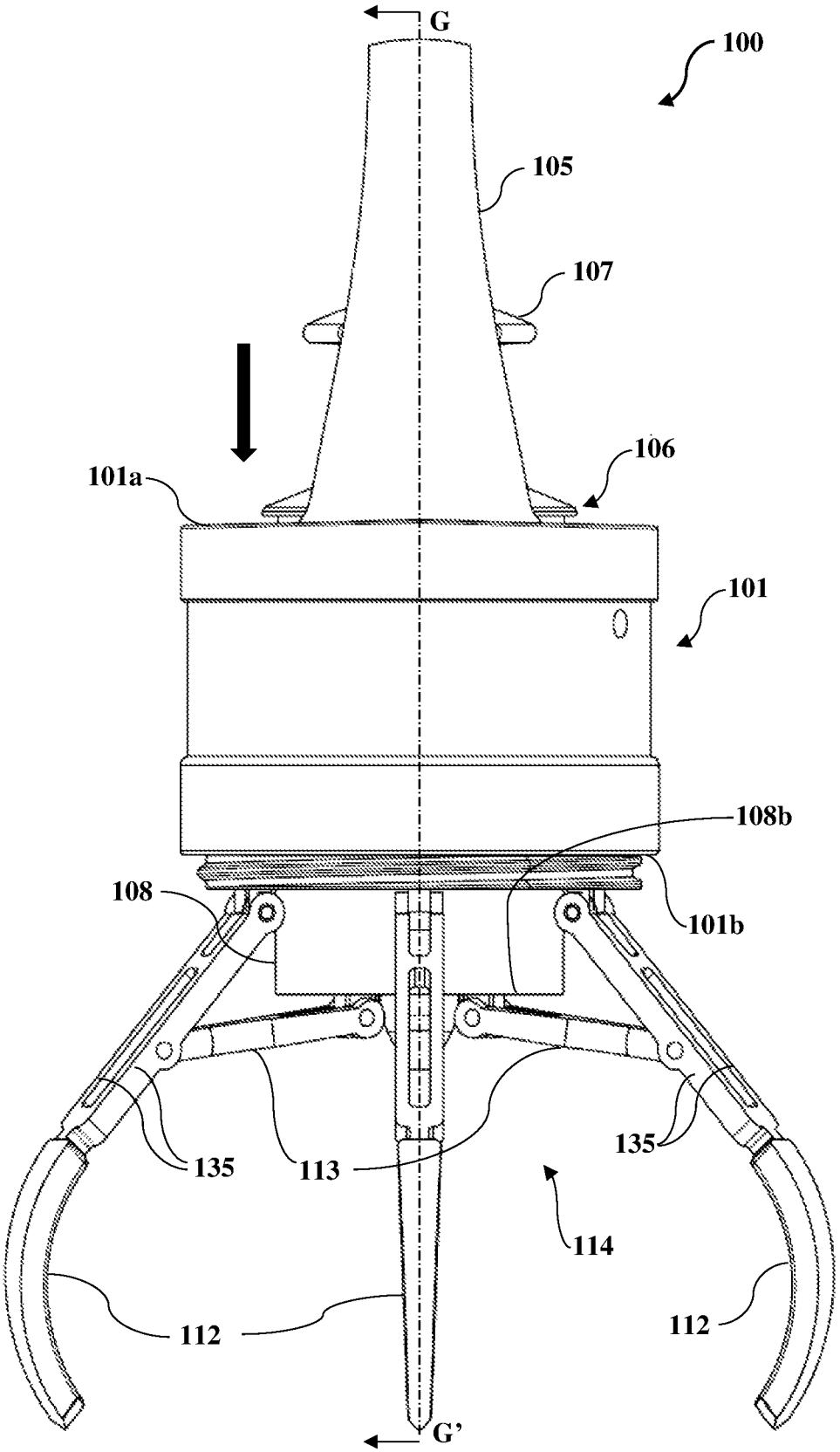
FIG. 16A illustrates a side elevation view of an embodiment of the waste picking, storage, and disposal device in the open condition.
Figure 16B:
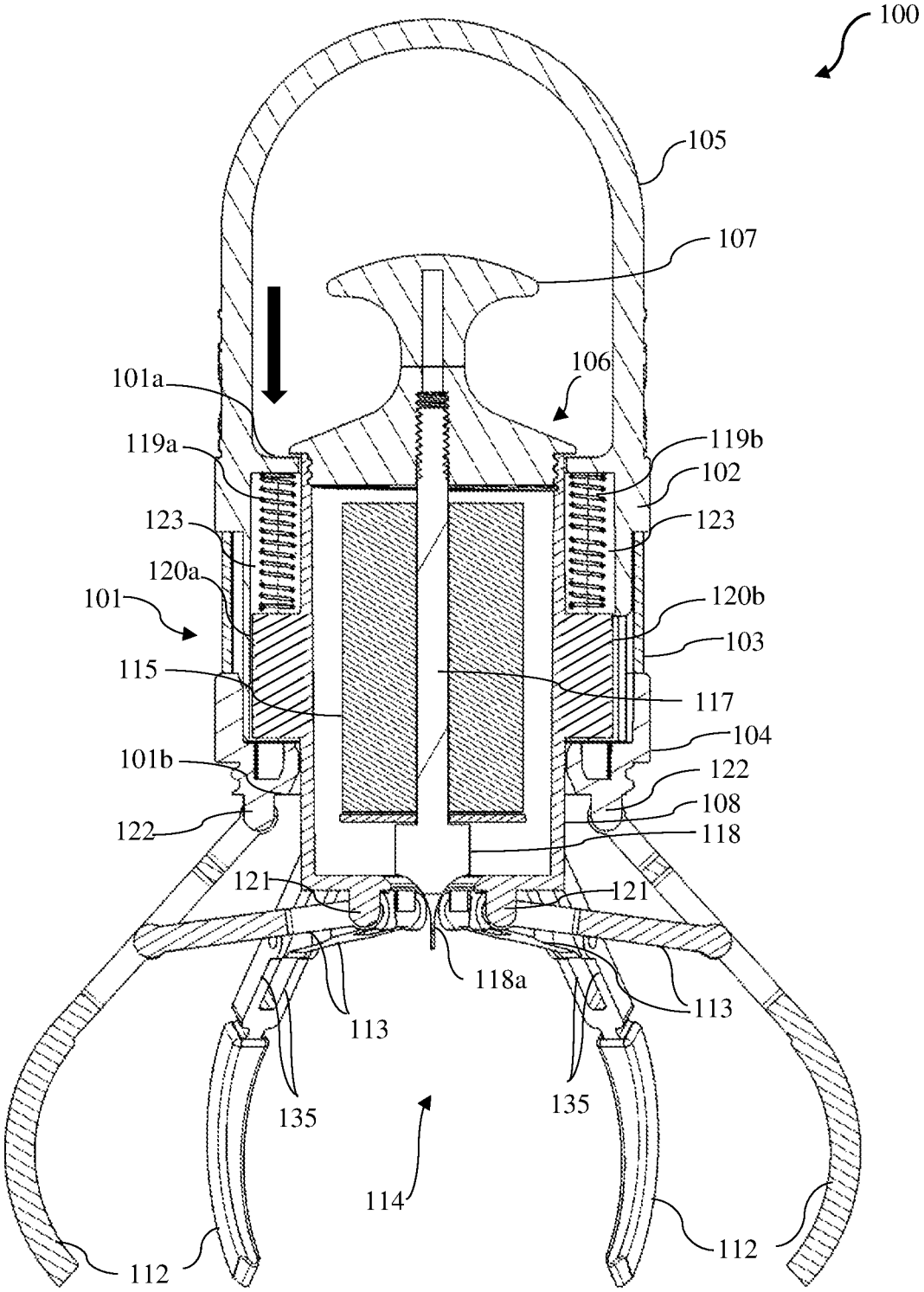
FIG. 16B illustrates a cross-sectional view of an embodiment of the waste picking, storage, and disposal device in the open condition, taken along a section line G-G' shown in FIG. 16A.

FIG. 16A illustrates a side elevation view of an embodiment of the waste picking, storage, and disposal device 100 in the open condition. FIG. 16B illustrates a cross-sectional view of an embodiment of the waste picking, storage, and disposal device 100 in the open condition, taken along a section line G-G' shown in FIG. 16A. As illustrated in FIG. 16B, the spring-loaded mechanism of the device 100 comprising the spring members 119*a* and 119*b* is supported at the upper end 101*a* of the cylindrical housing 101. In an exemplary embodiment, the spring members 119*a* and 119*b* are supported on support members (not shown) extending from the upper end 101*a* of the cylindrical housing 101. In an embodiment, the support members are configured as poles for coaxially supporting the spring members 119*a* and 119*b*. The spring members 119*a* and 119*b* are disposed on opposing sides of the hollow chamber 108 of the pull system 106. In an embodiment, the spring members 119*a* and 119*b* are located within the grooves 123 of the first cylindrical member 102 of the cylindrical housing 101, above the sliding blocks 120*a* and 120*b* of the hollow chamber 108. The spring members 119*a* and 119*b* are further supported by the sliding blocks 120*a* and 120*b* of the hollow chamber 108. The sliding blocks 120*a* and 120*b* also prevent the pull system 106 from moving forward against the third cylindrical member 104 of the cylindrical housing 101. The spring members 119*a* and 119*b* facilitate an upward movement and a downward movement of the pull system 106 by compression and decompression of the spring members 119*a* and 119*b*, respectively. When the pull lever 107 is released axially in the downward direction, the spring members 119*a* and 119*b*, previously compressed, are decompressed or expanded and facilitate a downward movement of the pull system 106 as illustrated in FIG. 16B. The downward movement of the pull system 106 causes the braces 113 to flex in an outward direction, and in turn, causes the gripping elements 112 to open in an outward direction as illustrated in FIG. 16B. In another embodiment, the spring members 119*a* and 119*b* decompress during a pull operation of the pull lever 107 and compress during a push or release operation of the pull lever 107.

Figure 17A:
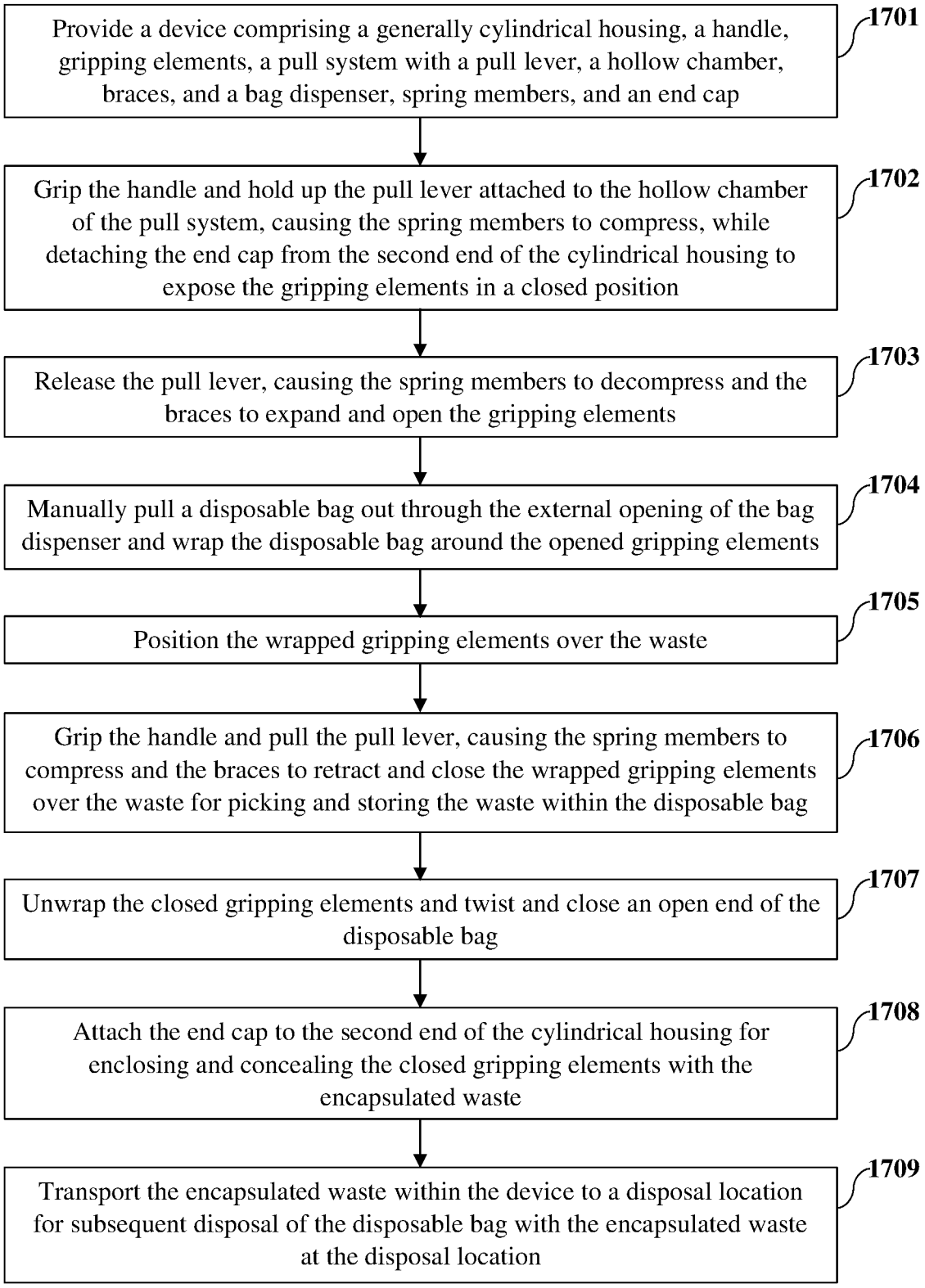
FIGS. 17A-17B illustrate a flowchart of an embodiment of a method for picking, storing, and disposing waste.
Figure 17B:
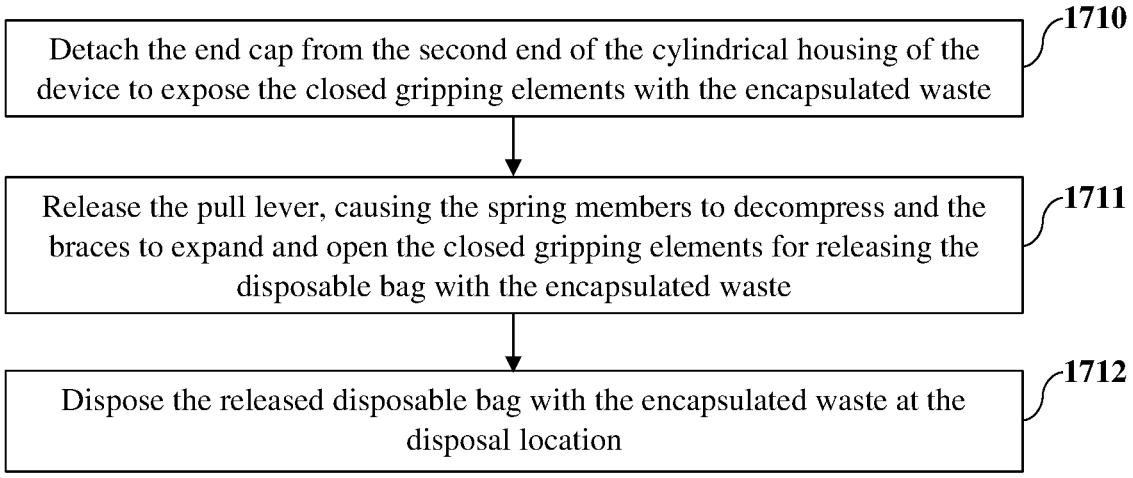

FIGS. 17A-17B illustrate a flowchart of an embodiment of a method for picking, storing, and disposing waste. In the method disclosed herein, the device 100 comprising the generally cylindrical housing 101, the handle 105, the gripping elements 112, the pull system 106, the spring members 119*a* and 119*b*, and the end cap 109 illustrated in FIGS. 4A-4B and disclosed in the descriptions of FIGS. 1-16B, is provided 1701. The pull system 106 comprises the pull lever 107, the hollow chamber 108, the braces 113, and the bag dispenser 118 as illustrated in FIGS. 4A-4B. The pull lever 107 is operated in a first direction to open the gripping elements 112 for picking the waste, and operated in a second direction to close the gripping elements 112 for encapsulating the waste. For example, the pull lever 107 is pushed or released axially in a downward direction to open the gripping elements 112 for picking the waste, and pulled axially in an upward direction to close the gripping elements 112 for encapsulating the waste.

To operate the device 100 as illustrated in the flowchart of FIG. 17A, the user grips 1702 the handle 105 of the device 100 and holds up the pull lever 107 attached to the hollow chamber 108, causing the spring members 119*a* and 119*b* to compress as illustrated in FIG. 14B, while detaching the end cap 109 of the device 100 from the lower end 101*b* of the cylindrical housing 101 to expose the gripping elements 112 in a closed position. The user then releases 1703 the pull lever 107, causing the spring members 119*a* and 119*b* to decompress and the braces 113 to expand and open the gripping elements 112 as illustrated in FIG. 15B and FIG. 16B. After the pull lever 107 is pulled up and the end cap 109 is removed, the gripping elements 112 open up, when the pull lever 107 is released. The user then manually pulls 1704 one of the disposable bags out through the external opening 118*b* of the bag dispenser 118 illustrated in FIG. 12A and FIG. 12C, FIG. 15B, and FIG. 16B, and wraps the disposable bag around the opened gripping elements 112 to protect the opened gripping elements 112 from directly contacting the waste. The user then positions 1705 the wrapped gripping elements 112 of the device 100 over the waste. The user then grips 1706 the handle 105 and pulls the pull lever 107 axially in an upward direction, causing the spring members 119*a* and 119*b* to compress and the braces 113 to retract and close the wrapped gripping elements 112 over the waste for picking and storing the waste within the disposable bag. At this stage, the wrapped gripping elements 112 completely cover the waste in contact with the disposable bag. The user unwraps 1707 the closed gripping elements 112 and twists and closes an open end of the disposable bag for encapsulating the waste within the disposable bag and preventing leakage. The user then attaches 1708 the end cap 109 to the lower end 101*b* of the cylindrical housing 101 for enclosing and concealing the closed gripping elements 112 with the encapsulated waste and thereafter transports 1709 the encapsulated waste within the device 100 to a disposal location, for example, a waste container or trash can, for subsequent disposal of the disposable bag with the encapsulated waste at the disposal location.

As illustrated in the flowchart of FIG. 17B, in the subsequent disposal of the disposable bag with the encapsulated waste, the user detaches 1710 the end cap 109 from the lower end 101*b* of the cylindrical housing 101 to expose the closed gripping elements 112 with the encapsulated waste. The user then releases 1711 the pull lever 107, causing the spring members 119*a* and 119*b* to decompress and the braces 113 to expand and open the closed gripping elements 112 for releasing the disposable bag with the encapsulated waste. The gripping elements 112 are slowly opened while the user holds the twisted end of the disposable bag. The user pulls the twisted end of the disposable bag containing the waste to release the disposable bag with the waste from the device 100. The user then disposes 1712 the released, disposable bag with the encapsulated waste at the disposal location.

Releasing the disposable bag with the encapsulated waste from the opened gripping elements 112 dispenses another one of the disposable bags from the external opening of the bag dispenser 118 for subsequent picking, storing, and disposal of other waste. A tip of the next disposable bag from the continuous roll 115 of disposable bags illustrated in FIGS. 15B-15C and FIG. 16B, protrudes out of the external opening 118*b* of the bag dispenser 118 for a subsequent cleanup of waste, when the first disposable bag with the encapsulated waste is released from the device 100. In an embodiment, the user locks the pull system 106 and in turn, the gripping elements 112 in the closed position, by restricting axial movement of the hollow chamber 108 of the pull system 106 using the stopper 129 illustrated in FIG. 6, configured in the cylindrical housing 101 of the device 100 as disclosed in the description of FIGS. 9A-9B. The user locks the pull system 106 to preclude the gripping elements 112 from inadvertently opening and the waste from falling out of the device 100, when the end cap 109 is detached from the cylindrical housing 101 of the device 100. Furthermore, the user locks the pull system 106 to preclude the gripping elements 112 from inadvertently opening and getting damaged, when the end cap 109 is detached from the cylindrical housing 101 of the device 100. In an embodiment, the user detaches the pull lever 107 of the pull system 106 from the upper end 108*a* of the hollow chamber 108 for loading the continuous roll 115 of disposable bags into the hollow chamber 108 as disclosed in the description of FIG. 13B.

Figure 18C:
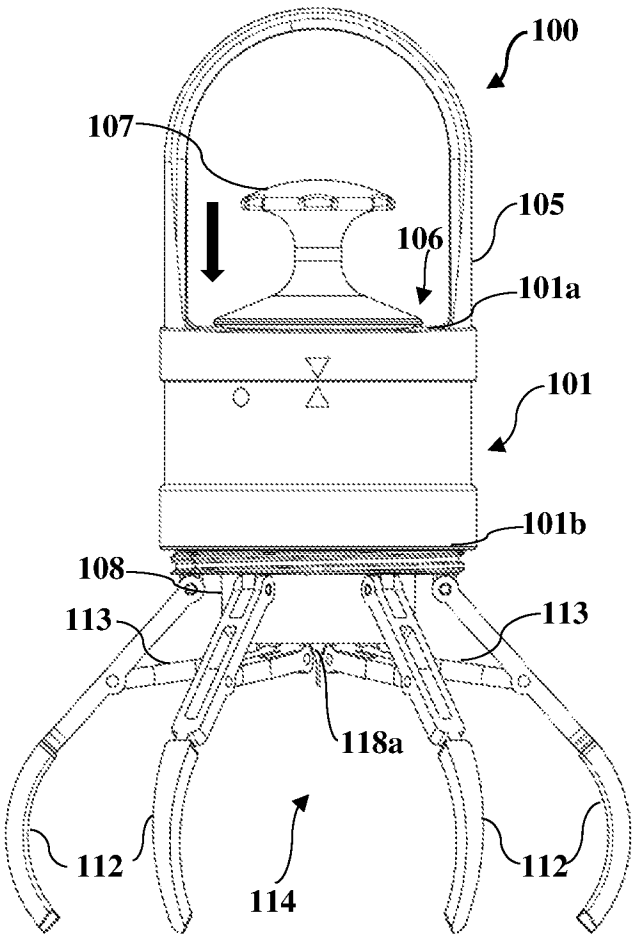
FIGS. 18A-18F illustrate elevation views showing operation of the waste picking, storage, and disposal device for picking, storing, and disposing waste.
Figure 18B:
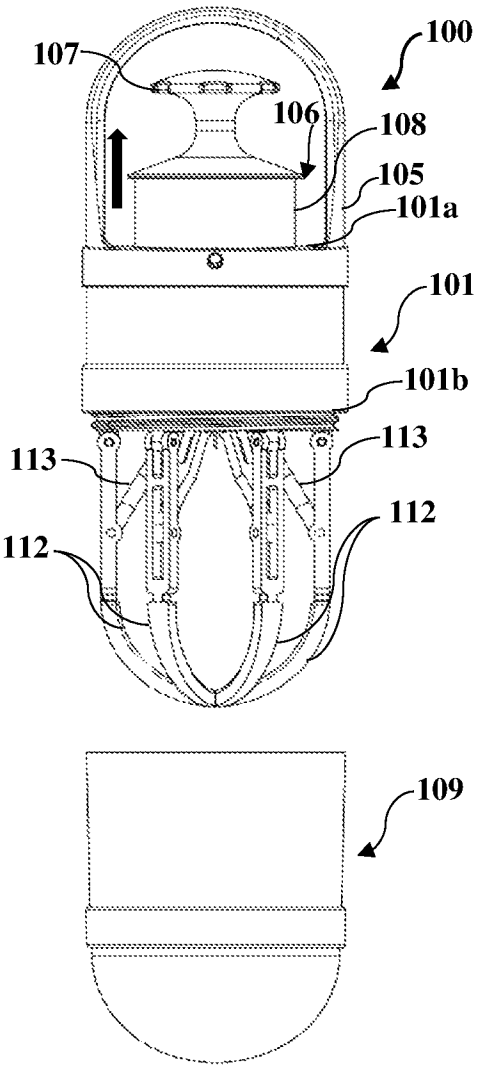
Figure 18A:
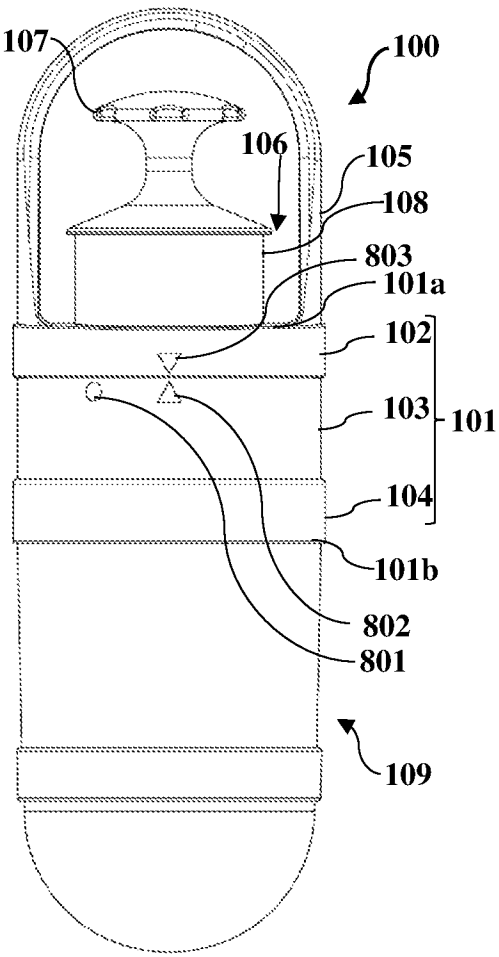
Figure 18F:
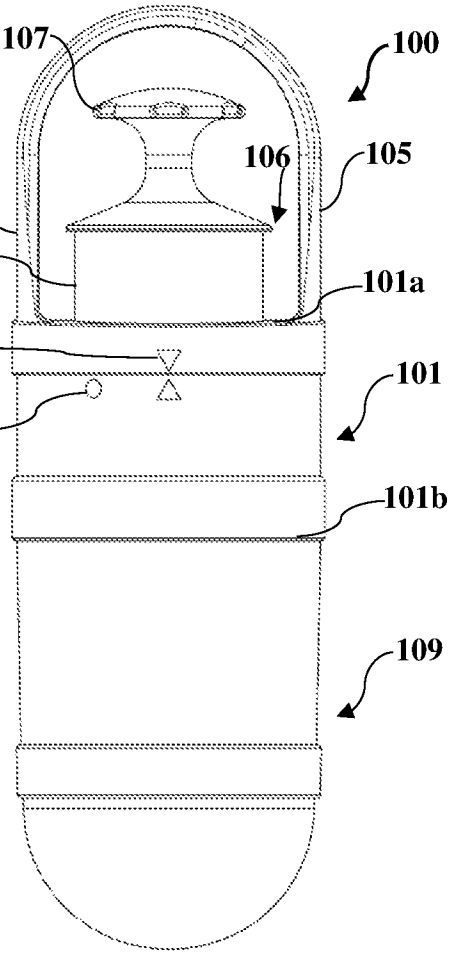
Figure 18E:
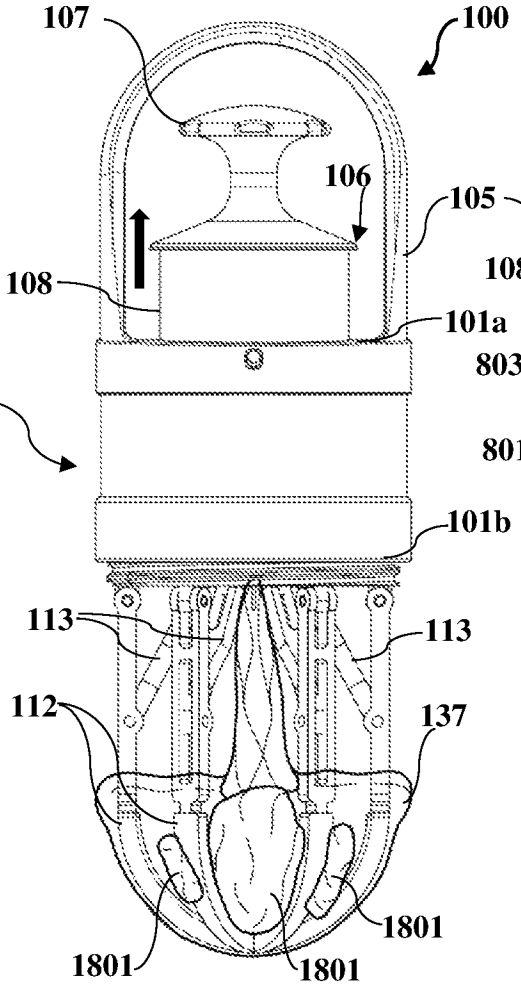
Figure 18D:
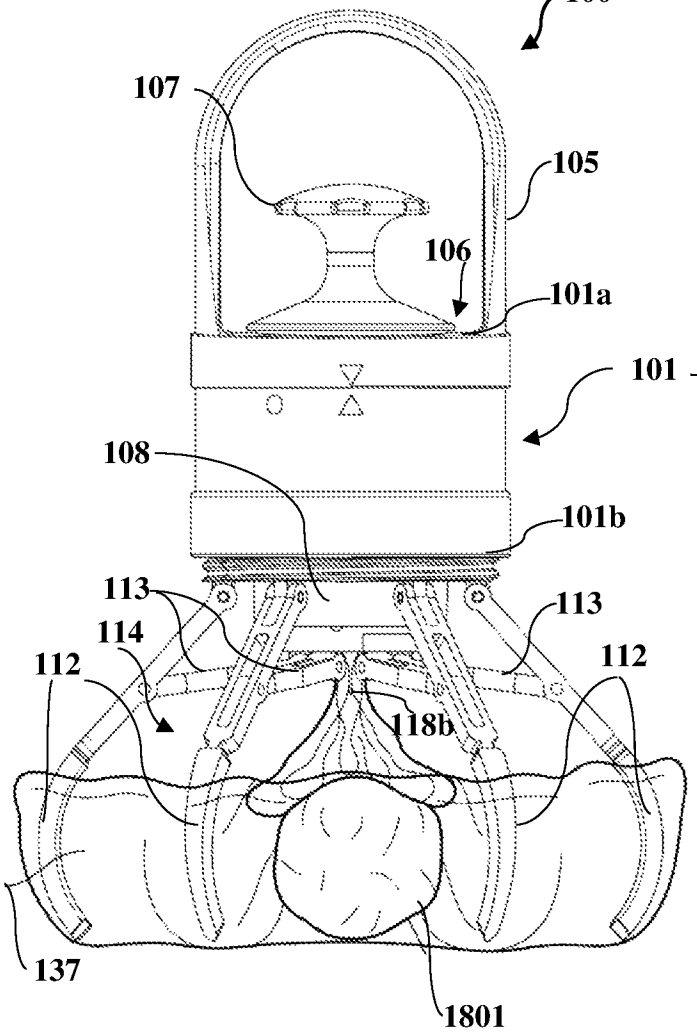

FIGS. 18A-18F illustrate elevation views showing operation of the waste picking, storage, and disposal device 100 for picking, storing, and disposing waste, for example, pet waste 1801. Consider an example where a pet owner takes a pet such as a dog for a walk in the park. The pet owner carries the device 100 in a closed condition as illustrated in FIG. 18A, on one wrist or around the pet owner's neck using the strap 202 illustrated in FIG. 2, attached to the device 100. The pet owner uses the device 100 to clean up after the pet during the walk in the park. To operate the device 100, the pet owner rotates the second cylindrical member 103 of the cylindrical housing 101 in one direction to align the triangle mark 803 on the first cylindrical member 102 with the triangular mark 802 on the second cylindrical member 103, which unlocks the device 100 and allows axial movement of the hollow chamber 108 illustrated in FIGS. 4A-4B, FIGS. 9A-9B, FIG. 13B, FIG. 14B, FIG. 15B, and FIG. 16B. The pet owner then grips the handle 105, holds up the pull lever 107 using fingers on both sides of the pull lever 107, and detaches the end cap 109 from the lower end 101*b* of the cylindrical housing 101 to expose the gripping elements 112 as illustrated in FIG. 18B. The end cap 109 is removed while the pull lever 107 is held up. At this stage, the spring members 119*a* and 119*b* illustrated in FIGS. 4A-4B and FIG. 14B, are compressed and the gripping elements 112 are in the closed position. The pet owner then releases the pull lever 107, causing the spring members 119*a* and 119*b* to decompress, the hollow chamber 108 to move axially in a downward direction, and the braces 113 to expand and open the gripping elements 112 as illustrated in FIG. 18C. The gripping elements 112 open up under spring pressure while slowly releasing the pull lever 107.

The pet owner then manually pulls one of the disposable bags 137 out through the external opening 118*b* of the bag dispenser 118 illustrated in FIG. 4A, FIG. 12A, FIG. 12C, FIG. 15B, and FIG. 16B, and wraps the disposable bag 137 around the opened gripping elements 112 as illustrated in FIG. 18D. Wrapping the opened gripping elements 112 with the disposable bag 137 covers and protects the opened gripping elements 112 from directly contacting the pet waste 1801. The pet owner then positions the wrapped gripping elements 112 over the pet waste 1801. The pet owner then grips the handle 105 and uses fingers on both sides of the pull lever 107 to pull the pull lever 107 axially in an upward direction, causing the spring members 119*a* and 119*b* to compress, the hollow chamber 108 to move axially in an upward direction, and the braces 113 to retract and close the wrapped gripping elements 112 over the pet waste 1801 for picking and storing the pet waste 1801 within the disposable bag 137 as illustrated in FIG. 18E. The user unwraps the closed gripping elements 112 and twists and closes an open end of the disposable bag 137 for encapsulating the pet waste 1801 within the disposable bag 137. In an embodiment, the user rotates the second cylindrical member 103 of the cylindrical housing 101 about the outer wall 102*b* of the first cylindrical member 102 in an opposite direction to lock the pull system 106 and the gripping elements 112 in the closed position as disclosed in the description of FIGS. 9A-9B. To lock the pull system 106, the pet owner rotates the second cylindrical member 103 of the cylindrical housing 101 to align the triangle mark 803 on the first cylindrical member 102 with the circular mark 801 on the second cylindrical member 103 as illustrated in FIG. 9B, which restricts axial movement of the hollow chamber 108 as disclosed in the description of FIG. 9B. While the unwrapped gripping elements 112 are in the closed position, the pet owner attaches the end cap 109 to the lower end 101*b* of the cylindrical housing 101 for enclosing and concealing the gripping elements 112 with the encapsulated pet waste 1801 as illustrated in FIG. 18F, and thereafter transports the encapsulated pet waste 1801 within the device 100 to a disposal location, for example, a waste container or trash can, for subsequent disposal of the disposable bag 137 with the encapsulated pet waste 1801 as disclosed in the description of FIG. 17B. The device 100 allows the pet owner to pick up the pet waste 1801 without touching the pet waste 1801, and carry the encapsulated pet waste 1801 within the device 100 in an odor-free and leak-free manner to toss at the disposal location at a later time.

The device 100 and the method disclosed herein provide a convenient, sanitary method and pleasant experience to users for picking, storing, and disposing pet waste, while handling their pets on-the-go. The device 100 and the method disclosed herein provide an all-in-one solution to clean up pet waste and other animal and non-animal waste. The gripping elements 112 of the device 100 performs a 360-degree pickup of the waste, ensuring a 360-degree cleanup of the waste, without leaving any waste behind. The spring-loaded pull system 106 of the device 100 allows the user to control the tension in gripping the handle 105 and the pull lever 107 together. The user can operate the device 100 with a single hand by gripping the handle 105 in one hand and positioning the user's fingers of the same hand on the pull lever 107 to move the hollow chamber 108 of the pull system 106 through the through-hole 101*c* of the cylindrical housing 101 in an upward direction and a downward direction for picking up the waste. In an embodiment, the device 100 is configured to pick up waste multiple times in a single disposable bag 137. Furthermore, the device 100 is configured to pick up waste from any surface, for example, grass, concrete, ground, sand, soil, mud, gravel, snow, etc. Through the use of the end cap 109 that conceals the picked-up waste encapsulated in the disposable bag 137 within the device 100, the device 100 precludes the waste from contacting and contaminating the user's hands. The secure end cap 109 keeps the device 100 odor-proof and leak-proof. The device 100 allows a non-touch pickup of the waste. The device 100 in the closed condition also conceals the unpleasant odor of the encapsulated waste. Furthermore, the device 100 provides compact and concealed storage for carrying the waste around until a proper disposal site is found. The user, therefore, does not need to rush to find a disposal location. The device 100 and the sanitary method disclosed herein, therefore, precludes serious health hazards for animals and humans.

The foregoing examples and illustrative implementations of various embodiments have been provided merely for explanation and are in no way to be construed as limiting the embodiments disclosed herein. Dimensions of various parts of the waste picking, storage, and disposal device disclosed above are exemplary, and are not limiting of the scope of the embodiments herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

I claim:

1. A device for picking, storing, and disposing waste, the device comprising:

a generally cylindrical housing comprising a first end and a second end, wherein the first end and the second end define a through-hole extending therebetween;

a handle extending upwardly from the first end of the generally cylindrical housing, wherein the handle is configured to be gripped by a user during operation of a pull system;

a plurality of gripping elements radially hinged to the second end of the generally cylindrical housing, wherein the gripping elements extend downwardly from the second end of the generally cylindrical housing;

the pull system disposed axially within the through-hole of the generally cylindrical housing and operably coupled to the gripping elements, wherein the pull system is configured to move axially within the through-hole of the generally cylindrical housing, and wherein the pull system comprises:

a pull lever disposed external to the first end of the generally cylindrical housing, wherein the pull lever is configured to be operated axially in opposing directions to facilitate opening and closing of the gripping elements for picking the waste;

a hollow chamber detachably connected to a lower end of the pull lever and disposed axially within the through-hole extending between the first end and the second end of the generally cylindrical housing, wherein the hollow chamber is configured to store a continuous roll of disposable bags therewithin;

a plurality of braces radially hinged to a lower end of the hollow chamber in a one-to-one correspondence to the gripping elements, wherein each of the braces comprises:

a first end hinged to the lower end of the hollow chamber; and a second end operably hinged to a pair of flanges configured substantially on a mid-section of a corresponding one of the gripping elements for facilitating the opening and the closing of the gripping elements; and a bag dispenser disposed proximal to the lower end of the hollow chamber and to the second end of the generally cylindrical housing for supporting the continuous roll of disposable bags, wherein the bag dispenser comprises an external opening configured to dispense one of the disposable bags stored in the hollow chamber for containing and disposing the waste, and wherein the dispensed one of the disposable bags is configured to be wrapped around the gripping elements to protect the gripping elements from directly contacting the waste, and wherein, when the pull lever is operated axially in the opposing directions, the lower end of the hollow chamber with the bag dispenser moves axially within an internal space defined by the gripping elements, and via the braces, causes the wrapped gripping elements to open and close for picking, encapsulating, and storing the waste within the dispensed one of the disposable bags for subsequent disposal;

spring members supported at the first end of the generally cylindrical housing, on opposing sides of the hollow chamber of the pull system, wherein the spring members are configured to facilitate an upward movement and a downward movement of the pull system; and an end cap detachably attachable to the second end of the generally cylindrical housing, wherein the end cap is configured to enclose and conceal the gripping elements with and without the encapsulated waste.

2. The device of claim 1, wherein a diameter of the lower end of the pull lever of the pull system is substantially larger than a diameter of the through-hole of the generally cylindrical housing.

3. The device of claim 1, wherein the generally cylindrical housing further comprises:

a first cylindrical member extending downwardly from the first end of the generally cylindrical housing;

a second cylindrical member disposed on an outer wall of the first cylindrical member, wherein the second cylindrical member is removably fixed in an axial direction and is rotatable about the outer wall of the first cylindrical member in a circumferential direction for one of allowing and restricting axial movement of the hollow chamber of the pull system; and a third cylindrical member removably connected to the first cylindrical member and extending upwardly from the second end of the generally cylindrical housing, wherein the third cylindrical member is internally connected to the first cylindrical member along the axial direction to define the through-hole for accommodating the pull system.

4. The device of claim 3, further comprising:

a pair of grooves configured diametrically opposite each other on an inner wall of the first cylindrical member of the generally cylindrical housing, wherein the grooves extend along the axial direction; and a pair of sliding blocks configured diametrically opposite each other on an outer wall of the hollow chamber of the pull system, wherein the sliding blocks of the hollow chamber are configured to match and slide within the grooves of the first cylindrical member to facilitate the movement of the pull system axially within the through-hole of the generally cylindrical housing.

5. The device of claim 4, wherein the first cylindrical member of the generally cylindrical housing comprises a slot corresponding to one of the grooves, wherein the slot is configured to accommodate a stopper configured on an inner wall of the second cylindrical member, and wherein the slot is configured to allow the stopper to move therewithin in the circumferential direction for one of blocking and opening the one of the grooves during rotation of the second cylindrical member about the outer wall of the first cylindrical member.

6. The device of claim 5, wherein the first cylindrical member further comprises a slide rail extending circumferentially on the outer wall of the first cylindrical member, wherein the slide rail is configured to slidably accommodate a protruding element configured on the inner wall of the second cylindrical member, and wherein each end of the slide rail comprises a notch matching the protruding element and configured to accommodate the protruding element when the stopper is positioned to one of block and open the one of the grooves during the rotation of the second cylindrical member about the outer wall of the first cylindrical member.

7. The device of claim 1, wherein the pull system further comprises a mounting rod disposed axially within an internal space of the hollow chamber, wherein the mounting rod comprises a first end detachably connected to the lower end of the pull lever, and a second end attached to the bag dispenser, wherein the mounting rod is configured to accommodate the continuous roll of disposable bags thereon within the internal space of the hollow chamber, and wherein the pull lever is detached from the first end of the mounting rod for loading the continuous roll of disposable bags onto the mounting rod.

8. The device of claim 1, wherein the handle is disposed a predetermined distance away from the pull lever of the pull system for allowing movement of the pull lever within a space defined between the handle and the first end of the generally cylindrical housing.

9. The device of claim 1, wherein, operating the pull lever of the pull system in a first direction opens the gripping elements to facilitate ready picking of the waste, and wherein operating the pull lever in a second direction opposing the first direction, closes the gripping elements for storage thereof and for encapsulating and storing the picked waste.

10. The device of claim 1, wherein the end cap comprises:

a generally cylindrical, hollow upper section detachably attachable to the second end of the generally cylindrical housing; and a generally semi-spherical, hollow lower section with a closed end extending downwardly from the generally cylindrical, hollow upper section, wherein the generally cylindrical, hollow upper section and the generally semi-spherical, hollow lower section are together configured to enclose the gripping elements, and wherein the device is configured to form a capsule when the end cap is attached to the second end of the generally cylindrical housing.

11. A device for picking, storing, and disposing waste, the device comprising:

a generally cylindrical housing comprising a first end and a second end, wherein the first end and the second end define a through-hole extending therebetween;

a plurality of gripping elements radially hinged to the second end of the generally cylindrical housing, wherein the gripping elements extend downwardly from the second end of the generally cylindrical housing;

a pull system disposed axially within the through-hole of the generally cylindrical housing and operably coupled to the gripping elements, wherein the pull system is configured to move axially within the through-hole of the generally cylindrical housing, and wherein the pull system comprises:

a pull lever disposed external to the first end of the generally cylindrical housing, wherein the pull lever is configured to be operated axially in opposing directions to facilitate opening and closing of the gripping elements for picking the waste;

a hollow chamber detachably connected to a lower end of the pull lever and disposed axially within the through-hole extending between the first end and the second end of the generally cylindrical housing, wherein the hollow chamber is configured to store a continuous roll of disposable bags therewithin;

a plurality of braces radially hinged to a lower end of the hollow chamber in a one-to-one correspondence to the gripping elements, wherein each of the braces comprises:

a first end hinged to the lower end of the hollow chamber; and a second end operably coupled to a pair of flanges configured substantially on a mid-section of a corresponding one of the gripping elements for facilitating the opening and the closing of the gripping elements; and a bag dispenser disposed proximal to the lower end of the hollow chamber and to the second end of the generally cylindrical housing for supporting the continuous roll of disposable bags, wherein the bag dispenser comprises an external opening configured to dispense one of the disposable bags stored in the hollow chamber for containing and disposing the waste, and wherein the dispensed one of the disposable bags is configured to be wrapped around the gripping elements to protect the gripping elements from directly contacting the waste; and spring members supported at the first end of the generally cylindrical housing, on opposing sides of the hollow chamber of the pull system, wherein the spring members are configured to facilitate an upward movement and a downward movement of the pull system; and wherein, when the pull lever is operated axially in the opposing directions, the lower end of the hollow chamber with the bag dispenser moves axially within an internal space defined by the gripping elements, and via the braces, causes the wrapped gripping elements to open and close for picking, encapsulating, and storing the waste within the dispensed one of the disposable bags for subsequent disposal.

12. The device of claim 11, wherein the generally cylindrical housing further comprises:

a first cylindrical member extending downwardly from the first end of the generally cylindrical housing;

a second cylindrical member disposed on an outer wall of the first cylindrical member, wherein the second cylindrical member is removably fixed in an axial direction and is rotatable about the outer wall of the first cylindrical member in a circumferential direction for one of allowing and restricting axial movement of the hollow chamber of the pull system; and a third cylindrical member removably connected to the first cylindrical member and extending upwardly from the second end of the generally cylindrical housing, wherein the third cylindrical member is internally connected to the first cylindrical member along the axial direction to define the through-hole for accommodating the pull system.

13. The device of claim 12, wherein the first cylindrical member of the generally cylindrical housing comprises:

a pair of grooves configured diametrically opposite each other on an inner wall of the first cylindrical member and extending along the axial direction, wherein an outer wall of the hollow chamber of the pull system comprises a pair of sliding blocks configured diametrically opposite each other and matching the grooves of the first cylindrical member, wherein the sliding blocks of the hollow chamber are configured to slide within the grooves of the first cylindrical member to facilitate the movement of the pull system axially within the through-hole of the generally cylindrical housing;

a slot corresponding to one of the grooves, wherein the slot is configured to accommodate a stopper configured on an inner wall of the second cylindrical member, and wherein the slot is configured to allow the stopper to move therewithin in the circumferential direction for one of blocking and opening the one of the grooves during rotation of the second cylindrical member about the outer wall of the first cylindrical member; and a slide rail extending circumferentially on the outer wall of the first cylindrical member, wherein the slide rail is configured to slidably accommodate a protruding element configured on the inner wall of the second cylindrical member, and wherein each end of the slide rail comprises a notch matching the protruding element and configured to accommodate the protruding element when the stopper is positioned to one of block and open the one of the grooves during the rotation of the second cylindrical member about the outer wall of the first cylindrical member.

14. The device of claim 11, wherein the pull system further comprises a mounting rod disposed axially within an internal space of the hollow chamber, wherein the mounting rod comprises a first end detachably connected to the lower end of the pull lever, and a second end attached to the bag dispenser, wherein the mounting rod is configured to accommodate the continuous roll of disposable bags thereon within the internal space of the hollow chamber, and wherein the pull lever is detached from the first end of the mounting rod for loading the continuous roll of disposable bags onto the mounting rod.

15. The device of claim 11, further comprising a handle extending upwardly from the first end of the generally cylindrical housing, wherein the handle is configured to be gripped by a user during operation of the pull system, and wherein the handle is disposed a predetermined distance away from the pull lever of the pull system for allowing movement of the pull lever within a space defined between the handle and the first end of the generally cylindrical housing.

16. The device of claim 11, further comprising an end cap detachably attachable to the second end of the generally cylindrical housing, wherein the end cap is configured to enclose and conceal the gripping elements with and without the encapsulated waste, and wherein the end cap comprises:

a generally cylindrical, hollow upper section detachably attachable to the second end of the generally cylindrical housing; and a generally semi-spherical, hollow lower section with a closed end extending downwardly from the generally cylindrical, hollow upper section, wherein the generally cylindrical, hollow upper section and the generally semi-spherical, hollow lower section are together configured to enclose the gripping elements, and wherein the device is configured to form a capsule when the end cap is attached to the second end of the generally cylindrical housing.

17. A method for picking, storing, and disposing waste, the method comprising:

providing a device comprising:

a generally cylindrical housing comprising a first end and a second end, wherein the first end and the second end define a through-hole extending therebetween;

a handle extending upwardly from the first end of the generally cylindrical housing;

a plurality of gripping elements radially hinged to the second end of the generally cylindrical housing, wherein the gripping elements extend downwardly from the second end of the generally cylindrical housing;

a pull system disposed axially within the through-hole of the generally cylindrical housing and operably coupled to the gripping elements, wherein the pull system is configured to move axially within the through-hole of the generally cylindrical housing, and wherein the pull system comprises:

a pull lever disposed external to the first end of the generally cylindrical housing, wherein the pull lever is configured to be operated axially in opposing directions to facilitate opening and closing of the gripping elements for picking the waste;

a hollow chamber detachably connected to a lower end of the pull lever and disposed axially within the through-hole extending between the first end and the second end of the generally cylindrical housing, wherein the hollow chamber is configured to store a continuous roll of disposable bags therewithin;

a plurality of braces radially hinged to a lower end of the hollow chamber in a one-to-one correspondence to the gripping elements, wherein each of the braces comprises:

a first end hinged to the lower end of the hollow chamber; and a second end operably hinged to a pair of flanges configured substantially on a mid-section of a corresponding one of the gripping elements for facilitating the opening and the closing of the gripping elements; and a bag dispenser disposed proximal to the lower end of the hollow chamber and to the second end of the generally cylindrical housing for supporting the continuous roll of disposable bags, wherein the bag dispenser comprises an external opening configured to dispense one of the disposable bags stored in the hollow chamber for containing and disposing the waste;

spring members supported at the first end of the generally cylindrical housing, on opposing sides of the hollow chamber of the pull system, wherein the spring members are configured to facilitate an upward movement and a downward movement of the pull system; and an end cap detachably attachable to the second end of the generally cylindrical housing, wherein the end cap is configured to enclose and conceal the gripping elements;

gripping the handle of the device and holding up the pull lever attached to the hollow chamber of the pull system, causing the spring members to compress, while detaching the end cap of the device from the second end of the generally cylindrical housing of the device to expose the gripping elements of the device in a closed position;

releasing the pull lever, causing the spring members to decompress and the braces of the pull system to expand and open the gripping elements;

manually pulling one of the disposable bags out through the external opening of the bag dispenser of the pull system and wrapping the one of the disposable bags around the opened gripping elements to protect the opened gripping elements from directly contacting the waste;

positioning the wrapped gripping elements of the device over the waste;

gripping the handle and pulling the pull lever, causing the spring members to compress and the braces to retract and close the wrapped gripping elements over the waste for picking and storing the waste within the one of the disposable bags;

unwrapping the closed gripping elements and twisting and closing an open end of the one of the disposable bags for encapsulating the waste within the one of the disposable bags; and attaching the end cap to the second end of the generally cylindrical housing for enclosing and concealing the closed gripping elements with the encapsulated waste and thereafter transporting the encapsulated waste within the device to a disposal location for subsequent disposal of the one of the disposable bags with the encapsulated waste at the disposal location.

18. The method of claim 17, wherein the subsequent disposal of the one of the disposable bags with the encapsulated waste comprises:

detaching the end cap from the second end of the generally cylindrical housing of the device to expose the closed gripping elements with the encapsulated waste;

releasing the pull lever, causing the spring members to decompress and the braces to expand and open the closed gripping elements for releasing the one of the disposable bags with the encapsulated waste, wherein the releasing of the one of the disposable bags with the encapsulated waste from the opened gripping elements dispenses another one of the disposable bags from the external opening of the bag dispenser of the pull system for subsequent picking, storing, and disposal of other waste; and disposing the released one of the disposable bags with the encapsulated waste at the disposal location.

19. The method of claim 17, further comprising locking the pull system by restricting axial movement of the hollow chamber of the pull system using a stopper configured in the generally cylindrical housing of the device.

20. The method of claim 17, further comprising loading the continuous roll of disposable bags into the hollow chamber of the pull system by detaching the pull lever of the pull system from an upper end of the hollow chamber.

* * * * *